US008067997B2

(12) United States Patent
Melde et al.

(10) Patent No.: US 8,067,997 B2
(45) Date of Patent: Nov. 29, 2011

(54) APPARATUS AND METHOD OF SELECTING COMPONENTS FOR A RECONFIGURABLE IMPEDANCE MATCH CIRCUIT

(75) Inventors: Kathleen Lowe Melde, Tucson, AZ (US); Richard B. Whatley, Nashua, NH (US)

(73) Assignee: The Arizona Board of Regents on Behalf of the University of Arizona, Tucson, AZ (US)

( * ) Notice: Subject to any disclaimer, the term of this patent is extended or adjusted under 35 U.S.C. 154(b) by 343 days.

(21) Appl. No.: 12/093,144

(22) PCT Filed: Nov. 9, 2006

(86) PCT No.: PCT/US2006/043694

§ 371 (c)(1), (2), (4) Date: Dec. 22, 2008

(87) PCT Pub. No.: WO2007/058910

PCT Pub. Date: May 24, 2007

(65) Prior Publication Data

US 2009/0167457 A1 Jul. 2, 2009

Related U.S. Application Data

(60) Provisional application No. 60/736,117, filed on Nov. 10, 2005.

(51) Int. Cl.
*H03H 7/38* (2006.01)

(52) U.S. Cl. ..... 333/17.3; 333/32

(58) Field of Classification Search ..... 333/17.3, 333/32, 33

See application file for complete search history.

(56) References Cited

U.S. PATENT DOCUMENTS

| | | | | |
|---|---|---|---|---|
| 5,594,807 | A | 1/1997 | Liu | |
| 5,619,138 | A | 4/1997 | Rourke | |
| 6,208,225 | B1 | 3/2001 | Miller | |
| 6,531,936 | B1 | 3/2003 | Chiu | |
| 7,586,384 | B2 * | 9/2009 | Ranta | 333/17.3 |
| 2005/0040912 | A1 | 2/2005 | Pelz | |
| 2005/0195541 | A1 | 9/2005 | Chen et al. | |
| 2005/0245204 | A1 | 11/2005 | Vance | |

OTHER PUBLICATIONS

Rizk, Jad B. et al., "Design of X-Band MEMS Microstrip Shunt Switches", Gallium Arsenide Applications Symposium (2000).

* cited by examiner

*Primary Examiner* — Stephen Jones

(74) *Attorney, Agent, or Firm* — Oblon, Spivak, McClelland, Maier & Neustadt, L.L.P.

(57) ABSTRACT

A method of selecting component values for an analog circuit includes identifying a cost function that evaluates similarity between an approximate frequency response function and a preferred frequency response function for at least one characteristic of the functions, determining the approximate frequency response function of the analog circuit based on an approximate component value, and changing the approximate component value based on a determined magnitude of similarity between the preferred frequency response function and the approximate frequency response function for the at least one characteristic. An impedance matching apparatus includes a mismatch detection circuit that produces a difference between source and load impedances, a match network controller that produces a control value based on the difference, and a reconfigurable varactor match network including at least one stub mounted varactor having a capacitance controlled by the control value to match the source and load impedances.

11 Claims, 33 Drawing Sheets

S-PARAMETERS

```
S_Param
SP2
Start=3GHz
Stop=7GHz
Step=10MHz
```

```
MeasEqn
Meas12
srtSignal=sort(db(S11[100::300])),"ascending")

MeasEqn
Meas9
pow_3=pow(sigdev,3)

MeasEqn
Meas10
sum_3=sum(pow_3)

MeasEqn
Meas6
pow_4pow(sigdev,4)

MeasEqn
Meas7
sum_4=sum(pow_4)

MeasEqn
Meas11
Skewness=sum_3/(200*pow(STDev,3))

MeasEqn
Meas1
Fitness=8.5*abs(Mean)-8.2*Kurtosis-35*abs(Skewness)-Penalty

MeasEqn
Meas13
Penalty=if(abs(db(S11[100::300]))<10) then 90 else 0

MeasEqn
Meas2
STDev=stddev(srtSignal)

MeasEqn
Meas3
Mean=mean(srtSignal)

MeasEqn
Meas5
sigdev=srtSignal-Mean

MeasEqn
Meas8
Kurtosis=sum_4/(200*pow(STDev,4))-3
```

GOAL

```
Goal
OptimGoal17
Expr="Fitness"
SiminstanceName="SP2"
Min=90
Max=120
Weight=5
RangeVar[1]=
RangeMin[1]=
RangeMax[1]=
```

OPTIM

```
Optim
Optim2
optimType=Random
ErrorForm=L2
Maxiters=100
DesiredError=0.0
StatusLevel=4
FinalAnalysis="SP2"
NormalizeGoals=no
SelBestValues=yes
Seed=
SaveSolns=yes
SaveGoals=yes
SaveOptimVars=yes
UpdateDataset=yes
SaveNominal=yes
SaveAlterations=no
UseAllOptVars=yes
UseAllGoals=yes
SaveCurrentEF=no
```

*Fig. 18*

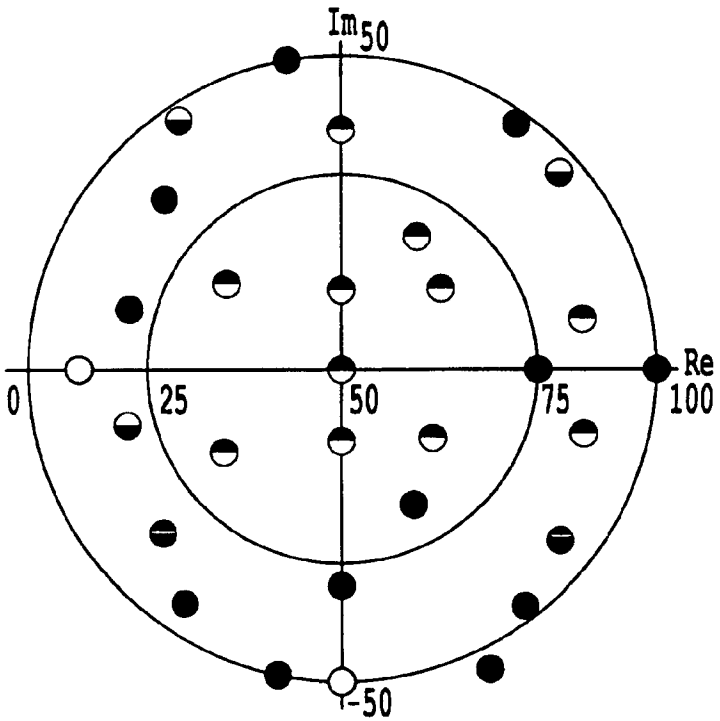
Fig. 21B
AFTER TUNING
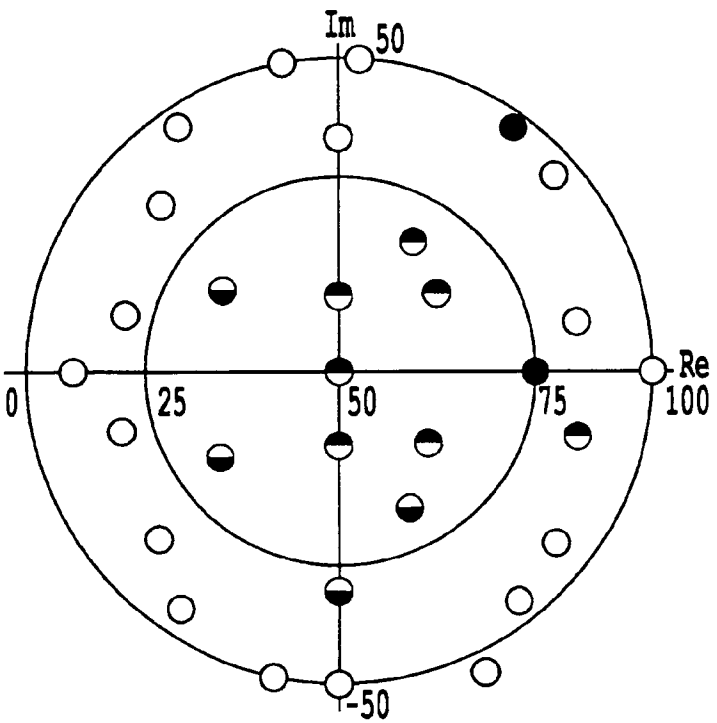
Fig. 21A
BEFORE TUNING
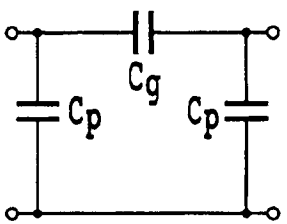
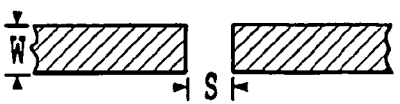
Fig. 22

BANDWIDTH PERFORMANCE FOR MATCHING VARIOUS LOADS

APPARATUS AND METHOD OF SELECTING COMPONENTS FOR A RECONFIGURABLE IMPEDANCE MATCH CIRCUIT

CROSS-REFERENCE TO A RELATED APPLICATION

This application claims priority to U.S. provisional application No. 60/736,117, filed on Nov. 10, 2005, which is incorporated herein by reference in its entirety.

BACKGROUND OF THE INVENTION

1. Field of the Invention

The present invention relates to the field of broadband wireless radio frequency (RF) communications, and in particular to a reconfigurable impedance match circuit, which may be used in broadband wireless devices and a method for selecting component values for analog circuits.

2. Discussion of the Background

In the past decade the need for broadband communications has increased rapidly. With this increased need the inadequacies of current systems has become apparent. In order to increase performance much research has been done on different modulation schemes and codecs, different antennas, and transmission circuits. An often overlooked but potentially highly limiting factor in the bandwidth performance of a system is the impedance match between important elements in the system.

Conventional impedance matching solutions are often accomplished in a static sense. For example, the impedances of transmission circuits and antennas may be calculated at design time and a static matching case may be built into the design. However, this approach may not adequately account for significant circuit element impedance changes that may occur during the life of the system, which may invalidate the static matching case.

For example, a cellular phone antenna may have clearly defined impedance parameters in its nominal state to which the static matching structure may be designed. If the user were to place a hand over the antenna during operation, the reactive impedance of the antenna would greatly change. In order for the transmission system to function correctly it must radiate a certain amount of energy. Since the antenna impedance is now changed, much of the energy is reflected back to the transmission circuit from the antenna, resulting in a lower radiated energy from the antenna. Since the cellular phone needs to radiate a certain amount of energy and less is now being radiated due the impedance mismatch, the phone reacts by increasing the output from the transmitting circuit, resulting in a an efficiency decrease, which may not be prevented when using a static matching network.

Reconfigurable matching networks can be changed if a certain matching case is no longer valid. In recent years there has been quite a bit of interest in circuits utilizing MEMS (Micro-Electromechanical Systems) technology. MEMS devices often use switches and capacitors in a matching network to change the performance of a periodic structure.

J. Papapolymerou, et al., "Reconfigurable Double-Stub Tuners Using MEMS Switches for Intelligent RF Front-Ends," *IEEE Trans. Microwave Theory and Techniques*, vol. 51, no. 1, January 2003, which is incorporated herein by reference in its entirety, describes a simple two stub impedance matching network using MEMS that may have interesting properties. This double stub tuner can be configured to match a fairly wide range of loads. Reconfiguring the structure is accomplished by capacitive loading of the two stubs in the matching network. The amount of capacitive loading is determined by a bank of capacitors, selectively picked using MEMS switches. A problem with this approach lies in the aspect that a discrete set of loads can be matched. The greater the desired matching load, the larger the capacitor bank and number of required switches. Additionally the operation of the circuit may be restricted to a narrow bandwidth, estimated to be 10%-15% using $\lambda/2$ resonators, with bandwidth defined as the 3 dB attenuation point.

Later, Y. Lu, et al., "A MEMS Reconfigurable Matching Network for a Class AB Amplifier," *IEEE Microwave and Wireless Components Letters*, vol. 13, no. 10, pp. 437-439, October 2003, which is incorporated herein by reference in its entirety, used the same double stub tuner approach as discussed in Papapolymerou to design a matching network for use in a power amplifier system. Since it was essentially the same circuit as proposed in Papapolymerou, the impedance matching structure proposed by Lu may also suffer from low bandwidth and discrete tuning limitations.

Hunter et al., "Electronically Tunable Microwave Bandpass Filters," *IEEE Trans. Microwave Theory and Techniques*, vol. MTT-30, no. 9, pp. 1354-1360, September 1982, which is incorporated herein by reference in its entirety, describes an electronically tunable bandpass filter, which can be used as an impedance matching network. Further, Hunter describes a 5% band-pass filter having the pass band constrained to the 3 dB attenuation points. The physical realization described in Hunter includes a comb-line filter on microstrip with varactor diodes loading the ends of short circuited fingers. However, the structure of Hunter has narrow bandwidth and poor insertion loss properties (nearly 6 dB). The varactor diode in Hunter has a limited range of capacitance, which affects the reconfigurable nature of the circuit. Makimoto et al., "Varactor Tuned Bandpass Filters Using Microstrip-line Ring Resonators," *IEEE MTT-S Digest*, pp. 411-414, 1986, which is incorporated herein by reference in its entirety, describes a reconfigurable band-pass filter implementation having a combination of varactor diodes and ring resonators. Makimoto mentions altered coupling between resonators but does not describe such an implementation.

Thus, conventional reconfigurable networks may rely on the user having particular advanced knowledge regarding a mismatch between load and source. In addition, it may be desirable for users to have a straightforward method for determining adjustments of the reconfigurable network needed to account for a load mismatch. Unfortunately, conventional solutions may not adequately provide methods to detect and use information regarding source and load impedance disparity.

Mingo, et al., "An RF Electronically Controlled Impedance Tuning Network Design and Its Application to an Antenna Input Impedance Automatic Matching System," *IEEE Trans. Microwave Theory and Techniques*, vol. 52, no. 2, pp. 489-497, February 2004, which is incorporated herein by reference in its entirety, presents a high frequency front end system operating at 390 MHz, including an impedance matching network connected to a coupler that detects a mismatch in impedance, and an algorithm to correct the detected mismatch. However, the impedance matching network of Mingo uses a discrete tuning method much like earlier MEMS devices. Instead of MEMS switches, however, p-i-n diodes were used to activate different banks of capacitors, limiting a resulting system to function over discrete loads. Furthermore, the device described by Mingo has a narrow bandwidth, and Mingo fails to describe a detailed scheme for detecting the mismatch between source and load Thus, Mismatches in the impedance characteristics between the source and load of many broadband applications are an often overlooked but limiting factor in the performance of a broadband system. To correct for mismatches in impedance, transformers and matching circuits are classically used. In general, impedance matching components are developed for a static sense and function only with non-varying source and load impedances. If the impedance of either the source or load changes, however, the efficiency and bandwidth characteristics can suffer as a result.

SUMMARY OF THE INVENTION

A broadband reconfigurable matching circuit can be used to correct impedance mismatch. In the past, reconfigurable networks functioned over very narrow bandwidth and required user interaction to decide the best method for tuning out a mismatch. The automatic RF match control system described here not only functions in high bandwidth applications, but also provides elements to eliminate the need for user intervention.

Accordingly, one object of the invention is to provide a novel method of selecting a component value for a component in an analog circuit, the method comprising steps of: identifying a cost function that evaluates a magnitude of a similarity between an approximate frequency response function and a preferred frequency response function for at least one characteristic of the functions; determining the approximate frequency response function of the analog circuit based on an approximate value of the component; determining the magnitude of the similarity between the preferred frequency response function and the approximate frequency response function for the at least one characteristic of the functions; and changing the approximate value of the component in the analog circuit based on the determined magnitude to select the component value.

Another object of the invention is to provide a novel method of selecting, as above and further comprising decreasing the magnitude of the similarity prior to the changing when a value of the approximate frequency response function exceeds a predetermined threshold.

Another object of the invention is to provide a novel method of selecting, as above and further comprising selecting the at least one characteristic of the functions to be at least one of a mean value of the function in a passband, a flatness value of the function in the passband, and a skewness value of the function in the passband.

Another object of the invention is to provide a novel method of selecting, as above and further comprising determining the flatness value of the function in the passband based on the fourth statistical moment of the function in the passband.

Another object of the invention is to provide a novel method of selecting, as above and further comprising determining the skewness value of the function in the passband based on the third statistical moment of the function in the passband.

Another object of the invention is to provide a novel method of selecting, as above and further comprising determining the mean value of the function in the passband based on the first statistical moment of the function in the passband.

Another object of the invention is to provide a novel method of selecting, as above, wherein the cost function is defined as:

$$\text{Cost} = a \cdot |\mu_x| - b \cdot \left| \frac{\sum (X - \mu_x)^4}{N\sigma_x^4} - 3 \right| - c \cdot \left| \frac{\sum |X - \mu_x|}{N\sigma_x^3} \right| - \text{Penalty}$$

where Cost is the magnitude of the similarity of the approximate and preferred frequency response functions, a is a weighting factor for the mean value of the approximate frequency response function, b is a weighting factor for the flatness value of the approximate frequency response function, c is a weighting factor for the skewness value of the approximate frequency response function, $\mu_x$ is the mean value of the approximate frequency response function in the passband, X is a value of the approximate frequency response function in the passband, N is a number of values in the approximate frequency response function in the passband, $\sigma_x$ is the standard deviation of the approximate frequency response function in the passband, and Penalty is an amount of reduction of the magnitude of the similarity when the approximate frequency response function exceeds a predetermined threshold in the passband.

Another object of the invention is to provide a novel impedance matching apparatus for matching an impedance of a source to an impedance of a load, the apparatus comprising: a mismatch detection circuit connected to the load and configured to receive information regarding the impedance of the source, determine the impedance of the load, and produce a difference between the source and load impedances; a match network controller configured to receive the difference between the source and load impedances from the mismatch detection circuit and produce a control value based on the difference; and a matching network including a continuously variable impedance controlled by the control value to match the impedance of the source to the impedance of the load.

Another object of the invention is to provide a novel impedance matching apparatus, as above, wherein the matching network includes at least one varactor configured to be controlled by the control value from the match network to vary a capacitance of the varactor.

Another object of the invention is to provide a novel impedance matching apparatus, as above, wherein at least one of the at least one varactor is mounted on a stub.

Another object of the invention is to provide a novel impedance matching apparatus, as above, wherein the reconfigurable varactor match network includes plural shunt resonant stubs with a varactor in each stub, and the control value includes a varactor control voltage for each varactor.

Another object of the invention is to provide a novel impedance matching apparatus, as above, wherein the plural shunt resonant stubs are symmetrically arranged around a central resonator located in between the source and the load.

Another object of the invention is to provide a novel impedance matching apparatus impedance matching apparatus for matching an impedance of a source to an impedance of a load, the apparatus comprising: a mismatch detection circuit connected to the load and configured to receive information regarding the impedance of the source, determine the impedance of the load, and produce a difference between the source and load impedances; a match network controller configured to receive the difference between the source and load impedances from the mismatch detection circuit and produce a control value based on the difference; and means connected between the source and the load for varying a continuously variable impedance based on the control value to match the impedance of the source with the impedance of the load.

Another object of the invention is to provide a novel impedance matching apparatus, as above, wherein the mismatch detection circuit further comprises: a first four port coupler including a first input port connected to the source, a first through port, a first coupled port, and a first isolated port; a second four port coupler including a second input port connected to the first through port of the first four port coupler, a second through port connected to the load, a second coupled port, and a second isolated port connected to the first isolated port of the first four port coupler; a current sensing resistor having a first end connected to the isolated port of the first four port coupler, the isolated port of the second four port coupler, and an anode of a first input diode; the first input diode having a cathode connected to a first end of a first capacitor and a first end of a first input resistor; the first capacitor having a second end connected to ground; the first input resistor having a second end connected to a non-inverting input of a first operational amplifier, a cathode of a first output diode, and a first end of a first output resistor; the first output diode having an anode connected to an output of the first operational amplifier; the first operational amplifier having a non-inverting input connected to ground; the first output resistor having a second end connected to ground; a second input diode having an anode connected to the second coupled port of the second four port coupler and a first end of a voltage sensing resistor, and a cathode connected to a first end of a second capacitor and a first end of a second input resistor; the voltage sensing resistor having a second end connected to ground; the second capacitor having a second end connected to ground; the second input resistor having a second end connected to a non-inverting input of a second operational amplifier, a first end of a second output resistor, and a cathode of a second output diode; the second output diode having an anode connected to an output of the second operational amplifier; the second output resistor having a second end connected to ground; and the second operational amplifier having an inverting input connected to ground, wherein a voltage difference between the outputs of the first and second operational amplifiers represents the magnitude of the impedance difference.

Another object of the invention is to provide a novel mismatch detection circuit configured to detect a magnitude of an impedance difference between an impedance of a source and an impedance of a load, the apparatus comprising: a first four port coupler including a first input port connected to the source, a first through port, a first coupled port, and a first isolated port; a second four port coupler including a second input port connected to the first through port of the first four port coupler, a second through port connected to the load, a second coupled port, and a second isolated port connected to the first isolated port of the first four port coupler; a current sensing resistor having a first end connected to the isolated port of the first four port coupler, the isolated port of the second four port coupler, and an anode of a first input diode; the first input diode having a cathode connected to a first end of a first capacitor and a first end of a first input resistor; the first capacitor having a second end connected to ground; the first input resistor having a second end connected to a non-inverting input of a first operational amplifier, a cathode of a first output diode, and a first end of a first output resistor; the first output diode having an anode connected to an output of the first operational amplifier; the first operational amplifier having a non-inverting input connected to ground; the first output resistor having a second end connected to ground; a second input diode having an anode connected to the second coupled port of the second four port coupler and a first end of a voltage sensing resistor, and a cathode connected to a first end of a second capacitor and a first end of a second input resistor; the voltage sensing resistor having a second end connected to ground; the second capacitor having a second end connected to ground; the second input resistor having a second end connected to a non-inverting input of a second operational amplifier, a first end of a second output resistor, and a cathode of a second output diode; the second output diode having an anode connected to an output of the second operational amplifier; the second output resistor having a second end connected to ground; and the second operational amplifier having an inverting input connected to ground, wherein a voltage difference between the outputs of the first and second operational amplifiers represents the magnitude of the impedance difference.

Another object of the invention is to provide a novel computer program product storing program instructions which, when executed by a computer to select a component value for a component in an analog circuit, result in the computer performing steps comprising: identifying a cost function that evaluates a magnitude of a similarity between an approximate frequency response function and a preferred frequency response function for at least one characteristic of the functions; determining the approximate frequency response function of the analog circuit based on an approximate value of the component; determining the magnitude of the similarity between the preferred frequency response function and the approximate frequency response function for the at least one characteristic of the functions; and changing the approximate value of the component in the analog circuit based on the determined magnitude to select the component value.

Another object of the invention is to provide a novel computer program product, as above and wherein said program instructions result in the computer performing a step of decreasing the magnitude of the similarity prior to the changing when a value of the approximate frequency response function exceeds a predetermined threshold.

Another object of the invention is to provide a novel computer program product, as above and wherein said program instructions result in the computer performing a step of selecting the at least one characteristic of the functions to be at least one of a mean value of the function in a passband, a flatness value of the function in the passband, and a skewness value of the function in the passband.

Another object of the invention is to provide a novel computer program product, as above and wherein said program instructions result in the computer performing a step of determining the flatness value of the function in the passband based on the fourth statistical moment of the function in the passband.

Another object of the invention is to provide a novel computer program product, as above and wherein said program instructions result in the computer performing a step of determining the skewness value of the function in the passband based on the third statistical moment of the function in the passband.

Another object of the invention is to provide a novel computer program product, as above and wherein said program instructions result in the computer performing a step of determining the mean value of the function in the passband based on the first statistical moment of the function in the passband.

Another object of the invention is to provide a novel computer program product, as above, wherein the cost function is defined as:

$$\text{Cost} = a \cdot |\mu_x| - b \cdot \left| \frac{\sum (X - \mu_x)^4}{N\sigma_x^4} - 3 \right| - c \cdot \left| \frac{\sum |X - \mu_x|}{N\sigma_x^3} \right| - \text{Penalty}$$

where Cost is the magnitude of the similarity of the approximate and preferred frequency response functions, a is a weighting factor for the mean value of the approximate frequency response function, b is a weighting factor for the flatness value of the approximate frequency response function, c is a weighting factor for the skewness value of the approximate frequency response function, $\mu_x$ is the mean value of the approximate frequency response function in the passband, X is a value of the approximate frequency response function in the passband, N is a number of values in the approximate frequency response function in the passband, $\sigma_x$ is the standard deviation of the approximate frequency response function in the passband, and Penalty is an amount of reduction of the magnitude of the similarity when the approximate frequency response function exceeds a predetermined threshold in the passband.

BRIEF DESCRIPTION OF THE DRAWINGS

A more complete description of the invention and many of the attendant advantages thereof will be readily obtained as the same becomes better understood by reference to the following detailed description when considered in connection with the accompanying drawings, wherein:

FIG. 18 shows example objects and syntax used in ADS to implement a cost function;

FIGS. 21A and 21B show the ability of the 10 stub tuner to match certain loads, before and after tuning, respectively;

FIG. 22 includes a physical and schematic representation of a microstrip gap, and the associated capacitance properties;

DESCRIPTION OF THE PREFERRED EMBODIMENTS

With the high bandwidth and vastly changing load profiles prevalent in many wireless systems, the present inventors recognize that it would be advantageous to develop a device having an intelligent RF front end that is capable of effectively matching a wide range of loads with high bandwidth, detecting a mismatch between the source and load impedances, and having the ability to correct this mismatch. Ideally, the device should be highly efficient with very low insertion loss properties over a broad range of tunable loads and frequency ranges.

An automatic match control (AMC) system according to the present invention may provide an intelligent RF front end that can sense a mismatch in impedance between the source and load of a circuit, and then react to minimize this mismatch. Further, such an automatic match control system may have a continuous load matching capability, and is not limited to simply tuning a discrete arrangement of load impedances.

Figure 1:
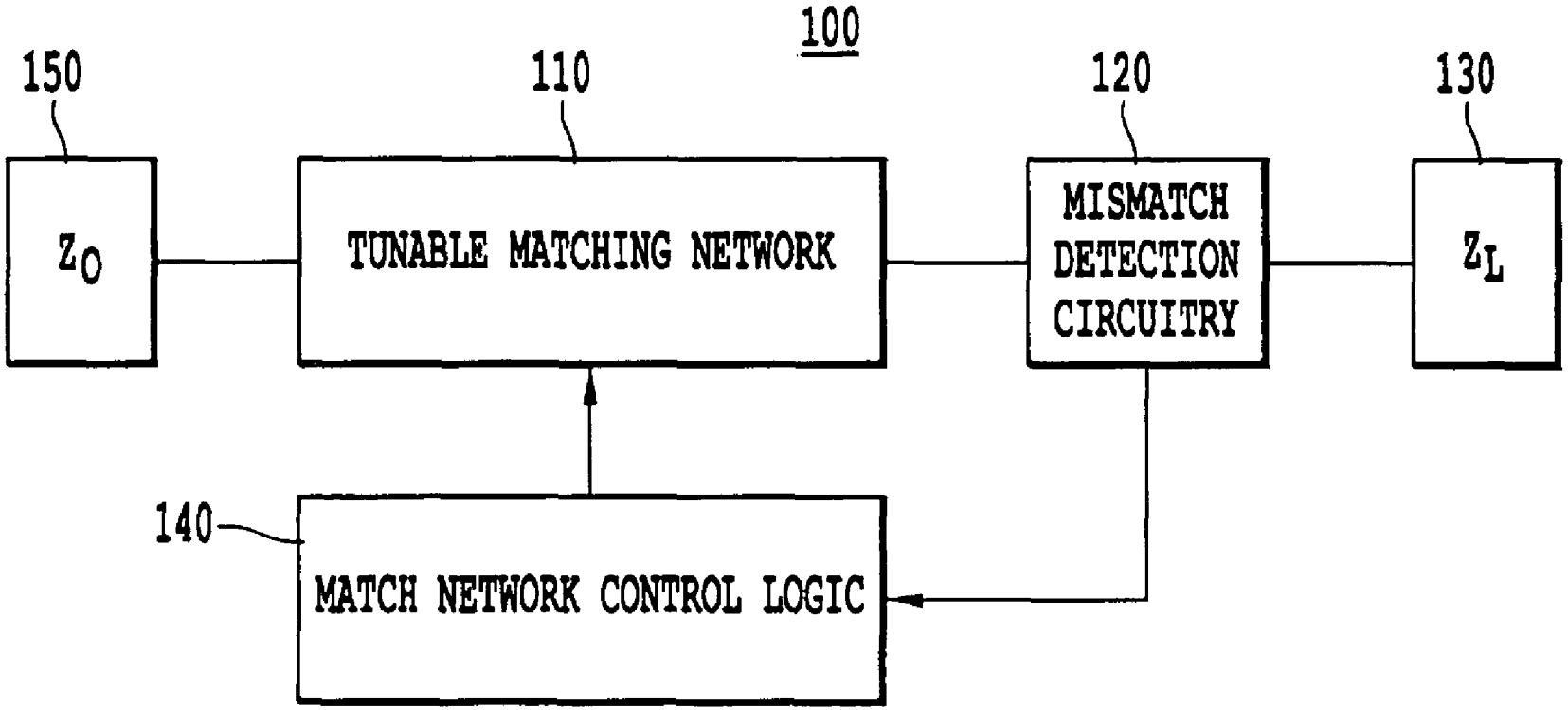
FIG. 1 is a block diagram of an embodiment of an Automatic Matching Circuit according to the present invention.

Referring now to the drawings, wherein like reference numerals designate identical or corresponding parts throughout the several views. FIG. 1 is a block diagram of an embodiment of an AMC 100 according to the present invention, including source impedance $Z_O$ 150 connected to a tunable matching network 110, which is connected to mismatch detection circuitry 120 and match network control logic 140. The mismatch detection circuitry 120 is connected to an output load $Z_L$ 130 and the match network control logic 140. AMC 100 may provide instantaneous bandwidth greater than 25% and may be tunable to function with the same instantaneous bandwidth over an extensive range of loads, real and reactive. Test results included below indicate that embodiments of the invention are capable of matching of a wide array of loads using varactor diodes that are commercially available over many frequency ranges. Table 1.1 shows properties of the tunable matching network 110 in the present embodiment, although other properties may also be achieved by making variations to the present embodiment according to the teachings herein, as would be understood by one of skill in the art of RF communication circuit design.

TABLE 1.1

Reconfigurable Impedance Matching Network Properties

| | |
|---|---|
| Center Frequency | 5 GHz |
| Instantaneous Bandwidth (Maximum continuous range @−10 dB Return Loss) | 40% |
| Matching Range | $25 \leqq R \leqq 100 + j(-50 \leqq X \leqq 50)$ |

The present inventors have designed and extensively simulated embodiments of the AMC 100, and have fabricated and tested microstrip implementations of the AMC 100. Investigations have been conducted on the fabricated device to determine the electrical properties of the device as well as possible inadequacies. A wide range of circuit topologies for the matching network have been studied and are presented with one method proposed above the others.

The purpose of the mismatch detection circuit 120 is to detect the standing wave ratio, a result of the mismatch of the source and load impedances. Ideally this circuit detects the standing wave ratio without changing the match by introducing loading or interference on the system it is designed to measure. The match network control logic 140 is configured to receive information on the mismatch between the source and load and make a decision on the corrective action. Action taken will be in the form of providing biasing information for the tunable elements in the tunable matching network 140. Since the matching network is controlled by varactor diodes, the behavior of the network may be controlled by the biasing of those diodes. The match network control logic determines the best biasing levels based on the mismatch between source and load detected by the mismatch detection circuit 120, and accordingly, provides information to bias the varactor diodes in the tunable matching network 110. Design details regarding the match network control logic 140 are not discussed herein, but are known to those of normal skill in the art of RF communication circuit design.

Conventional solutions did not address impedance matching at the bandwidths presented here. In addition, conventional solutions may fail to adequately detect a mismatch between a source and load impedance or provide a method for compensating for this mismatch. On the other hand, the AMC system 100 may provide intelligent impedance matching over a large bandwidth at microwave frequencies, and may match a wide range of real and reactive loads, with efficient power usage and simple fabrication requirements.

In high frequency applications, when source and load impedances are not matched, certain inefficiencies may arise in the system, and energy delivered to the load from the source may be reflected back to the source, causing a drop in system efficiency. The reflection of energy may be described by the reflection coefficient: Γ

$$\Gamma = \frac{Z_{load} - Z_{src}}{Z_{load} + Z_{src}} \tag{1}$$

If Γ=0 then all energy from the source may be completely delivered to the load. Similarly, if Γ=1, all energy delivered to the load from the source may be reflected back towards the source. An impedance matching network may change the load impedance seen from the source such that Γ is minimized. The continuous frequency range over which Γ is attenuated to a point below −10 dB is referred to as the bandwidth of the impedance matching network.

An important metric in determining the match between a source and load impedance is the standing wave ratio (SWR). The SWR is used to define the ratio of maximum and minimum power in a standing wave pattern. If there is no standing wave pattern (in cases of a perfect match), the SWR will be unity. Relating the reflection coefficient to the standing wave ratio we have, as described in Pozar:

$$SWR = \frac{1 + |\Gamma|}{1 - |\Gamma|} \tag{2}$$

Other interesting properties of a mismatched system are the return loss and insertion loss. The return loss is the ratio of power delivered to the load, to power reflected back to the source from the load. This can be expressed in terms of the reflection coefficient:

$$RL = -20 \log(|\Gamma|) \tag{3}$$

The power lost in a system resulting from a mismatch in source and load impedances is often called the insertion loss and is given by:

$$IL = -10 \log(1 - |\Gamma|^2) \tag{4}$$

As the standing wave ratio increases the reflected power becomes comparable in magnitude to the incident power in the system as shown in Table 2.1.

TABLE 2.1

Properties of a Mismatched System

| SWR | Γ | RL (dB) | IL (dB) |
|---|---|---|---|
| 1 | 0.00 | undef | 0.00 |
| 1.1 | 0.05 | 26.4 | 0.01 |
| 1.5 | 0.20 | 14.0 | 0.18 |
| 2 | 0.33 | 9.50 | 0.50 |

TABLE 2.1-continued

| Properties of a Mismatched System | | | |
|---|---|---|---|
| SWR | Γ | RL (dB) | IL (dB) |
| 3 | 0.50 | 6.0. | 1.25 |
| 5 | 0.67 | 3.52 | 2.55 |
| 10 | 0.82 | 1.74 | 4.80 |

As discussed above, conventional impedance matching networks may be designed to match a static set of source and load impedances (e.g., conventional solutions may further assume that $Z_L$ and $Z_0$ are constant and do not vary much with frequency). Performance of the circuit at different impedances may vary significantly, depending on the impedance matching method. In practice, it is not uncommon that source and load impedances not only vary with frequency, but often vary at a fixed frequency. Thus, performance and ability to match impedances outside ideal loading circumstances may be advantageous. The present inventors have selected the use of a periodic structure or filter, with movable resonators (with respect to resonant frequency), to overcome some of the problems with conventional impedance matching structures.

In microwave electronics, a periodic structure is a transmission line with loaded reactive elements placed at regular intervals. These reactive elements form resonators. Often reactive elements can be formed in a microstrip transmission line by introducing discontinuities. These discontinuities can take various forms including gaps, tees, cuts, or bends in the structure, depending on the transmission line elements used. In a microstrip, reactive elements may be formed using short or open stubs, circular ring resonators, square patch resonators, or circular disk resonators, for example. In a filter or periodic structure, the coupling between these resonators can be accomplished by incorporating other reactive elements or discontinuities. Depending on the desired network performance and transmission line medium used, certain resonator types may have superior properties.

Since these resonators are periodically connected, they may also be considered to be capacitively or inductively coupled, or both. Depending on the transmission line medium chosen, a physical realization of resonators in an inductively coupled configuration may be difficult. Thus, it may be desirable to include structures that are capacitive coupled.

Ladder Filter Prototype

Figure 2:
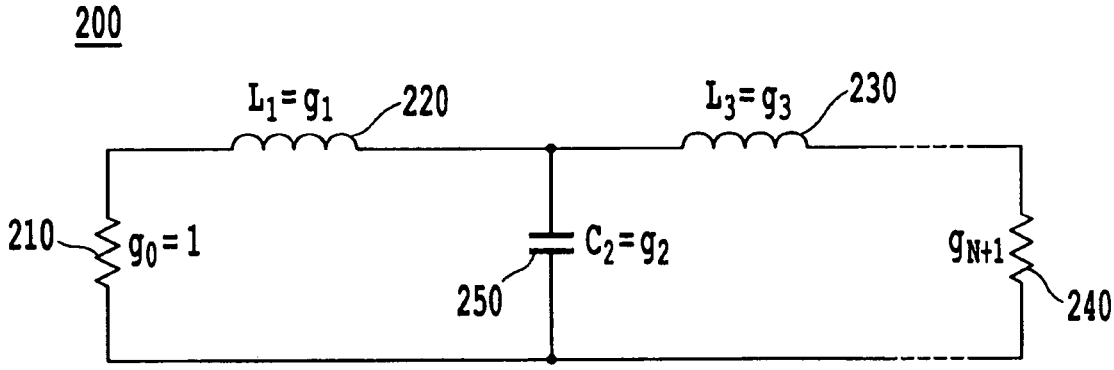
FIG. 2 is a circuit diagram of an embodiment of a lowpass ladder filter circuit configured to synthesize a periodic structure.

FIG. 2 is a circuit diagram of an embodiment of a lowpass ladder filter circuit 200 configured to synthesize a periodic structure. The ladder circuit 200 includes resistor 210 connected in parallel to series connected inductor 220 and capacitor 250. Further, the ladder circuit 200 includes inductor 230 connected at a first end to the node at which capacitor 250 and inductor 220 are joined, at a first end of capacitor 250. Plural resistors 240 are connected in parallel to one another and connected, at a first end, to the second end of inductor 240 and a second end of capacitor 250. $g_0$ through $g_{N+1}$ refer to element coefficient variables as discussed below. The ladder circuit 200 may not account for any frequency or impedance scaling. Since the inductor 220 is the leading element it is assumed that the generator is a voltage source. Component values for the resistors, capacitor, and inductors may be based on a desired passband response and can be Butterworth, Tchebyscheff, Elliptical, or any other type of periodic coefficients, as known to one of skill in the art, for example, as described in Pozar, David M., *Microwave Engineering: Second Edition*, New York: John Wiley & Sons Inc., 1998, which is incorporated herein by reference in its entirety.

If a bandpass periodic structure is desired, as in an impedance matching network, the appropriate frequency, impedance, and behavioral transformations can be used to convert the lowpass filter.

Figure 3:
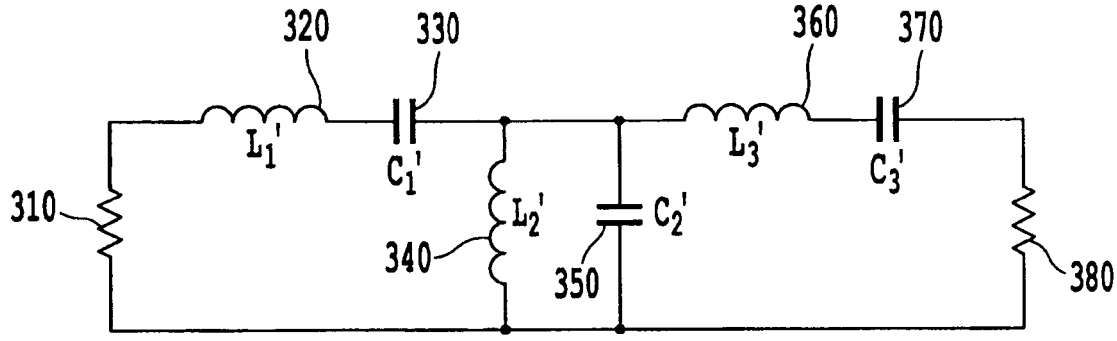
FIG. 3 is a circuit diagram of an embodiment of the filter circuit having shunt and series elements replaced so that the circuit may function as a bandpass structure.

FIG. 3 is a circuit diagram of an embodiment of the filter circuit having shunt and series elements replaced so that the circuit may function as a bandpass structure. The circuit of FIG. 3 includes inductors $L'_1$ 320, $L'_2$ 340, and $L'_3$ 360, Capacitors $C'_1$ 330, $C'_2$ 350, and $C'_3$ 380 and source and load impedances, 310 and 380 respectively.

$$L'_k = \frac{FBW \cdot L_k}{\omega_0} \tag{5}$$

$$C'_k = \frac{1}{\omega_0 \cdot FBW \cdot L_k} \tag{6}$$

Equations (5) and (6) represent equivalent circuits for series elements in the low pass filter embodiment.

$$L'_k = \frac{1}{\omega_0 \cdot FBW \cdot C_k} \tag{7}$$

$$C'_k = \frac{FBW \cdot C_k}{\omega_0} \tag{8}$$

Equations (7) and (8) represent shunt elements in a low pass filter embodiment. In equations (5)-(8), FBW represents the fractional bandwidth desired (e.g., 0.40 for a desired 40% bandwidth) and $\omega_0$ is the desired center frequency in radians/sec.

Using the bandpass filter transformation, a theoretical periodic structure may be designed that is capable of matching source and load impedances at moderate bandwidths. Since the lumped elements shown in the FIGS. 2 and 3 may not function well at microwave frequencies, certain transformations may be made for RF and microwave applications. Bode-Fano Limit The Bode-Fano Limit, as described in Pozar identifies a realistic limit to the bandwidth over which a good impedance match can be made with complex load impedances. This limit is related to the ratio of reactance to resistance and the bandwidth over which the match between source and load is desired.

According to the Bode-Fano Limit, for lumped elements, such as those in the periodic structures shown in FIGS. 2 and 3, there is a limitation for a parallel real and reactive load impedance combination given as:

$$\int_0^\infty \ln\frac{1}{|\Gamma(\omega)|}\,d\omega \le \frac{\pi}{RC} \tag{9}$$

Shown in equation 9, if the reflection coefficient is unity there is no contribution to the integral. The implication of this is that it is desired to have a maximum mismatch outside of the region representing the bandwidth of interest.

Figure 4:
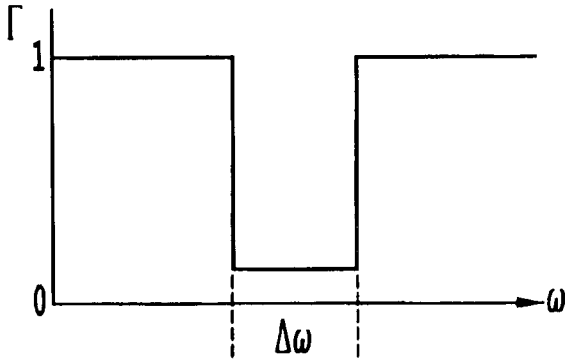
FIG. 4 is a waveform diagram of an idealized bandwidth of interest, $\Delta\omega$.

FIG. 4 is a waveform diagram of an idealized bandwidth of interest, $\Delta\omega$. With the condition shown in FIG. 4, a simplification to the integral in (9) can be expressed as:

$$\Delta\omega \ln\frac{1}{\Gamma} \le \frac{\pi}{RC} \tag{10}$$

$$\Gamma \ge e^{\frac{1}{2\Delta f RC}} \tag{11}$$

$$Since\ \omega = 2\pi f \tag{12}$$

Given a reflection coefficient or standing wave ratio, the maximum bandwidth that can be matched to a certain complex load impedance may be identified.

Implied by the Bode-Fano limit is that one should not waste any match out-of-band, and that the best in band match is obtained with Tchebyscheff coefficients, which allow the fewest number of resonating elements. Provided a certain amount of passband ripple is tolerable, a design using Tchebyscheff coefficients may give the best bandwidth for a fixed number of resonators. The desired bandwidth of this application is the largest continuous region within the passband that is below −10 dB return loss. Thus, the broadband impedance matching practice may incorporate the complex load impedance into a multi-section filter structure with a design that includes the characteristics of the load. Tchebyscheff designs provide the best starting point for an impedance matching structure, allowing the element values in the embodiment of FIG. 3 to be determined. A Tchebyscheff response may be evaluated as described in Matthaei, et al., *Microwave Filters, Impedance-Matching Networks, And Coupling Structures*, Dedham, Mass., Artech House Books, 1980, which is incorporated herein by reference in its entirety.

The element coefficients for a Tchebyscheff response in a circuit such as the circuit in the embodiment of FIG. 2 may be given by:

$$g_0 = 1 \tag{13}$$

$$g_1 = \frac{2}{\gamma}\sin\left(\frac{\pi}{2n}\right) \tag{14}$$

$$g_i = \frac{1}{g_{i-1}}\frac{4\sin\left[\frac{(2i-1)\pi}{2n}\right]\sin\left[\frac{(2i-3)\pi}{2n}\right]}{\gamma^2 + \sin^2\left[\frac{(i-1)\pi}{n}\right]} \text{ for } i = 2, 3, \ldots n \tag{15}$$

$$g_{n+1} = 1.0 \text{ for } n \text{ odd} \tag{16}$$

$$g_{n+1} = \coth^2\left(\frac{\beta}{4}\right) \text{ for } n \text{ even} \tag{17}$$

Where $$\beta = \ln\left[\coth\left(\frac{L_{Ar}}{17.37}\right)\right] \tag{18}$$

$$\gamma = \sinh\left(\frac{\beta}{2n}\right) \tag{19}$$

$L_{Ar}$ is the maximum tolerated insertion loss ripple allowed in the pass band in dB.

To determine the number of sections n needed to obtain a desired passband behavior one can use the relations:

$$\Omega = \left|\frac{1}{FBW}\left(\frac{f_1}{f_0} - \frac{f_0}{f_1}\right)\right| \tag{20}$$

$$M = \sqrt{\frac{10^{0.1\cdot DesA} - 1}{10^{0.1\cdot L_{Ar}} - 1}} \tag{21}$$

-continued $$N = \text{ceil}\left(\frac{\cosh^{-1} M}{\cosh^{-1}\Omega}\right) \tag{22}$$

The value DesA (dB) represents the desired pass-band attenuation.

Since the order of the network and values of coefficients are hereby determined to create a periodic structure that is capable of matching a certain source and load impedance at a desired bandwidth, a corresponding bandpass ladder circuit can be synthesized using Equations (5)-(8). However, such a synthesized structure may not be easily physically realizable using typical microwave transmission line structures because there are series inductances between each resonating element in the structure. To remove the dependence on series inductances a slightly different approach to the periodic structure design may be used. This different approach is called the Top-C coupled resonator method.

Top-C Coupled Resonators

Series inductances in the coupling between each resonator can be removed by transforming a typical band-pass filter to a "Top-C" network design, as described in Matthaei, and also as described in Hong, "Microstrip Filters for RF/Microwave Applications," New York: John Wiley & Sons, Inc., 2001, which is incorporated herein by reference in its entirety.

Figure 5:
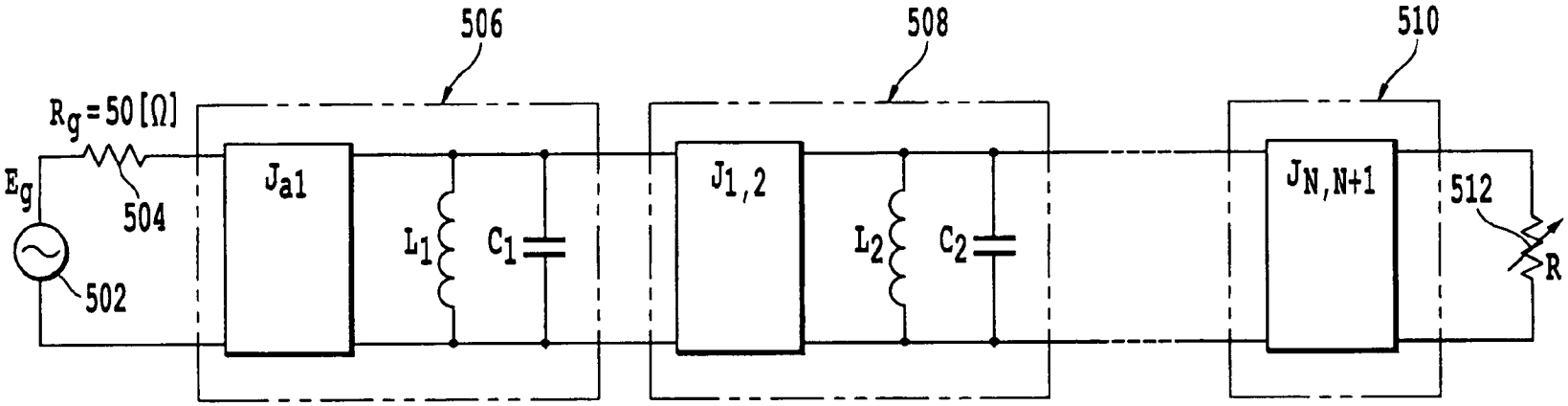
FIG. 5 is a circuit diagram of an embodiment of a ladder filter transformed using immittance inverters $J_{0,1}$, $J_{1,2}$, . . . $J_{N,N+1}$.

FIG. 5 is a circuit diagram of an embodiment of a ladder filter transformed using immittance inverters $J_{0,1}$, $J_{1,2}$, . . . $J_{N,N+}1$. Since it is desired to have capacitive coupling between each resonating element, J inverters are used. The embodiment of FIG. 5 includes a voltage source $E_g$ 502, source impedance $R_g$ 504, immittance, inductance capacitance stages 506 and 508, a final stage 510 and variable load impedance R 512.

Figure 6:
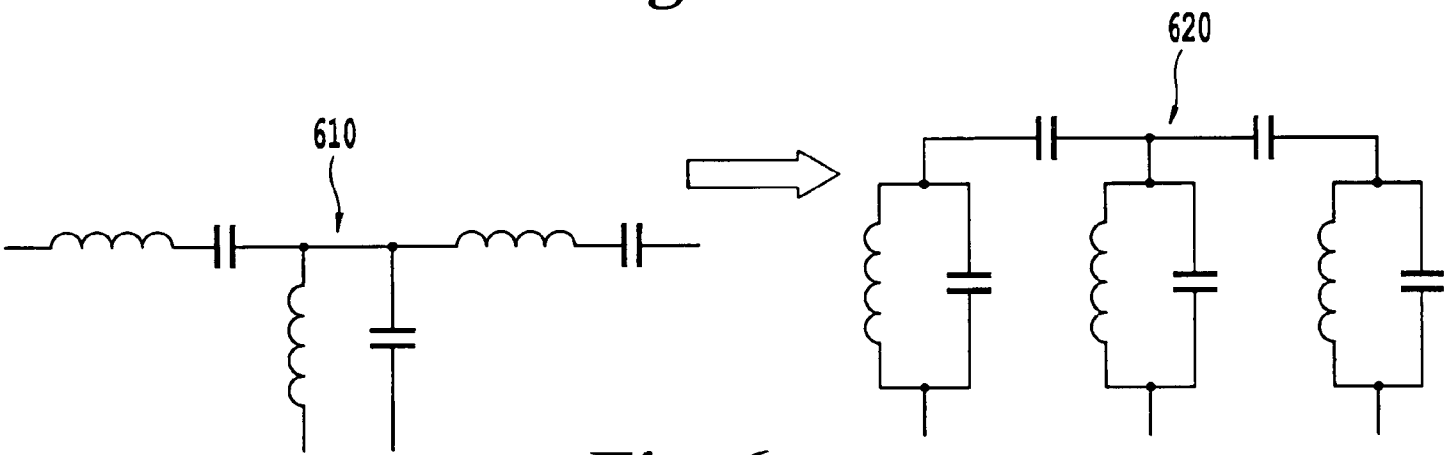
FIG. 6 is a schematic representation of a Top-C coupled bandpass structure compared to that of a simple ladder style bandpass filter.

FIG. 6 is a schematic representation of a Top-C coupled bandpass structure 620 compared to that of a simple ladder style bandpass filter 610.

To design a periodic structure using the Top-C coupled resonator method like the one shown in FIG. 2.4, the following design equations may be used, for example as described in Hong:

$$J_{0,1} = \sqrt{\frac{Y_0 \cdot FBW \cdot C_1 \cdot \omega_0}{g_0 \cdot g_1}} \tag{23}$$

$$J_{n,n+1} = \sqrt{\frac{Y_n \cdot FBW \cdot C_n \cdot \omega_0}{g_n \cdot g_{n+1}}} \tag{24}$$

$$J_{i,i+1} = FBW \cdot \omega_0 \sqrt{\frac{C_i \cdot C_{i+1}}{g_i \cdot g_{i+1}}} \tag{25}$$

$$L_i = \frac{1}{\omega_0^2 C_i} \tag{26}$$

$$\omega_0 = \sqrt{\omega_1 \omega_2} \tag{27}$$

$$FBW = \frac{\omega_2 - \omega_1}{\omega_0} \tag{28}$$

The values of $C_i$ used in Equations (23)-(26) can be appropriately be chosen by one of skill in the art. FBW represents the desired bandwidth of the structure.

Figure 7:
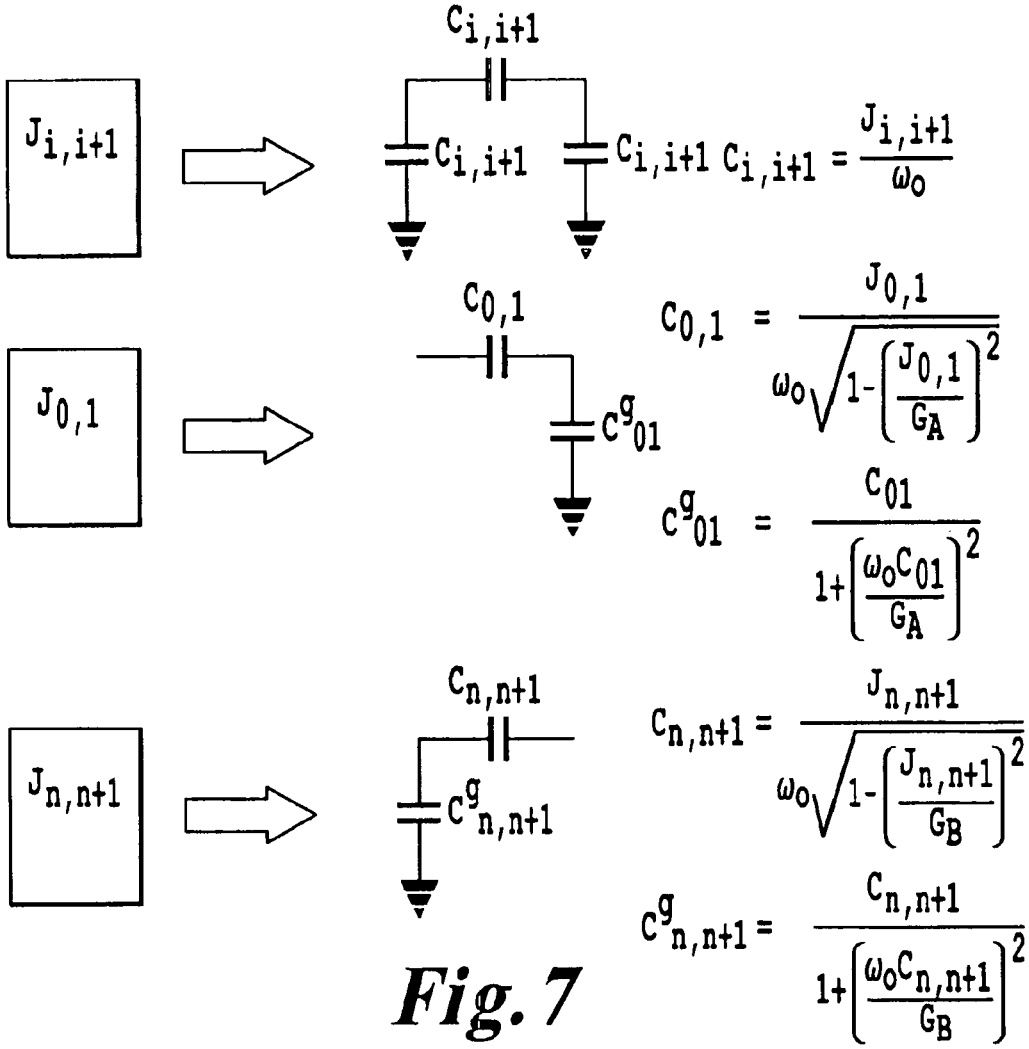
FIG. 7 is a schematic diagram showing physically realizable circuit relationships and corresponding equivalent equations.

The J-Inverters shown in FIG. 5 can be realized physically by using the relations shown in FIG. 7.

Using Richard's transformation Richard, the resonators and interconnecting lines are transformed into impedances that can be realized in a transmission line type. In a practical implementation the immittance inverters are frequency dependent and can be approximated by an ideal immittance in a small frequency range where the values of $J_i$ are constant. This frequency dependence may result in narrow bandwidth for periodic structures that use the Top-C technique.

Figure 8:
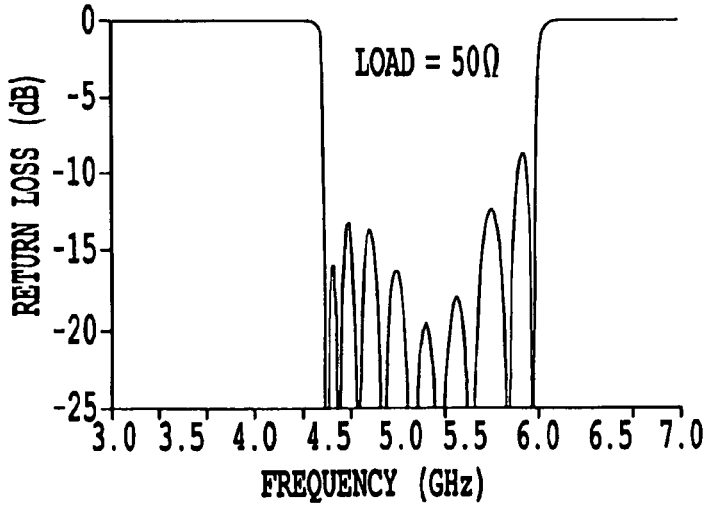
FIG. 8 is frequency response plot of a simulation of a Top-C network.

FIG. 8 is an Agilent Design System (ADS) simulation frequency response plot of a Top-C network designed using Tchebyscheff relations for −10 dB passband attenuation and 0.01 dB passband ripple, which requires 10 elements to achieve 40% bandwidth at 5 GHz. At the center frequency of 5 GHz, the passband of a 40% network would span from 4 GHz to 6 GHz; however, as shown in FIG. 8, such a circuit may not achieve the previously stated design goals. It is believed the frequency dependent nature of the J-Inverters prevents the circuit from functioning over such a large bandwidth, and therefore, another method for creating capacitive coupled periodic resonators may be preferred.

Matthaei Method

Figure 9:
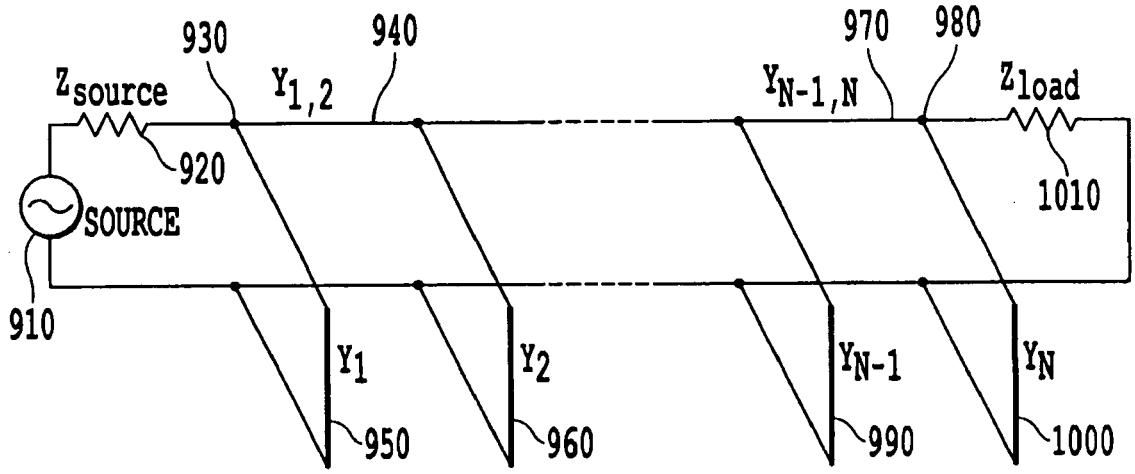
FIG. 9 is a schematic diagram of a series of shunt resonant stubs with varying couplings between them to form a matching periodic structure.

FIG. 9 is a schematic diagram of a series of shunt resonant stubs $Y_1, Y_2, \ldots Y_{N-1}, Y_N$ with varying couplings $Y_{1,2}, \ldots, Y_{N-1,N}$ between them to form a matching periodic structure 900 having an impedance matching network between nodes 930 and 980. Also included is equivalent voltage source 910 having source impedance $Z_{source}$ 920. $Z_{load}$ 1010 is an equivalent load impedance. Using a multiplying factor, based on the number of resonators and the source and load impedance to be matched as described by Matthaei, may vary the network impedance as gradually as possible from the source to load sides of the matching network. In addition to the multiplying factor, a scaling parameter that controls the admittance levels inside the structure, allowing for admittance scaling to values that can be realized easily in a transmission line model, is discussed. Values selected according to this method may be used to more easily model transmission lines with less frequency dependence than as the Top-C method, allowing for large bandwidth applications. The design equations according to this method follow:

$$s = \sqrt[n-2]{\frac{Z_{load}}{Z_{source}}} \tag{30}$$

The variable s is a multiplying factor that serves to gradually vary the impedance of the network between the source and load sides. This factor may be necessary only when a non-mirrored matching network is needed and a clear distinction between the source and load nominal impedance is defined. If a mirrored structure is desired one may not be able to vary the impedance gradually over the matching structure and s should be unity.

$$C_1 = g_1 \tag{31}$$

$$C_k = 2dg_1 s^{k-2} \text{ for } k = 3 \text{ to } n\text{-}1 \text{ if } n > 3 \tag{32}$$

$$C_n = g_0 g_n g_{n+1} \frac{Z_{load}}{Z_{source}} \text{ if } n \geq 3 \tag{33}$$

$$C_1' = g_1(1-d) \tag{34}$$

$$C_1'' = dg_1 \tag{35}$$

The parameter d represents the admittance scaling factor and is preferably greater than 0. This factor can control the size of a resulting network by scaling all impedance values. Usually the value of d is chosen arbitrarily, but in practice the best results may be obtained when d is equal to approximately 0.5. The g values in Equations (31)-(35) are given by the Tchebyscheff coefficients in Equations (13)-(22).

$$C_k' = C_{k-1}'' \text{ for } k = 2 \text{ to } n\text{-}1 \tag{36}$$

$$C_k'' = C_k - C_k' \tag{37}$$

$$Y_0 = \frac{1}{Z_0} \tag{38}$$

$$\frac{J_{k,k+1}}{Y_0} = \frac{1}{g_0}\sqrt{\frac{C_k C_{k+1}}{g_k g_{k+1}}} \text{ for } k = 1 \text{ to } n\text{-}2 \tag{39}$$

$$N_{k,k+1} = \sqrt{\left(\frac{J_{k,k+1}}{Y_0}\right)^2 + \left(\frac{C_k''\tan\theta_1}{g_0}\right)^2} \text{ for } k = 1 \text{ to } n\text{-}2 \tag{40}$$

$$\theta_1 = \frac{\pi}{2}\left(1 - \frac{\omega}{2}\right) \text{ and} \tag{41}$$

$$\omega = \frac{(f_2 - f_1)}{f_0} \text{ is the fractional bandwidth}$$

Once the capacitances of each stub and interconnecting lines are known, one can convert these values to impedance values representing the transmission line shunt stubs and the corresponding interconnects for the circuit shown in FIG. 9. Since the stubs in this circuit are shunted, their electrical length is a quarter of a wavelength.

To find the admittances of the quarter wavelength long shunt stubs:

$$Y_1 = \frac{Y_0}{g_0}\omega_1' C_2' \tan\theta_1 + Y_0\left(N_{12} - \frac{J_{12}}{Y_0}\right) \tag{42}$$

$$Y_k = Y_0\left(N_{k-1,k} + N_{k,k+1} - \frac{J_{k-1,k}}{Y_0} - \frac{J_{k,k+1}}{Y_0}\right) \text{ for } k = 2 \text{ to } n\text{-}2, \tag{43}$$

$$\text{if } n > 2$$

$$Y_n = \frac{Y_0}{g_0}\omega_1' C_n'' \tan\theta_1 + Y_0\left(N_{n-1,n} - \frac{J_{n-1,n}}{Y_0}\right) \text{ if } n \geq 2 \tag{44}$$

Each interconnecting line is also a quarter of a wavelength long and the admittances are given by:

$$Y_{k,k+1} = G_A\left(\frac{J_{k,k+1}}{G_A}\right) \text{ for } k = 2 \text{ to } n\text{-}1 \tag{45}$$

Since definition of the source or load is often interchangeable, it is desirable to design periodic structures such that they are mirrored about the center resonator. Using the method proposed by Matthaei, a mirrored structure would be obtained by setting the source and load impedance starting points to be equal and as thus not allowing a gradual variation in impedance from source to load, which forces an s value of unity.

If a mirrored structure is desired, from the synthesis relationships given by Matthaei, and there are unequal source and load impedance starting points, then one can take the average the calculated impedances for each stub and interconnecting line from the source and load sides and work inwards. One may take the stub closest to the source and average its impedance value with the stub closest to the load. The resulting average would become the new impedance value of stubs closest to the load and the source. Averaging in this manner would continue with the stubs and interconnecting lines moving towards the middle of the structure. However, this approach may disadvantageously introduce a high frequency mode outside the desired passband that violates the desired matching capabilities of the resonant network described above.

Adaptation to Allow for Reconfigurable Resonators

The shape of a microstrip structure may be calculated based on the admittances using microstrip physical circuit design equations, as discussed in detail below.

To facilitate a reconfigurable element loaded periodically in the structure, variable capacitors in the form of varactor diodes may be positioned at the end of each stub. The presence of variable capacitances changes the electrical properties of the structure. In order to get the best performance from the periodic structure, the electrical properties of the variable capacitances may be considered in the initial design synthesis equations. Previous consideration of the matching network ignored the effect of adding tuning elements.

Initially the tuning elements were connected directly to the structure resulting from the synthesis equations given previously. However, through extensive simulation, the present inventors have discovered that simply "adding" the tuning elements at the end of each stub produced undesirable results, and a correction was needed to the synthesis equations to allow for the loading of each tuning element.

Figure 10:
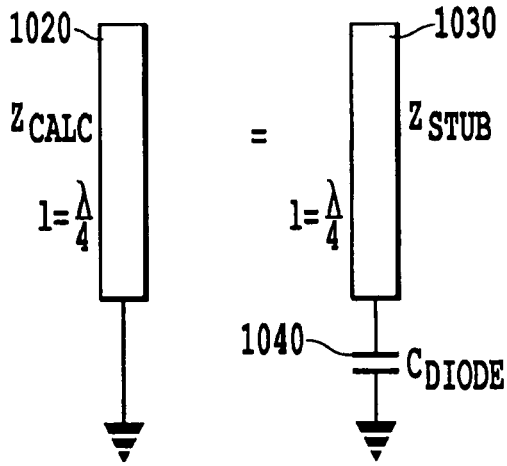
FIG. 10 is a schematic representation of a first alternative method that includes calculating the impedance of the tuning element and subtracting it from the impedance of each resonating stub.

FIG. 10 is a schematic representation of a first alternative method that includes calculating the impedance of the tuning element and subtracting it from the impedance of each resonating stub, resulting in a new value of impedance for each resonating stub. In this first alternative method, capacitors $C_{Diode}$ 1040 are placed at the end of each stub having an impedance $Z_{Stub}$ 1030 to produce an equivalent impedance $Z_{Calc}$ 1020 having improved overall results. Based on this, the present inventors reasoned that such a series configuration indicates that the impedance of a capacitor at its central resonant point added to the new impedance of the stub, would equal the total impedance calculated using the earlier design equations.

In evaluating designs synthesized using the Matthaei approach, the present inventors also determined that, in order to obtain good matching ability, not only should the resonant properties of the stubs be changed, but also the coupling between these resonators should be changed. Accordingly, interconnecting line impedances may be calculated by subtracting impedances from the tuning elements.

Figure 11:
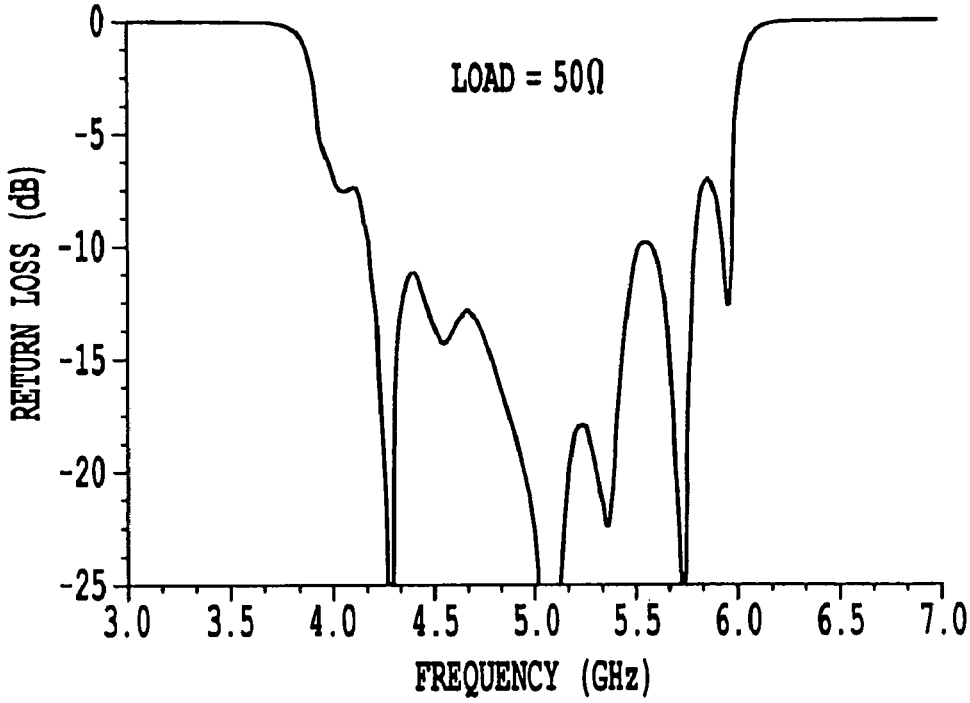
FIG. 11 is a frequency response plot showing a tunable range before a capacitor is added to the stubs.
Figure 12:
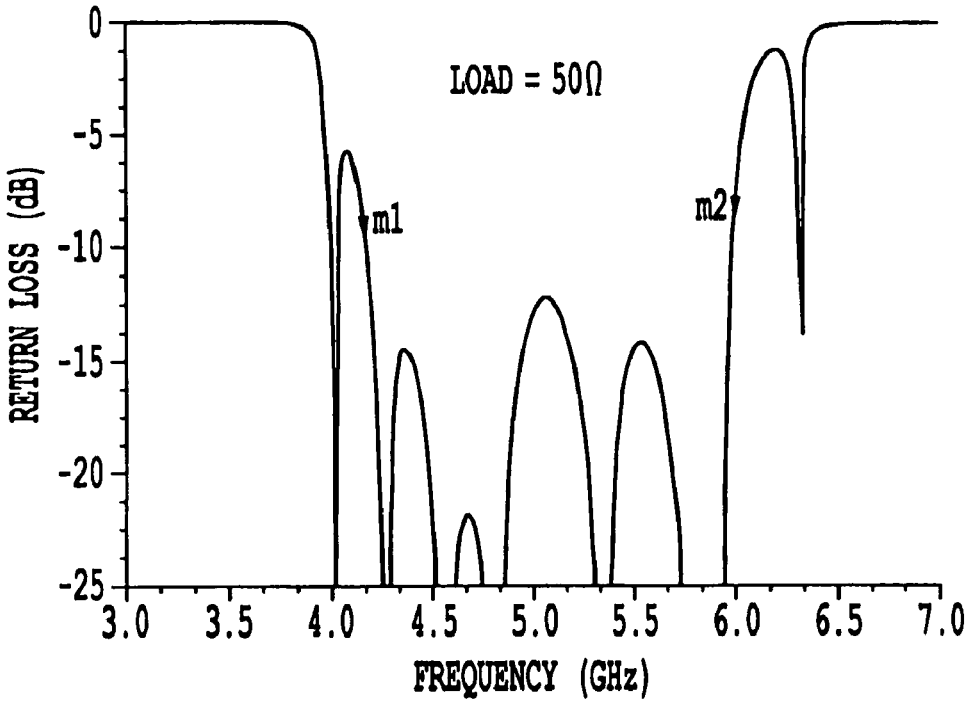
FIG. 12 is a frequency response plot showing a tunable frequency range after a capacitor is added to the stubs.

FIG. 11 is a frequency response plot showing a tunable range before capacitor $C_{Diode}$ 140 is added, and FIG. 12 is a frequency response plot showing a tunable frequency range after capacitor $C_{Diode}$ 140 is added to the stubs, as described above, respectively shown with and without adjusting the synthesized stub or interconnect impedances.

Thus, even with an adaptation of the method discussed by Matthaei, any gradual impedance change over the network is not a good approach when a mirrored structure is desired. A synthesis technique proposed by Hong generates matching networks that are mirrored about the center stub and may be suitable for high bandwidth applications. This method is a simplification of the equations (30)-(45) proposed by Matthaei. In the Hong method the impedance of the sections are not varied gradually from source to load. The equations proposed by Matthaei reduce to the Hong equations if the source and load impedance values used in the calculations are the equal.

With a circuit layout as in FIG. 9, values for components in the present embodiment are calculated according to the following equations:

$$\frac{J_{1,2}}{Y_0} = g_0\sqrt{\frac{h\cdot g_1}{g_2}} \tag{46}$$

$$\frac{J_{i,i+1}}{Y_0} = \frac{h\cdot g_0\cdot g_1}{\sqrt{g_i\cdot g_{i+1}}} \text{ for } i = 2 \text{ to } n\text{-}2 \tag{47}$$

-continued $$\frac{J_{n-1,n}}{Y_0} = g_0\sqrt{\frac{h\cdot g_1\cdot g_{n+1}}{g_0\cdot g_{n-1}}} \tag{48}$$

$$N_{i,i+1} = \sqrt{\left(\frac{J_{i,i+1}}{Y_0}\right)^2 + \left(\frac{h\cdot g_0\cdot g_1\tan\theta}{2}\right)^2} \text{ for } i = 1 \text{ to } n\text{-}1 \tag{49}$$

Shunt stub admittances for quarter wavelength resonators are:

$$Y_1 = g_0Y_0\left(1-\frac{h}{2}\right)g_1\tan\theta + Y_0\left(N_{1,2} - \frac{J_{1,2}}{Y_0}\right) \tag{50}$$

$$Y_i = Y_0\left(N_{i-1,i} + N_{i,i+1} - \frac{J_{i-1,i}}{Y_0} - \frac{J_{i,i+1}}{Y_0}\right) \text{ for } i = 2 \text{ to } n\text{-}1 \tag{51}$$

$$Y_n = Y_0\left(g_ng_{n+1} - g_0g_1\frac{h}{2}\right)\tan\theta + Y_0\left(N_{n-1,n} - \frac{J_{n-1,n}}{Y_0}\right) \tag{52}$$

Admittances of the interconnecting lines:

$$Y_{i,i+1} = Y_0\left(\frac{J_{i,i+1}}{Y_0}\right) \text{ for } i = 1 \text{ to } n\text{-}1 \tag{53}$$

$$\theta = \frac{\pi}{2}\left(1-\frac{FBW}{2}\right) \tag{54}$$

Where $h = 2$, (55)
represents an arbitrary admittance scaling property

As before, in order to make the design reconfigurable, the impedance of the tuning varactor may be taken into account. However, the present inventors realized that if the tuning varactor impedance is accounted for using the subtraction method an undesirable frequency shift upward in the pass band response may result. Thus, the present inventors identified the following improved approach. The impedance of a transmission line is the sum of the real and reactive parts of the line in equation (Z=R+jX). The magnitude of the impedance may be represented as:

$$|Z| = \sqrt{R^2 + (X_L - X_C)^2} \tag{56}$$

To insure similar performance in the nominal state after adding a tuning element, the magnitude of the impedance of the stub and tuning element combination may be set equal to the calculated stub impedance without the tuning element. This may require a decrease in the impedance of the stub. Since the impedance of a tuning element, like a capacitor, is frequency dependent, it may be advantageous to choose a frequency at the center of the passband and calculate the impedance of the tuning element. For example, if the tuning element is a varactor diode with a capacitance of 3.0 pF (the assumed center of the tuning range of the diode) at 5 GHz, the resulting reactance of the diode would be $$X_C = \frac{1}{j2\pi fC}$$

or, in this example, 10.6Ω. Using this value one can solve equation (56) to obtain a value for R. This is the value used to describe the impedance of the stub connecting to the tuning element. Introducing the varactor into the network in this method worked quite well and provided a fair starting point for optimization in ADS, which is discussed below.

As described earlier, the loading of a tuning element such as the varactor diode on the end of a resonating stub or interconnecting line appeared intuitively as a series circuit combination. In this case, if the real impedance parameter of the line is low, the changing capacitance has a large effect on the impedance. It is important to note however, that the impedance of the line represents a resonator, which may be equivalent to a parallel combination between an inductor and a capacitor. It is not preferred to simply short circuit the resonator and use a tuning element to solely control the impedance of the resonating elements. Based on simulation and testing, the present inventors have determined that the best approach is to select the line characteristics such that the real impedance and the reactive impedance are within about 10Ω of each other in the nominal state, as shown in equation (57).

$$|R_c - X_c| < 10\Omega \tag{57}$$

The effective tuning range may be determined based the overall impedance values of each stub or interconnect. Admittance scaling the design (i.e., changing the value of d in equation 55) can assist but may result in interconnecting lines with low impedance. Accordingly, the present inventors determined that to get the best tuning performance from a design it may be advantageous to have the impedance of the stubs and interconnecting lines have a same order as the impedance of the tuning diode over its entire tunable range. The series combination of the varactor and resonator does not yield a stand alone resonator. Instead, the resulting response is a low-pass filter and a resonator. For impedance matching network applications, such a combination may work well and the variable capacitance range serves to control impedance over the resonating element, changing its resonant point.

Network Synthesis Example

Various alternative approaches may be used when selecting the elements for reconfiguring the network. For example, capacitor banks connected with MEMS switches may be used for reconfiguration of the network, as described above. Further, varactor diodes used in conjunction with a novel impedance matching topology will be described below. The present inventors have determined that a suitable varactor diode should preferably operate over the entire frequency range desired for tuning, have high Q, have a large variable capacitance range, and have a package size making it easily implemented in a high frequency circuit.

An example of a suitable varacter diode is the MPV1965 manufactured by Microsemi. The MPV1965 has a useable capacitance range that spans 0.2 pF to 5 pF. However, the impedance of the stub or interconnecting line connected to the varactor diode may be most easily varied near the middle of the varactor diode's capacitance range.

In the following example, 3.0 pF is chosen as the center point for the varactor diode. However, as described herein, varacter diodes having other center point capacitance values are also included in the invention. Using equation (58) a value for the impedance of the varactor diode can be calculated.

Given the impedance matching network synthesis equations (46)-(56) and using the Tchebyscheff properties given in (13)-(22) component values for a broadband impedance matching network may be selected. Table 2.2 shows an example of design criteria for an impedance matching network according to an embodiment of the invention

TABLE 2.2

Example Design Criteria

| $Z_0$ (Ω) | RL (dB) | Passband Ripple (dB) | Bandwidth | $f_0$ GHz | Stub Tuning Capacitance (pF) | Interconnect Tuning Capacitance (pF) | Admittance Scale |
|---|---|---|---|---|---|---|---|
| 50 | 15 | 0.01 | 40% | 5 | 3 | 3 | 2 |

Using the inputs of Table 2.2 in the synthesis equations (20)-(22) indicates that a 10 resonator design can satisfy the design criteria. With 10 resonators, solving equations (46)-(56) yields:

TABLE 2.3

Calculated Stub Impedances

| n | 1 | 2 | 3 | 4 | 5 | 6 | 7 | 8 | 9 | 10 |
|---|---|---|---|---|---|---|---|---|---|---|
| $Z_i$ (Ω) | 22.1 | 11.1 | 11.0 | 10.8 | 10.8 | 10.8 | 10.8 | 11.0 | 11.1 | 22.1 |
| $Z_i + Z_{var}$ (Ω) | 23.8 | 14.2 | 14.1 | 14.0 | 14.0 | 14.0 | 14.0 | 14.1 | 14.2 | 23.8 |

Table 2.3 represents the calculated impedances for each shunt stub that is quarter wavelength long while Table 2.4 represents the impedance of each interconnecting line. Listed in the tables are the initial calculated impedances, and the corrected values based on loading a varactor diode. These impedances represent basic transmission lines and can be physically realized in a wide variety of microwave circuit methods. The values in each table relating to the stub and varactor combination are the values used in calculation of the physical structure size using the methods presented below.

TABLE 2.4

| Calculated Interconnect Impedances | | | | | | | | | |
|---|---|---|---|---|---|---|---|---|---|
| N, n + 1 | 1, 2 | 2, 3 | 3, 4 | 4, 5 | 5, 6 | 6, 7 | 7, 8 | 8, 9 | 9, 10 |
| $Z_{i,i+1}$ (Ω) | 41.7 | 40.8 | 43.7 | 44.6 | 44.9 | 44.6 | 43.7 | 40.8 | 41.7 |
| $Z_{i,i+1} + Z_{var}$ (Ω) | 42.6 | 41.8 | 44.6 | 45.5 | 45.8 | 45.5 | 44.6 | 41.8 | 42.6 |

Once a design is synthesized in the manner presented here it can be optimized in an ADS simulator as described below.

Other Considerations

In addition to taking the parasitic values into consideration, to obtain the best insertion loss profile possible, Tchebyscheff coefficients with low pass-band ripple may be used. Using 0.01 dB as the pass-band ripple parameter forces the insertion loss profile to nearly that of a nearly ideal response shown in FIG. 4, but still allows for using a lower number of resonators; the advantage of Tchebyscheff filters. The filter type and pass band ripple parameters represent only a starting point for the design; optimization using the cost function, described below, can help tailor a specific network.

Figure 13:
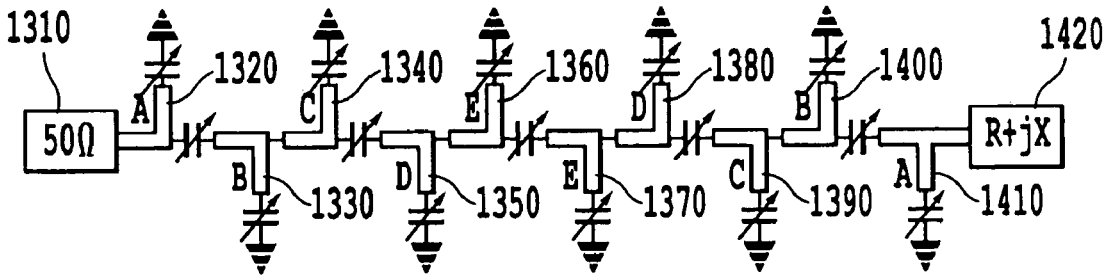
FIG. 13 is an example of an embodiment of an impedance matching structure according to the present invention and including ten stubs.

FIG. 13 is an example of an embodiment of an impedance matching structure according to the present invention and including ten stubs 1320-1410. Each stub includes a varactor diode having a center capacitance value of A-E pF. Although a mirrored structure (i.e., having a line of symmetry being around the center of the circuit) as shown in FIG. 13 is preferred with regard to bandwidth and fabrication, other structures, other center values, and other methods to determine the values also included in the present invention. Synthesis to Physical Structure The synthesis equations and methods for accounting for varactor loading on the stubs and interconnecting lines, as described above, may be used to obtain impedances representing an ideal transmission line circuit. A practical transmission line model may be converted to accommodate microstrip, stripline, or other microwave circuit type realizations. The reconfigurable tuner portion of the automatic match control circuit may be realized using microstrip. In order to get the most accurate performance behavior model from simulations, parasitic elements and circuit structural elements such as bends, tees, and gaps may be accounted for.

A simulation script, for example a script written in the MATLAB programming language, may be used to expedite the synthesis of the matching structure. Inputs to the script may include the characteristic impedance of the circuit, the desired bandwidth, nominal varactor capacitance, and the maximum acceptable insertion loss passband ripple. Based on the inputs given, the script may determine how many resonating elements are needed using Tchebyscheff equations (13-22) and provide the stub and interconnecting line impedances, as described above. The impedances calculated during synthesis of the matching structure represent an ideal transmission model may be transformed into a microstrip structure using an additional computer program. The relations for solving for the physical size of a microstrip transmission line, as described by Pozar, are:

$$B = \frac{60\pi^2}{Z_0\sqrt{\varepsilon_r}} \tag{58}$$

-continued $$W = \frac{2h}{\pi}\left[B - 1 - \ln(2B-1) + \frac{\varepsilon_r - 1}{2\varepsilon_r}\left\{\begin{matrix}\ln(B-1) + \\ 0.39 - \frac{0.61}{\varepsilon_r}\end{matrix}\right\}\right] \tag{59}$$

$$\lambda_0 = \frac{c}{f_0}\cdot 3.28083\cdot 12000 \text{ (conversion from meters to mils)} \tag{60}$$

$$\lambda_{TEM} = \frac{\lambda_0}{\sqrt{\varepsilon_r}} \tag{61}$$

$$K = \sqrt{\frac{\varepsilon_r}{\left[1 + 0.63(\varepsilon_r - 1)\left(\frac{W}{h}\right)^{.1225}\right]}} \tag{62}$$

$$l = \frac{\lambda_{TEM} K}{4} \tag{63}$$

$Z_0$ represents the characteristic impedance of each stub or interconnecting line respectively, where W is the width of the transmission line and l is the electrical length. Formulas (58)-(63) produce an output in mils ($1/1000^{th}$ of an inch), which is often a convenient measurement for use in a simulator. The obtained physical size of the structure is affected by the dielectric constant of the material on which it is fabricated, which is given by $\in_r$.

Figure 14:
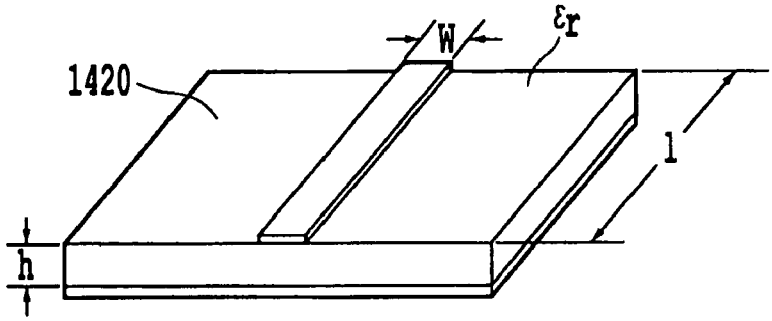
FIG. 14 is an isometric view of an example of a microstrip transmission line.
Figure 15A:
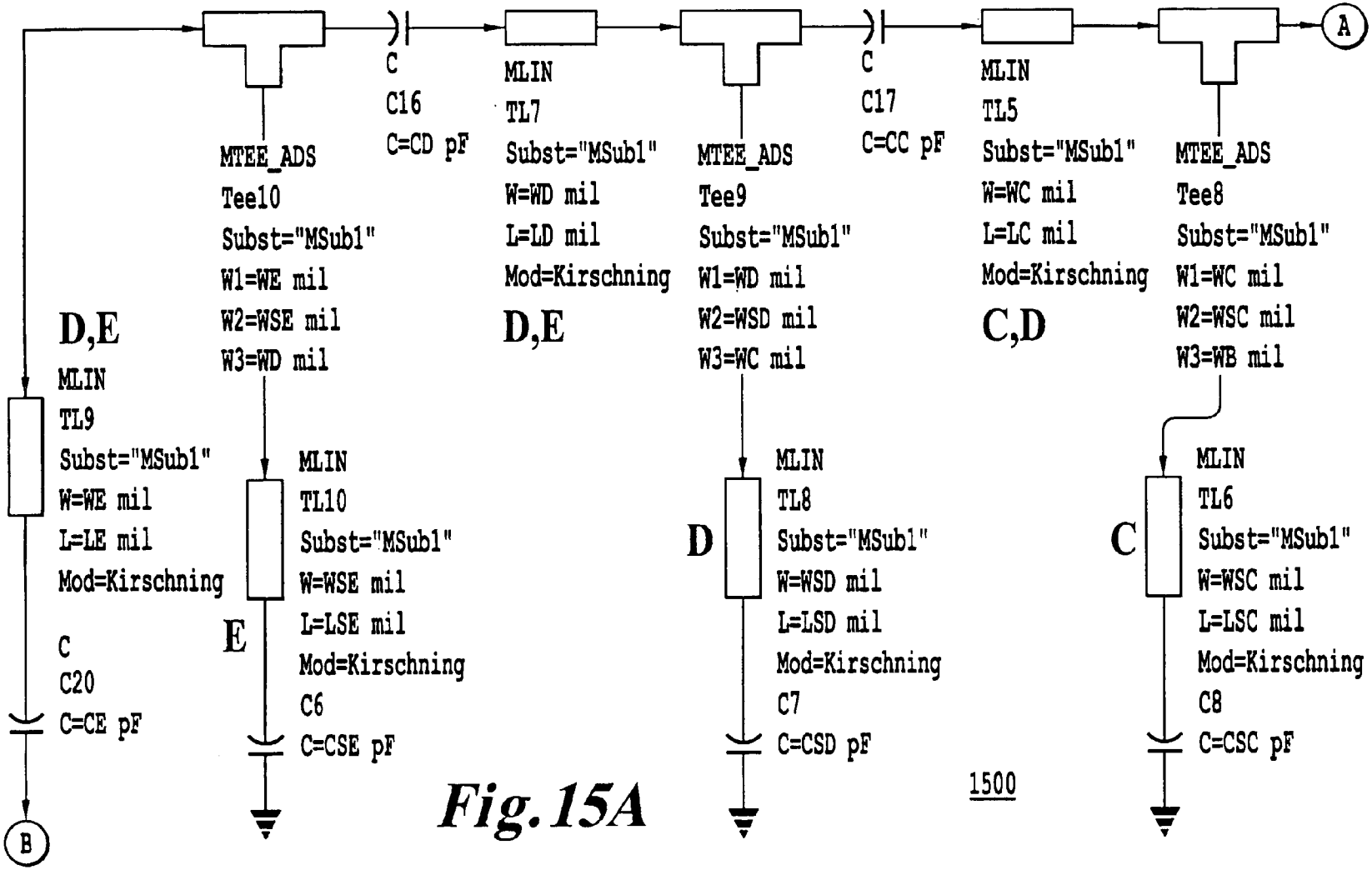
FIG. 15 is a circuit diagram of a first embodiment of an impedance matching network according to the present invention.
Figure 15B:
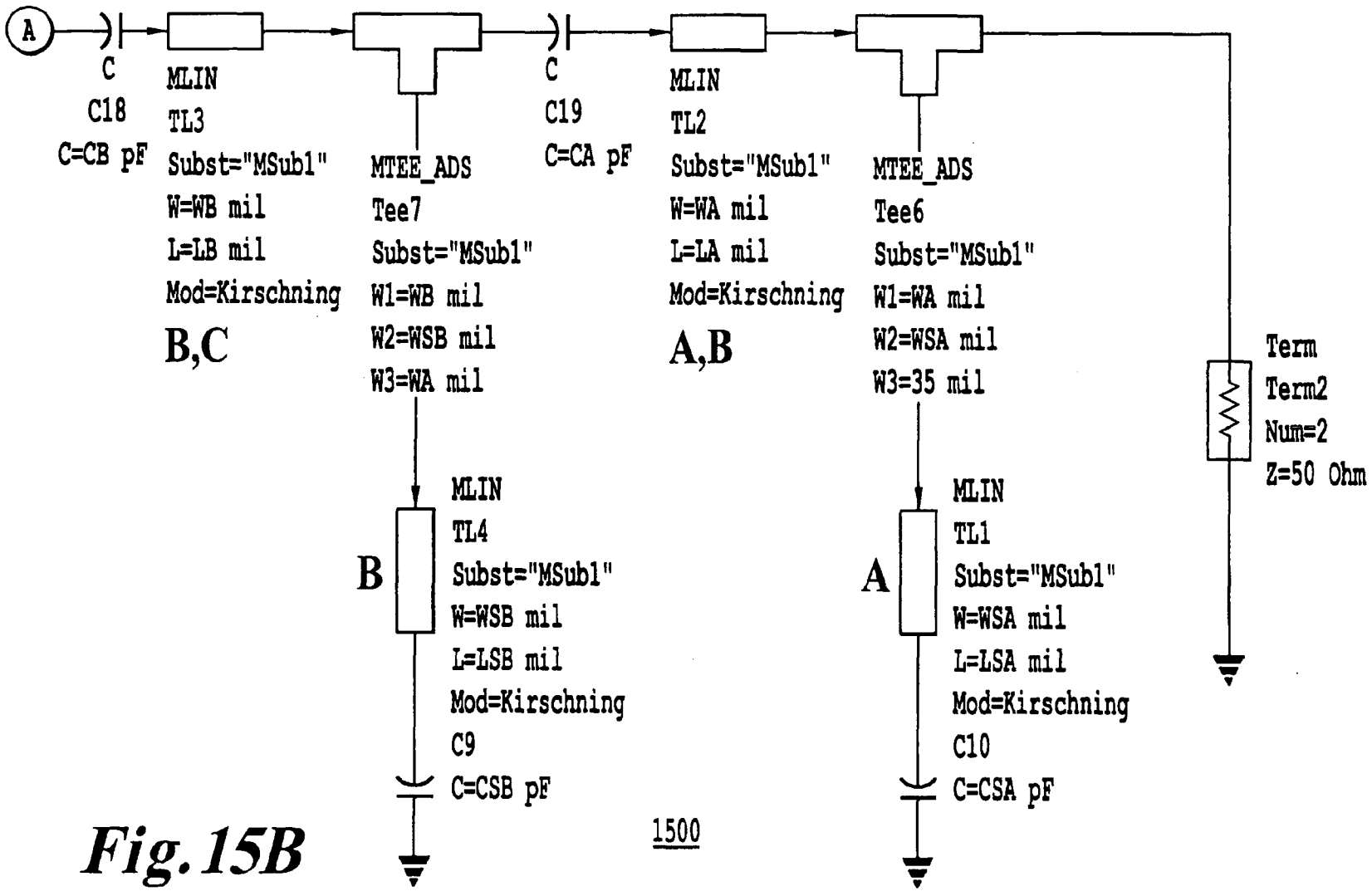
Figure 15C:
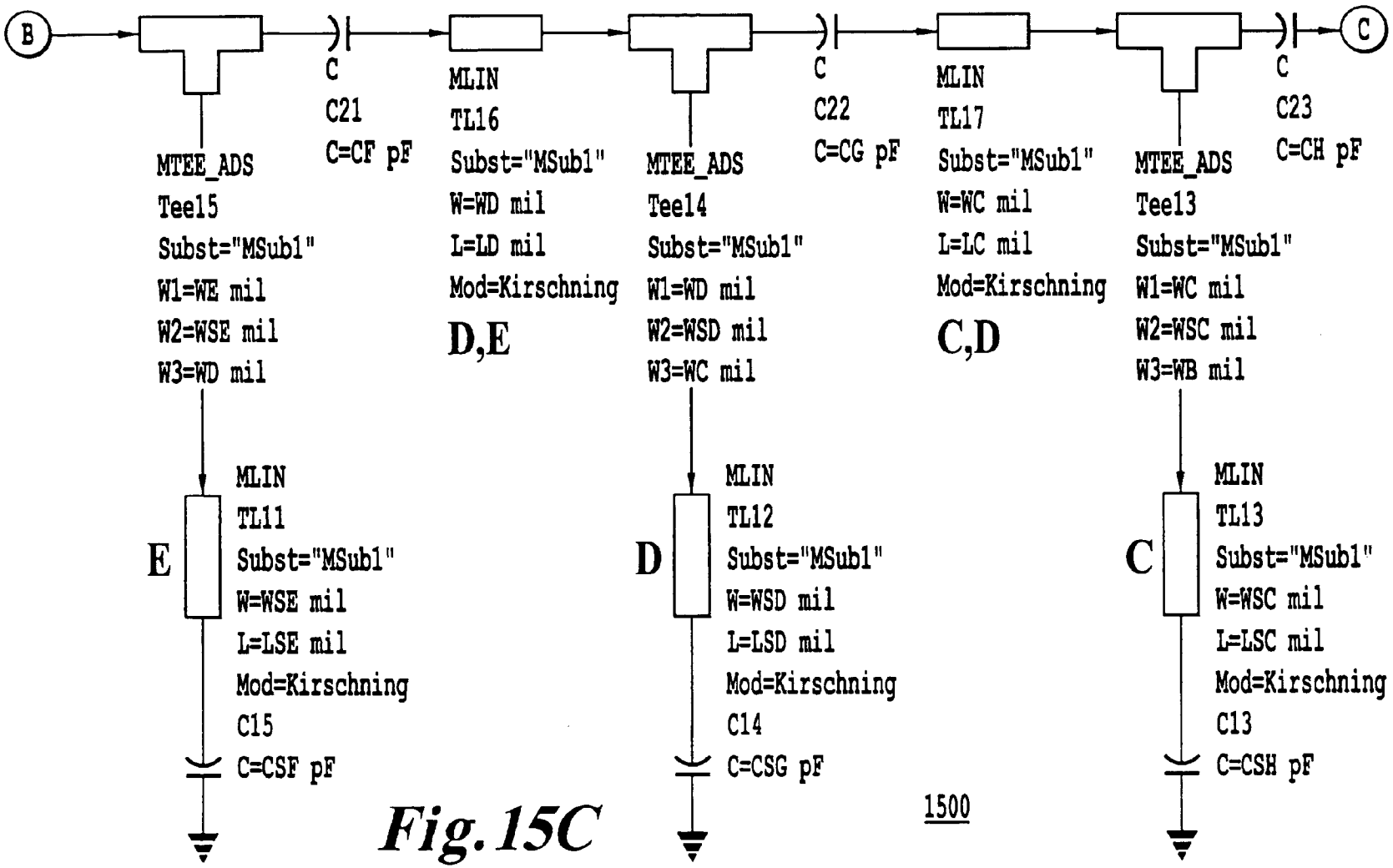
Figure 15D:
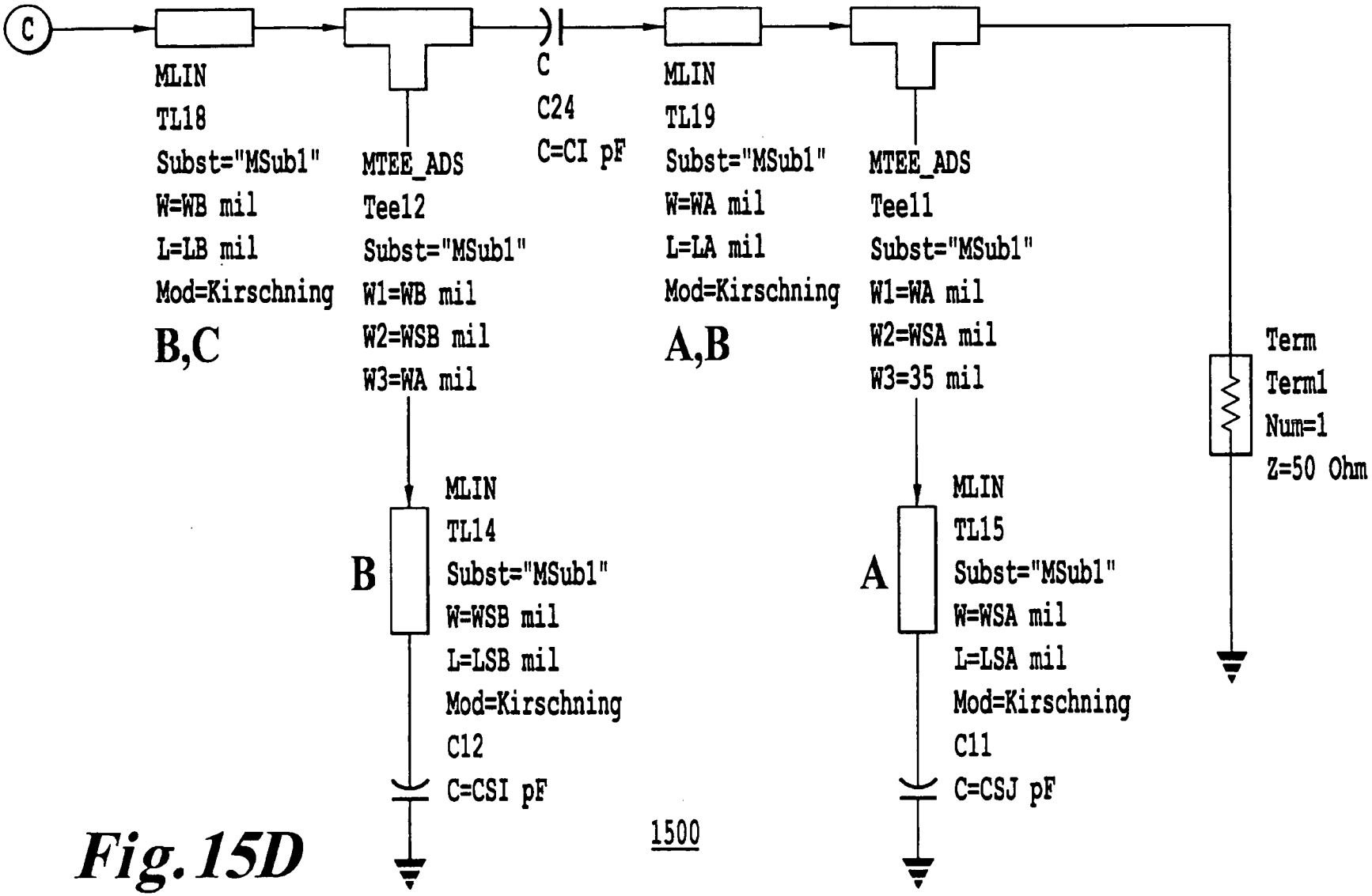

FIG. 14 is an isometric view of an example of a microstrip transmission line 1420.

The physical aspects of a microstrip circuit may depend on the material used for fabrication. In the following example, the microstrip is manufactured on Rogers Corporation DUROID 6006.

Table 3.1 shows properties of DUROID 6006 used in calculating the physical aspects of the first embodiment of a reconfigurable tuner according to the present invention.

TABLE 3.1

| DUROID 6006 Properties | |
|---|---|
| Dielectric Constant | 6.15 |
| Loss Tangent | 0.0027 |
| Thickness (h) | 25 mil |
| Cladding | 1 oz |
| Conductor Thickness | 1.4 mil |

FIG. 15 is a circuit diagram of a first embodiment of an impedance matching network 1500 according to the present invention. The impedance matching network 1500 includes 10 resonating elements A-E, having values selected using Tchebyscheff coefficients derived from 0.01 dB passband ripple and −15 dB return loss, using the selection methods described above. The impedances calculated using the equations described above were further transformed into a microstrip structure using equations (58)-(63), resulting in the values shown in FIG. 15. This structure may be optimized by adjusting lengths and widths of stubs and interconnecting lines, as described below. The nominal state varactor capacitances of the present embodiment are selected to be 3 pF and the source and load impedance values are selected to be 50Ω. Tables 3.2 and 3.3 show calculated stub and interconnecting line values, respectively, for the physical microstrip circuit in the present embodiment.

TABLE 3.2

| Calculated Microstrip Stub Sizes | | | | | |
|---|---|---|---|---|---|
| Stub | A | B | C | D | E |
| Width [mils] | 114 | 212 | 342 | 355 | 137 |
| Length [mils] | 265 | 252 | 251 | 250 | 250 |

TABLE 3.3

| Calculated Microstrip Interconnecting Line Sizes | | | | | |
|---|---|---|---|---|---|
| Interconnect | A, B | B, C | B, C | C, D | D, E |
| Width [mils] | 27 | 21 | 19 | 19 | 19 |
| Length [mils] | 283 | 287 | 289 | 289 | 289 |

Design Optimization Using a Cost Function

Often it is beneficial to optimize the synthesized design using an optimizer, such as the ADS optimizer.

For example, simulation and optimization of the impedance matching network 1500 may be performed using the S-Parameters object within the ADS optimizer. Simulations may be set up such that device characteristics are measured between 3-7 GHz with four hundred discrete measurement points. Although the optimization capabilities within ADS may be used to change the lengths and widths of stubs and interconnecting lines by sampling points within the pass band and trying to force the reflection properties of the system to a lower value, the inventors discovered that such an approach has minimal effectiveness and may produce designs with very poor return loss properties, a symptom associated with widely spaced resonators.

Instead, the inventors selected a statistical function to grade the performance of an impedance matching network and to optimize the impedance properties of the circuit to obtain the best performance. The statistical function was named the Cost Function. For example, designs with a cost function score of 100 or more were considered to have desirable performance properties and were used as the basis for a preferred design. The cost function scores the performance of the simulated impedance matching network against the performance of an ideal case, such as that shown in FIG. 4.

Defining the properties of a well performing system is not a trivial task and the inventors determined that the passband response should be carefully evaluated before determining that the circuit is functioning with desirable behavior. Further, the design performance can advantageously be evaluated by treating the discrete points within the simulated passband as a probability density function, and performing statistical analysis on this function. For example, the flatness, symmetry, and mean value of a probability density function can be evaluated.

A relatively flat passband may be desirable because all of the energy in the passband is attenuated at a similar magnitude. A flat passband response allows for a properly scaled representation of the input signal to appear at the output of the system. Evaluating the flatness of a density function may be accomplished using the fourth statistical moment called the Kurtosis. In a function that has a mostly flat, non-peaky nature, the calculated fourth moment may be close to or equal to zero. For purposes of this design it is desirable to have a fairly flat pass band. If the distribution function has some outlying values or long tails it is said to be Leptokurtic, having a fourth moment value above 0, an undesirable property. If the distribution has small tails it is called Platykurtic, and while not desirable either, it is not as detrimental to the system performance. In the following, it is assumed that any fourth moment value away from 0 is undesirable and as thus the absolute value of the Kurtosis term becomes a subtracting term to the cost function.

Figure 16A:
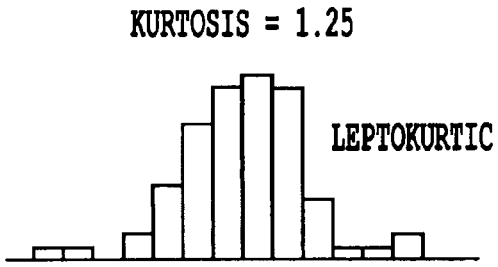
FIG. 16A is a probability distribution plot of fourth moment properties for an example Leptokurtic distribution function.

FIG. 16A is a probability distribution plot of fourth moment properties for an example Leptokurtic distribution function. In each of FIGS. 16A, 16B, and 17A-C, the x-axis represents a real-valued random variable x and the y-axis represents a relative number of occurrences of that value of x.

Figure 16B:
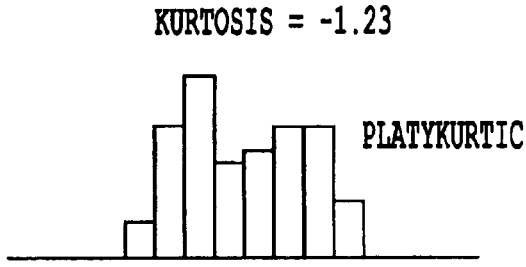
FIG. 16B is a plot of fourth moment properties of an example Platykurtic distribution function.

FIG. 16B is a plot of fourth moment properties of an example Platykurtic distribution function.

Symmetry is another important property for describing a passband response. If the passband is not symmetric, modulated signals about the center frequency may suffer spectral damage. The symmetry of a passband distribution can be described by using the third statistical moment called the Skewness.

Figure 17A:
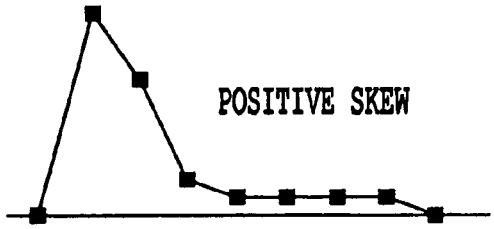
FIGS. 17A-17C are probability distribution plot examples of third statistical moments having positive skew, negative skew, and symmetric distribution (no skew), respectively.
Figure 17B:
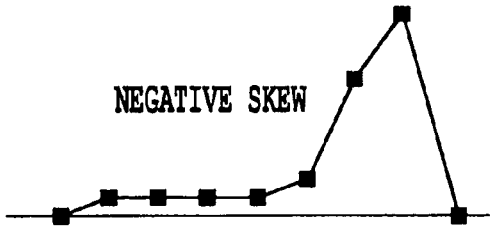
Figure 17C:
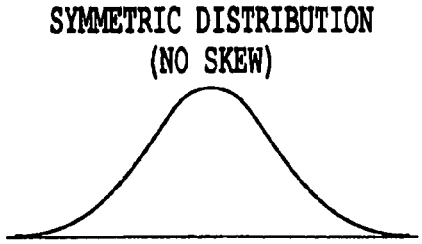
Figure 19A:
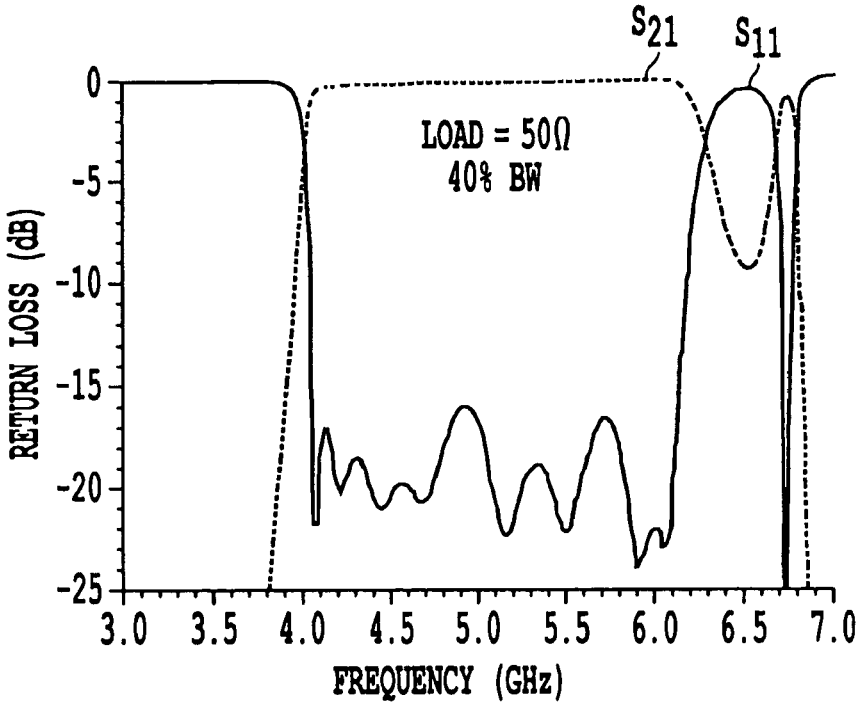
FIGS. 19A-D are simulated frequency response plots for the 10 stub tuner in response to various loads at or near 50Ω.
Figure 19B:
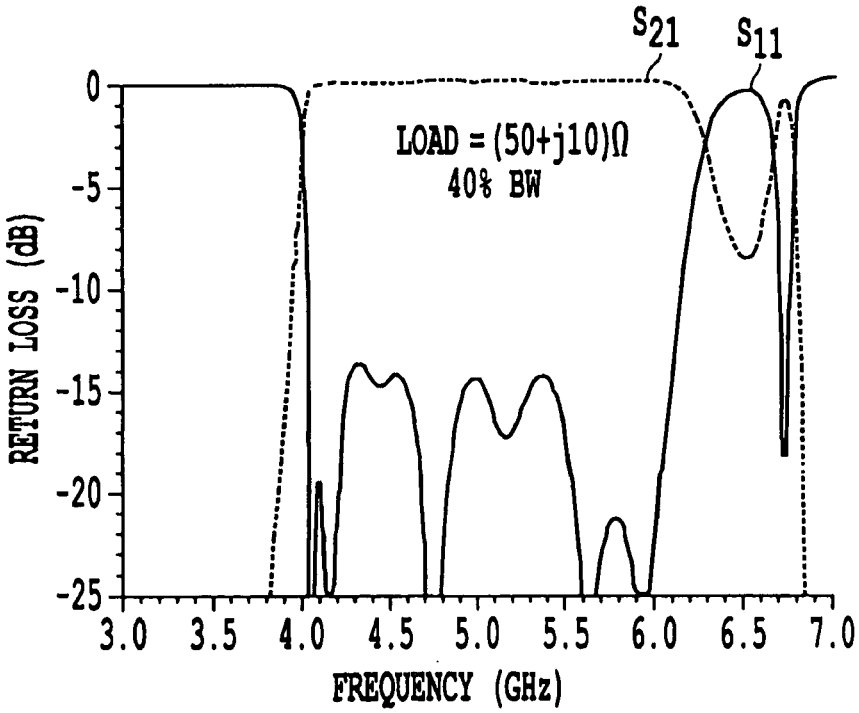
Figure 19C:
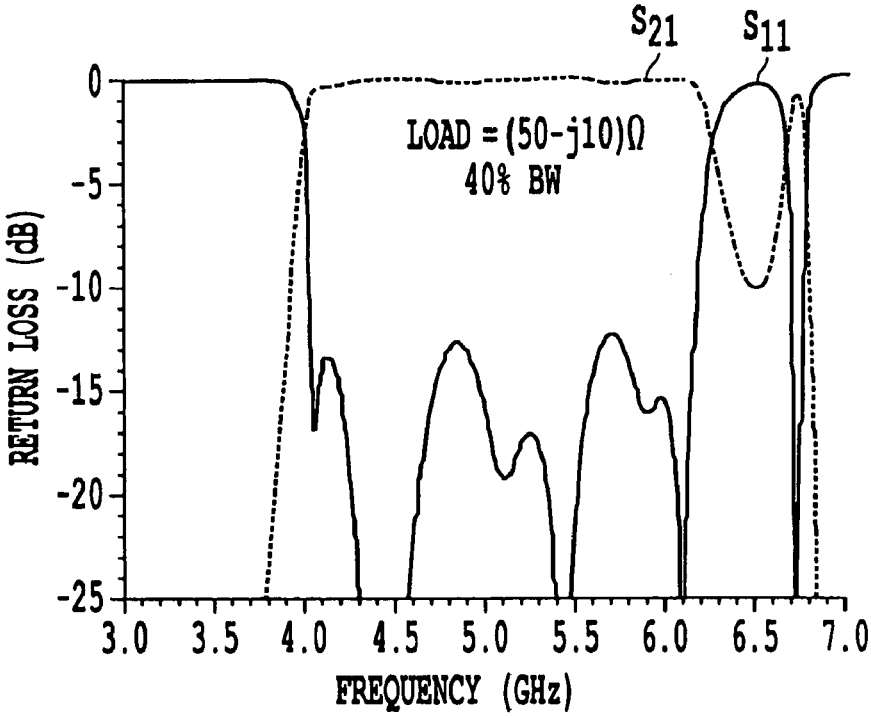
Figure 19D:
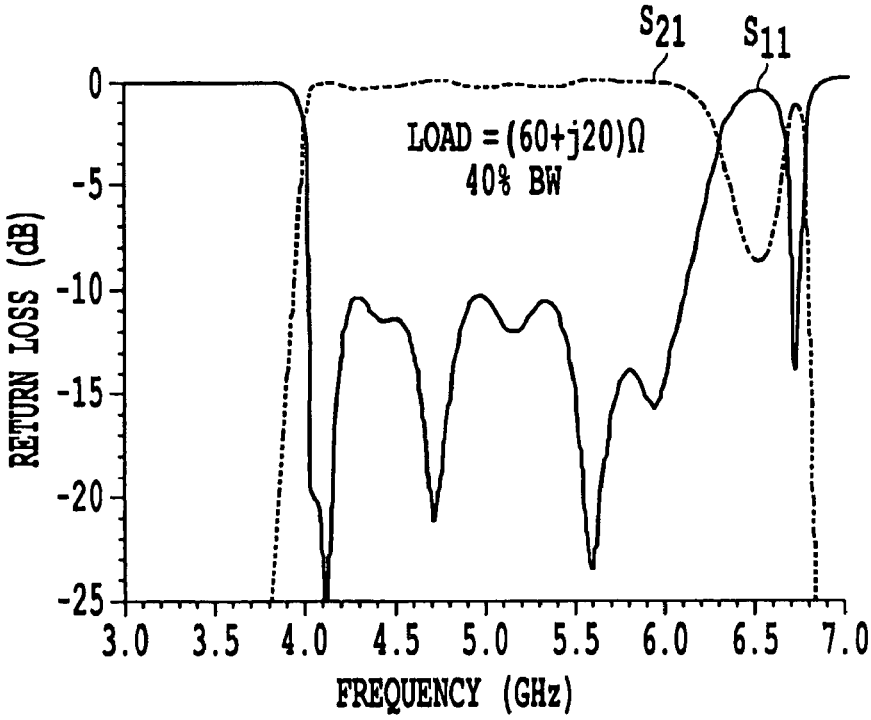
Figure 20A:
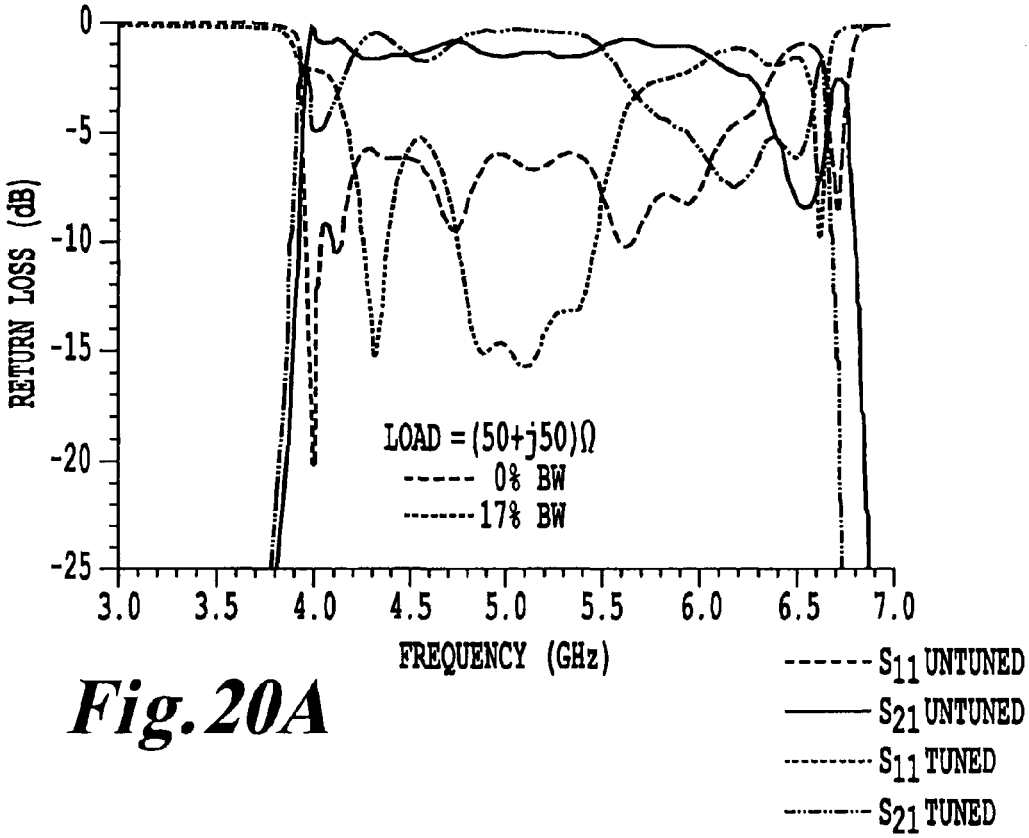
FIGS. 20A-E are frequency response plots that show that large changes in the load impedance may cause the bandwidth of the system to suffer.
Figure 20B:
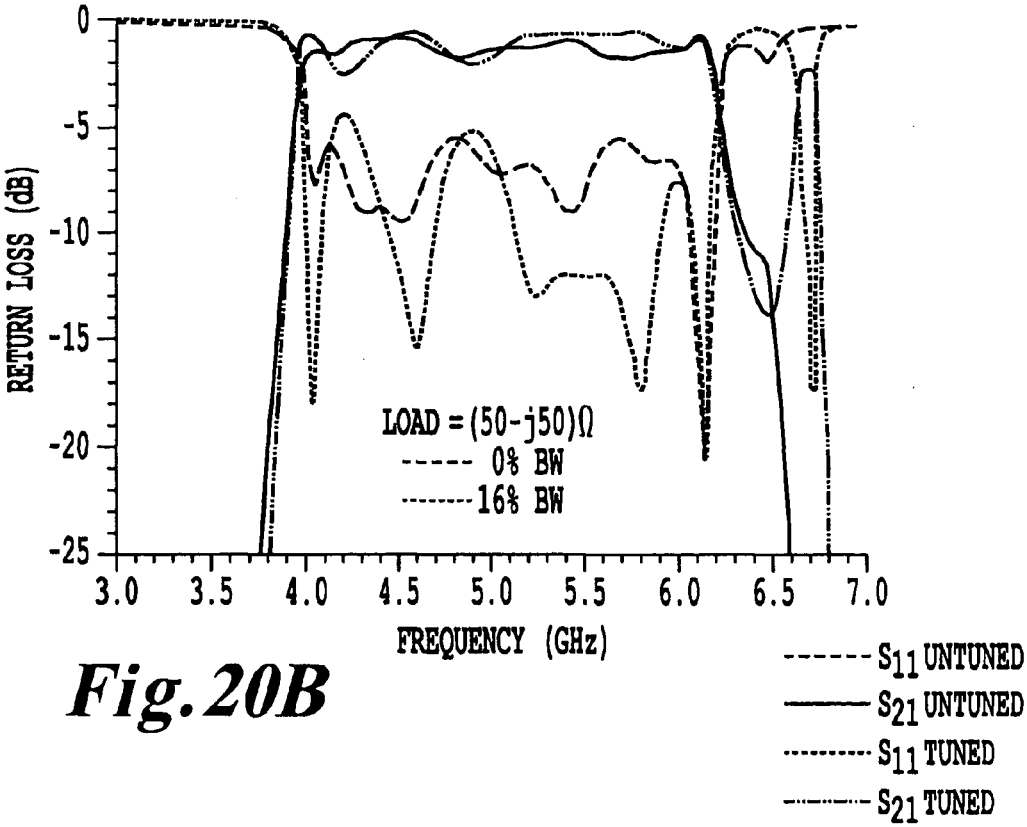
Figure 20C:
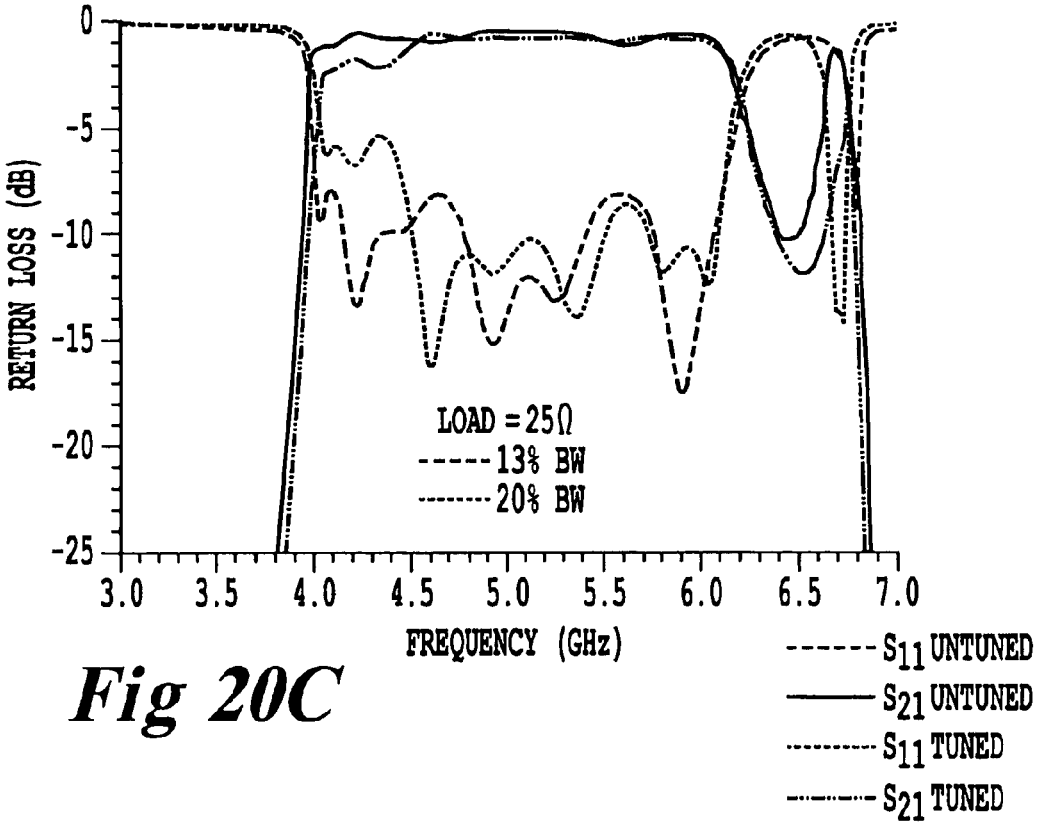
Figure 20D:
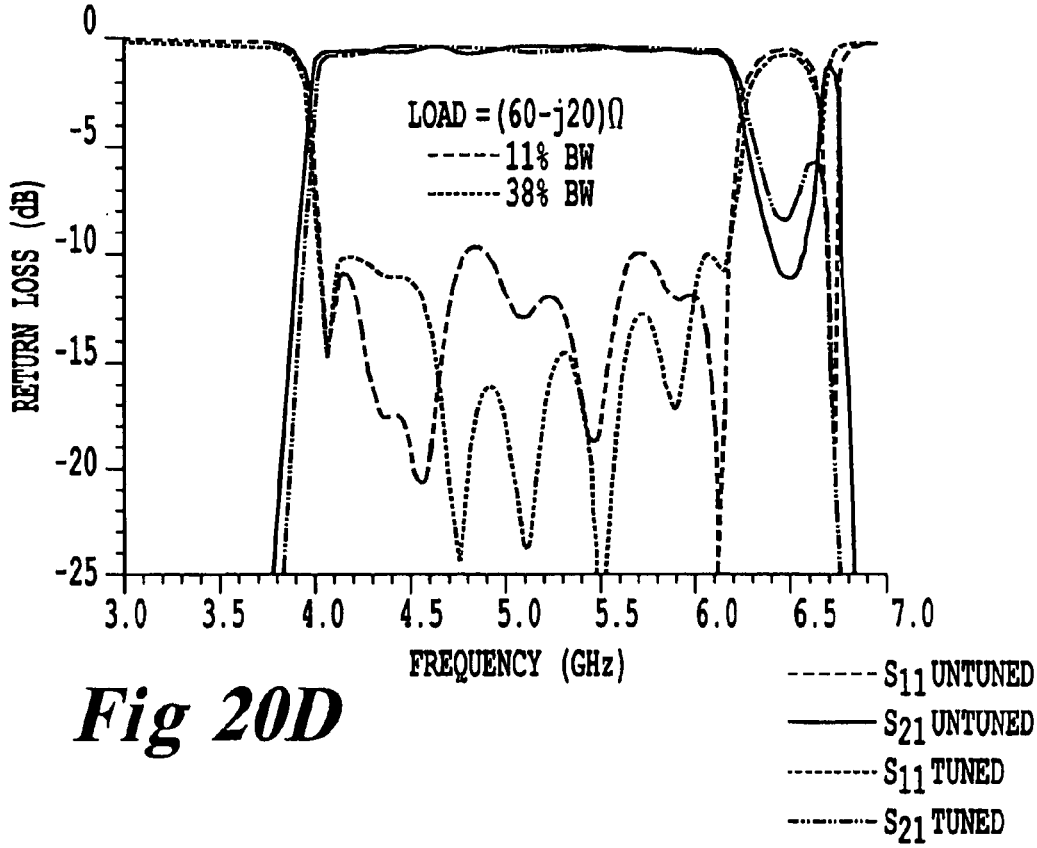
Figure 20E:
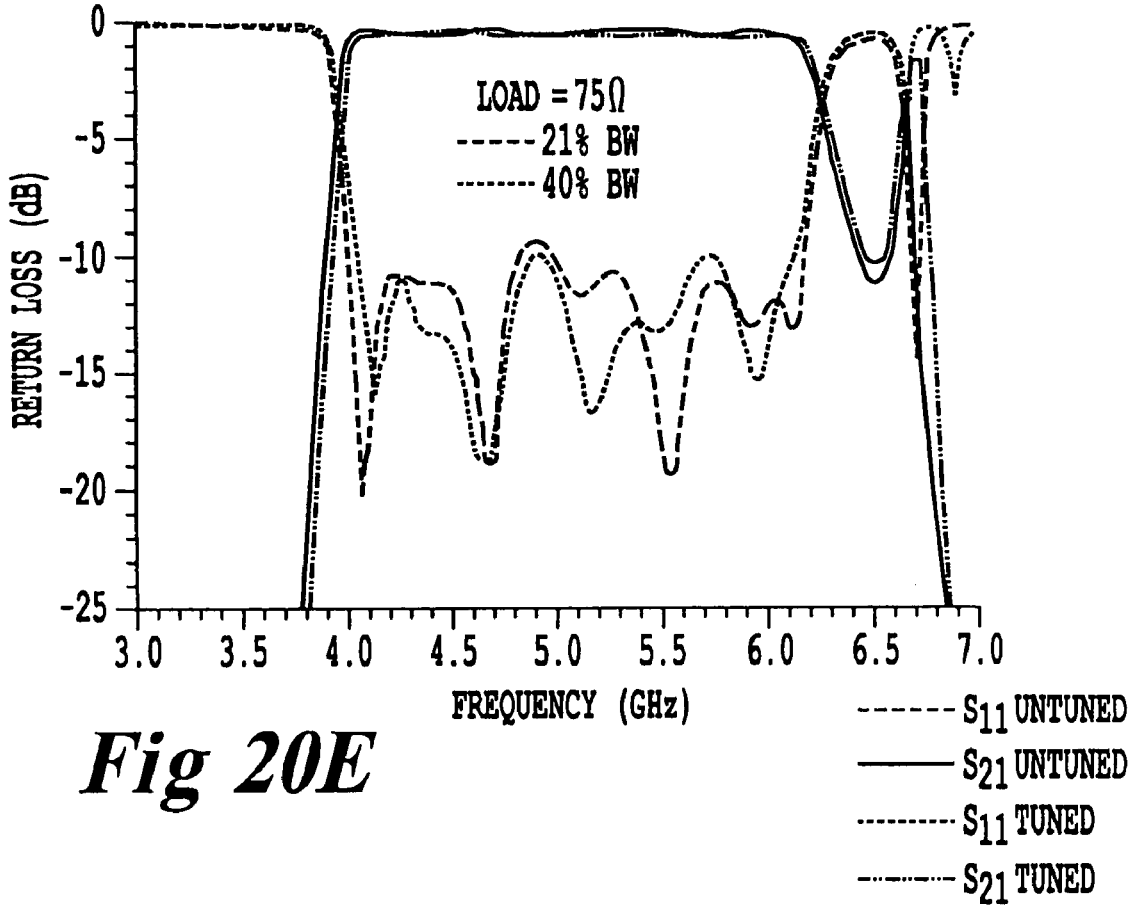
Figure 23A:
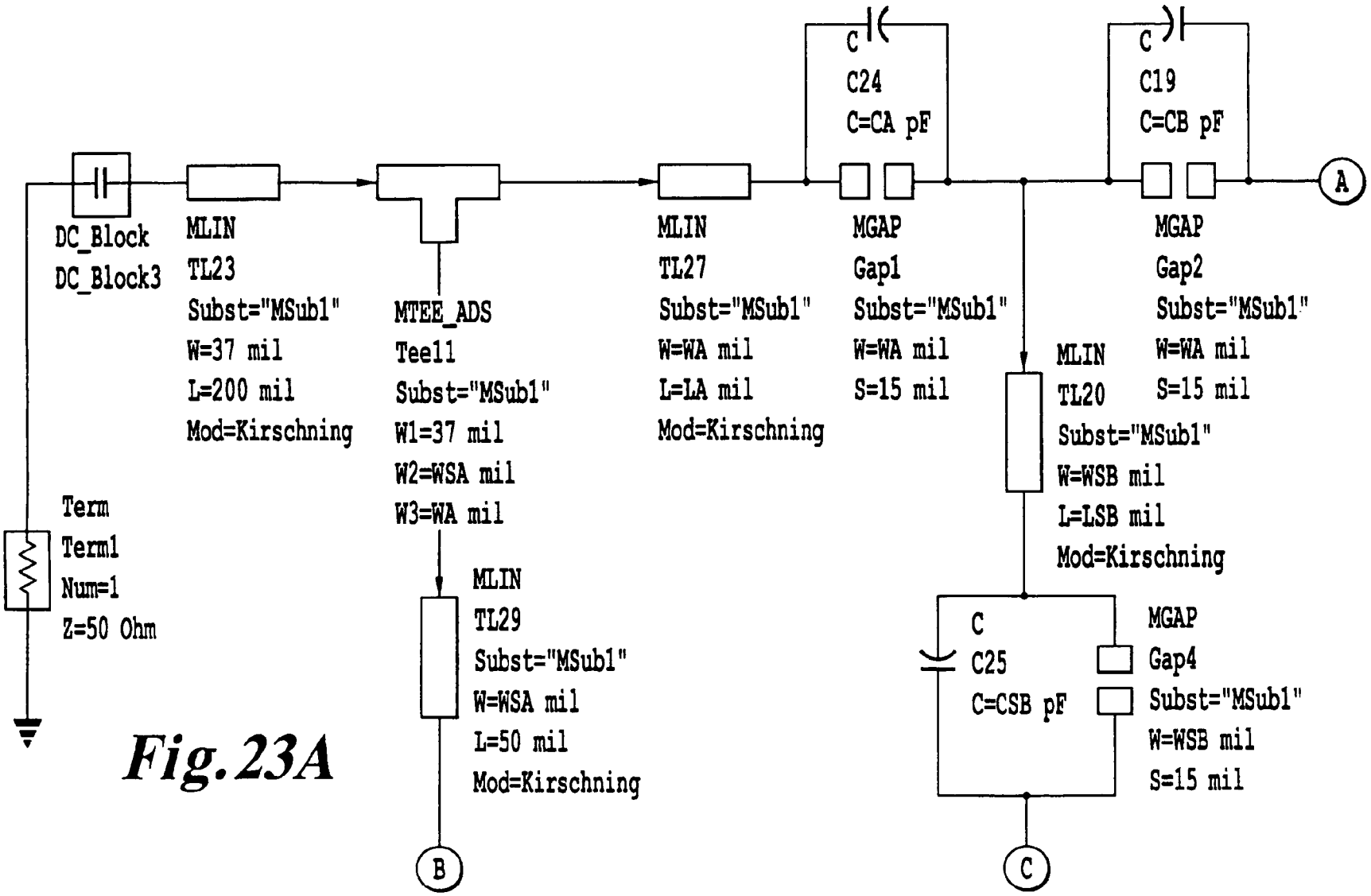
FIG. 23 shows another embodiment of an optimized impedance matching network according to the present invention.
Figure 23B:
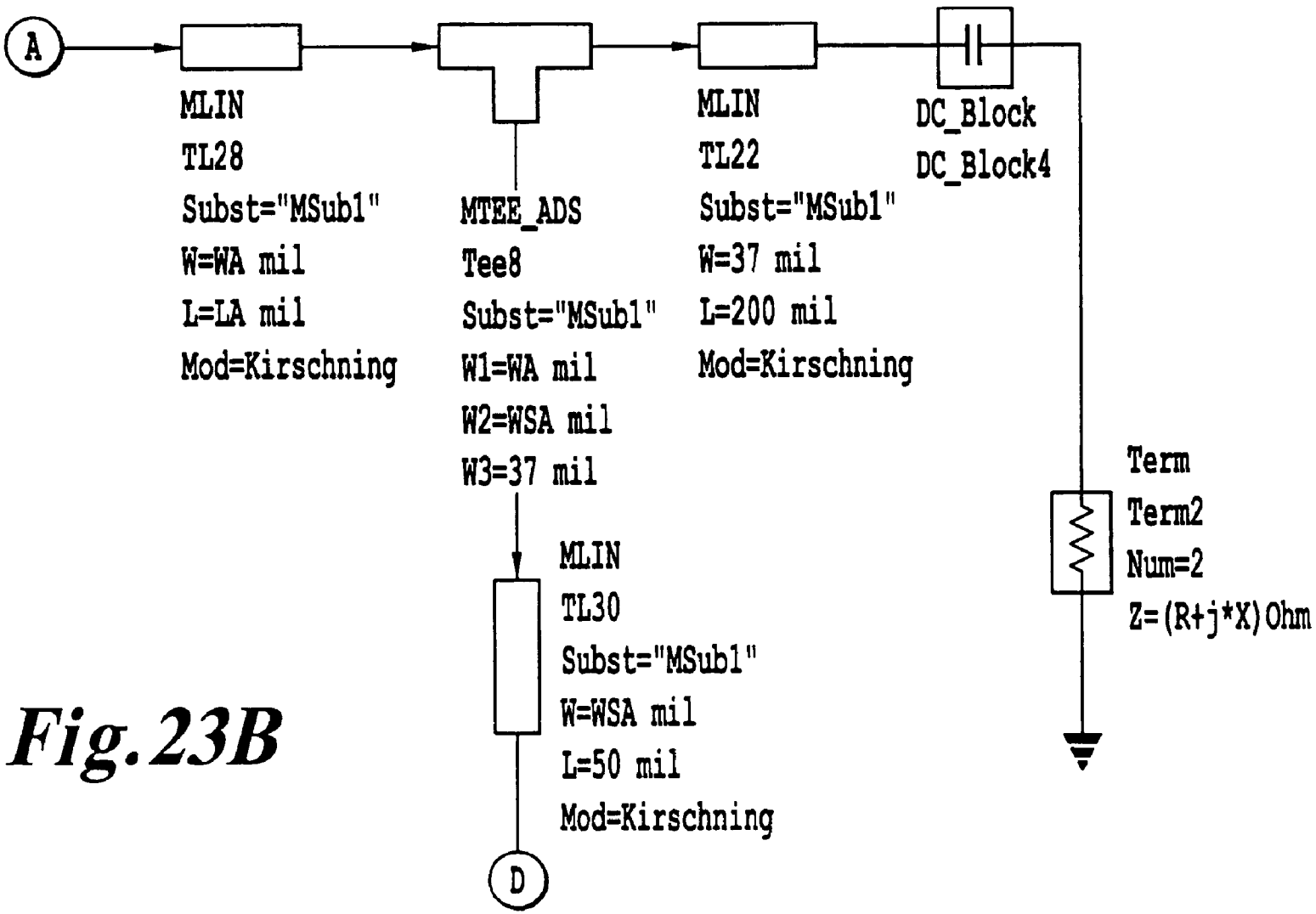
Figure 23C:
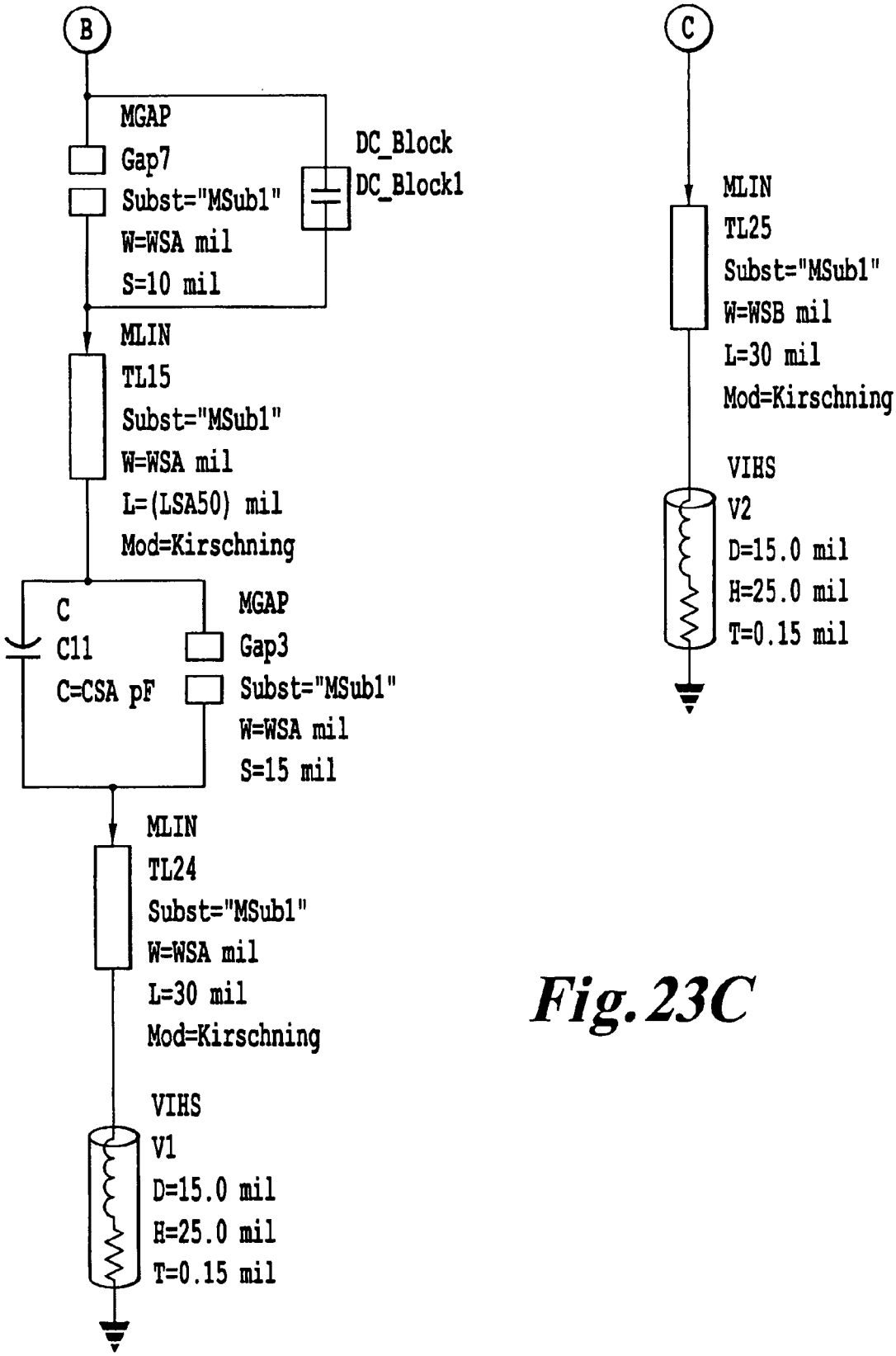
Figure 23D:
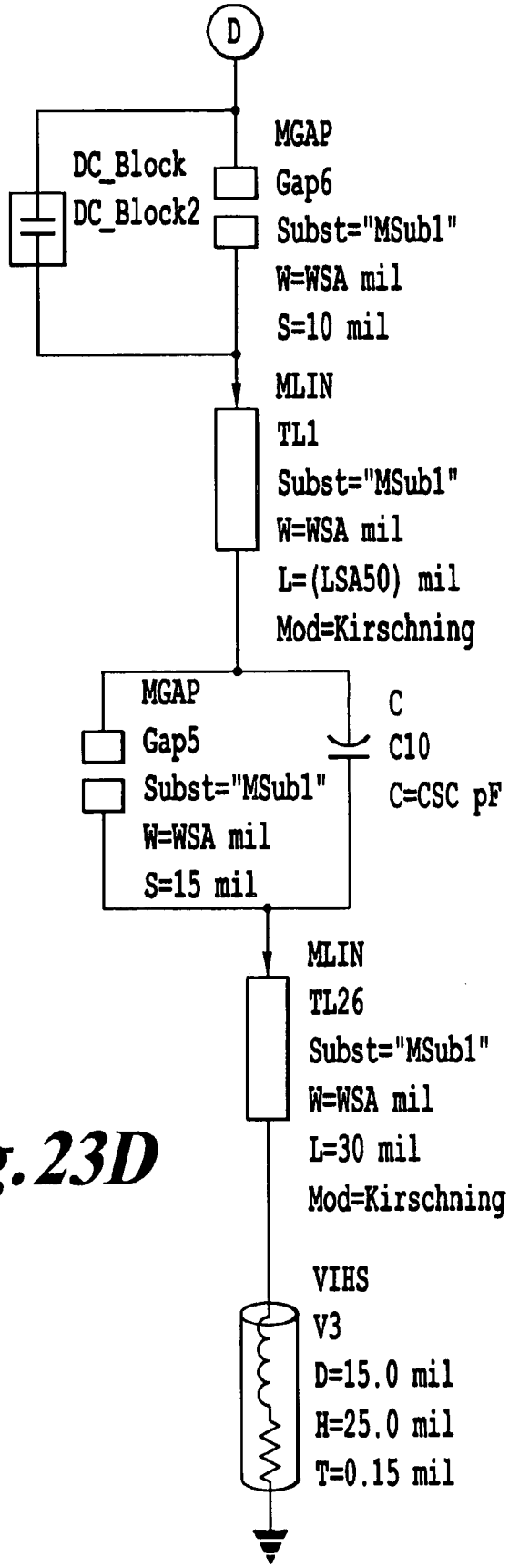

FIGS. 17A-17C show examples of third statistical moments having positive skew, negative skew, and symmetric distribution (no skew), respectively. If a distribution is mostly symmetrical the calculated third moment is approximately zero. Depending on the shift of symmetry to the right or left of the center value the Skewness value can take a positive or negative value. As before, it is assumed that any shift in symmetry is undesirable and the absolute value of the symmetry term subtracts from the value of the cost function.

The first statistical moment of a distribution is called the Mean and is the most fundamental statistical calculation. Since the bandwidth of the pass band is defined as the area of points consecutively below −10 dB return loss, the mean value of the pass band is preferred to be −10 or lower. Therefore the absolute value of this term can be taken as an additive reward in the cost function. The problem, however, with this method is that there may be some points above the desired −10 dB return loss, affecting the calculated bandwidth, but the calculated mean value still lies below −10 dB. This problem may be addressed by using a step function that enforces a penalty on the cost function calculation if any point in the desired pass-band climbs above −10 dB.

Finally, considering the additive and subtracting terms, a first embodiment of an optimization cost function may be defined as:

$$\text{Cost} = a\cdot|\mu_x| - b\cdot\left|\frac{\sum(X-\mu_x)^4}{N\sigma_x^4} - 3\right| - c\cdot\left|\frac{\sum|X-\mu_x|}{N\sigma_x^3}\right| - \text{Penalty} \tag{64}$$

The variables a, b, and c are functional weights.

The weights in this formula may be determined based on possible good values of the Mean, Skewness, and Kurtosis, and assigning those good values to a cost function value of 100. Several different "good" distributions may be used to solve a system of equations. For example, one possible "good" pass-band response selected according to an embodiment of the present invention, is shown in Table 3.4.

TABLE 3.4

| Properties of an example "Good" performing network | | |
|---|---|---|
| $\lvert\mu_x\rvert$ Mean | $\left\lvert \frac{\sum (X-\mu_x)^4}{N\sigma_x^4} - 3 \right\rvert$ Kurtosis | $\left\lvert \frac{\sum \lvert X-\mu_x\rvert}{N\sigma_x^3} \right\rvert$ Skewness |
| 12 | 0 | 0 |
| 13 | 1 | 0 |
| 14 | 1.5 | 1 |

Using the values in Table 3.4 and solving a system of equations for a, b, and c in (64), example preferred cost function weights were determined as shown in Table 3.5.

TABLE 3.5

| Calculated Cost Function Weights | |
|---|---|
| a | $\frac{25}{3}$ |
| b | $\frac{25}{3}$ |
| c | $\frac{25}{6}$ |

Selecting a penalty for having any ripples that pass above the −10 dB point in the pass-band may be unnecessary, and through experimentation the present inventors determined that the cost function could reach a value equal or greater than 100 even if a ripple did pass above the −10 dB threshold, if the penalty was too small. If the penalty was too big, however, depending on the optimization method in ADS, the optimizer would make changes that were too drastic and the cost function value would never fall into a good position in the solution plane. Accordingly, based on experimentation the present inventors determined the preferred penalty value resides between 80 and 90. Using this value should allow a good solution to be found and also not disadvantageously prefer a design with only mediocre performance.

The resulting cost function according to a second embodiment may be defined as:

$$\text{Cost} = \frac{25}{3}\cdot\lvert\mu_x\rvert - \frac{25}{3}\cdot\left\lvert\frac{\sum (X-\mu_x)^4}{N\sigma_x^4} - 3\right\rvert - \frac{25}{6}\cdot\left\lvert\frac{\sum \lvert X-\mu_x\rvert}{N\sigma_x^3}\right\rvert - 90 \tag{65}$$

This cost function is preferably used only on the data vector representing the pass band and nothing outside. When the cost function is used in an optimizer such as ADS, one can drive the performance of a synthesized structure towards that of the ideal case shown in FIG. 4. All synthesized impedance matching networks should preferably go through the optimization process after the initial design stage, to ensure the best network structure, and later to explore its tuning capabilities.

Implementation of the Cost Function in ADS

After the lengths and widths of the microstrip structure are calculated, the structure is closer to being considered a physical realization. If the structure is only to be simulated and not optimized, there is no need to enter the optimization functions. Using the MeasEqn objects in ADS one can enter the cost function, using the statistical methods described earlier.

S-parameter simulations in ADS use discrete points represented by the frequency sweep plan information in the simulation. In this design, each simulation was run such that the frequency was swept from 3 GHz to 7 GHz in 10 MHz steps. Sweeping in this manner meant there were 401 data points, which would be consistent with the standard calibration of an HP network analyzer. Since 40% bandwidth about 5 GHz is the design criteria, the pass-band would represent points 100-300 in ADS, and MeasEqn syntax reflects this.

FIG. 18 shows example objects and syntax used in ADS to implement the cost function.

Once a synthesized structure is created, it can be optimized based on the cost function with the source and load impedances set at a particular value, for example 50%. Use of the optimizer in this manner allows one to optimize performance for an impedance matching network. The synthesized impedance matching network shown in the embodiment of FIG. 15 was optimized in this manner with the lengths and widths of the structure used as the variables in optimization. Table 3.6 and 3.7 show the lengths and widths of the stubs and interconnecting lines before and after optimization.

TABLE 3.6

| Pre and Post Optimization Stub Sizes | | | | | |
|---|---|---|---|---|---|
| Stub | A | B | C | D | E |
| Pre-Optimization Width [mils] | 114 | 212 | 342 | 355 | 137 |
| Post-Optimization Width [mils] | 65 | 342 | 332 | 339 | 96 |
| Pre-Optimization Length [mils] | 265 | 252 | 251 | 250 | 250 |
| Post-Optimization Length [mils] | 306 | 229 | 244 | 248 | 284 |

TABLE 3.7

| Pre and Post* Optimization Interconnecting Line Sizes | | | | | |
|---|---|---|---|---|---|
| Interconnect | A, B | B, C | B, C | C, D | D, E |
| Pre-Optimization Width [mils] | 27 | 21 | 19 | 19 | 19 |
| Post-Optimization Width [mils] | 30 | 19 | 18 | 20 | 22 |
| Pre-Optimization Length [mils] | 283 | 287 | 289 | 289 | 289 |
| Post-Optimization Length [mils] | 309 | 255 | 315 | 262 | 299 |

Simulation of the 40% Bandwidth Reconfigurable Tuner

FIGS. 19A-D show simulation results for the 10 stub tuner in response to various loads at or near 50Ω. In each of FIGS. 19A-19D, the red line represents $S_{11}$ while the blue line represents $S_{21}$. $S_{11}$ represents a return loss (or reflection coefficient) in dB (i.e., signal input at port 1 and sensed at port 1), and $S_{12}$ represents an insertion loss in dB (i.e., signal input at port 1 and sensed at port 2). For example, it is desirable for $S_{11}$ to have a large negative dB value indicating a small reflected signal.

Simulations of the 10 stub 40% bandwidth impedance matching circuit according to the present invention show that, at nominal and slightly mismatched loads, the desired bandwidth was obtained without the need for tuning. Some of the loads tested needed no tuning to meet the 40% bandwidth goal. Calculation of the fractional bandwidth shown in FIGS. 19A-D and throughout this description are done by determining the width of a largest region within the passband that lies below −10 dB and dividing it by the center frequency of that region.

$$BW = \frac{f_{max} - f_{min}}{f_{mid}} \tag{66}$$

With loads having large reactive properties, the optimized reconfigurable tuner may not achieve 40% bandwidth.

FIGS. 20A-E are frequency response plots that show that large changes in the load impedance may cause the bandwidth of the system to suffer. If the reconfigurable tuner works correctly, however, the large changes in impedance should be tuned out and the bandwidth will stay above 40%. Since the resonators are mostly Tchebyscheff spaced the rippled insertion loss parameter can be seen in the plots. Ideally the insertion loss would be flat, but to maximize the bandwidth available with 10 resonators the Tchebyscheff spacing is used. Once the device is tuned, however, the resonator spacing profile is no longer Tchebyscheff, but something resulting from fitting to the optimization function.

To test the ability of the reconfigurable tuner to match loads that have impedances much different than 50Ω, the optimizer was used with the same cost function described earlier. In reconfiguring the network one optimizes the capacitor values that are connected to each stub and interconnecting line while leaving the widths and lengths constant. Reconfiguration of the network in this manner allows one to find capabilities of the matching network.

As shown in FIGS. 20A-E, the result of tuning the varactor diodes is apparent. In this example, the circuit was tuned using the cost function described above. Although the cost function may not exactly match the method used in tuning in the real world circuit (due to restrictions on the pseudo-continuous nature of the circuit), the cost function shows how well the structure can be adapted to match new loads. Loads that are non-reactive or barely reactive seem fairly simple to match and still obtain wide instantaneous bandwidth. Loads that are highly reactive, however, seem more difficult to match.

Further, the simulation results show that loads which have a capacitive reactance are easier to tune to wide bandwidth matching than loads with inductive reactance.

FIGS. 21A and 21B show the ability of the 10 stub tuner to match certain loads, before and after tuning, respectively. The horizontal axis in each plot represents the real part of the impedance while the vertical axis represents the imaginary part. If a certain load impedance match is desired, and ability for the 10 stub matching networks to match that load may be determined based a position in FIGS. 21A and 21B. Table 3.8 includes the resulting varactor settings that were obtained from tuning the design with the optimizer and corresponding to the element values in the embodiment of FIG. 15.

TABLE 3.8

Stub and Interconnecting Line Tuned Varactor Capacitances (pF)

| Load | Bandwidth | CA | CB | CC | CD | CE | CF |
|---|---|---|---|---|---|---|---|
| 25 − j50 | 0 | 2.443 | 2.385 | 4.501 | 1.738 | 5.985 | 4.44 |
| 50 − j50 | 1 | 2.141 | 5.564 | 4.98 | 3.339 | 1.963 | 3.143 |
| 25 + j50 | 12 | 2.591 | 0.447 | 1.31 | 2.884 | 5.551 | 5.938 |
| 70 + j50 | 12 | 2.838 | 2.817 | 4.423 | 1.866 | 2.942 | 4.621 |
| 40 − j50 | 21 | 0.604 | 2.275 | 2.942 | 2.555 | 3.558 | 5.124 |
| 70 − j50 | 21 | 0.503 | 5.183 | 3.64 | 1.43 | 3.962 | 4.293 |
| 40 + j50 | 23 | 4.611 | 0.399 | 1.445 | 1.646 | 4.597 | 3.645 |
| 75 | 25 | 3.955 | 3.318 | 3.326 | 2.09 | 5.324 | 2.284 |
| 50 − j35 | 26 | 2 | 5.874 | 3.739 | 4.718 | 3.855 | 2.604 |
| 60 − j20 | 28 | 3.759 | 3.295 | 3.597 | 4.066 | 2.619 | 2.826 |
| 50 + j35 | 30 | 5.214 | 1.124 | 3.409 | 2.244 | 1.009 | 5.146 |
| 30 + j10 | 32 | 3.839 | 2.939 | 4.728 | 2.79 | 3.69 | 2.068 |
| 30 − j10 | 32 | 2.818 | 5.711 | 4.577 | 1.607 | 3.571 | 3.424 |
| 60 + j20 | 34 | 1.804 | 2.393 | 2.972 | 3.056 | 1.39 | 2.925 |
| 50 − j10 | 40 | 3 | 3 | 3 | 3 | 3 | 3 |
| 50 + j10 | 40 | 3 | 3 | 3 | 3 | 3 | 3 |
| 50 | 40 | 3 | 3 | 3 | 3 | 3 | 3 |

TABLE 3.8-continued

Stub and Interconnecting Line Tuned Varactor Capacitances (pF)

| Load | Bandwidth | CG | CH | CI | CSA | CSB | CSC |
|---|---|---|---|---|---|---|---|
| 25 − j50 | 0 | 3.768 | 4.312 | 1.804 | 0.805 | 3.86 | 1.482 |
| 50 − j50 | 1 | 3.392 | 1.008 | 2.761 | 1.812 | 5.891 | 1.788 |
| 25 + j50 | 12 | 5.599 | 3.547 | 3.892 | 4.389 | 1.344 | 3.619 |
| 70 + j50 | 12 | 2.466 | 3.451 | 3.935 | 3.352 | 0.264 | 3.543 |
| 40 − j50 | 21 | 2.36 | 3.049 | 2.763 | 1.966 | 1.576 | 3.453 |
| 70 − j50 | 21 | 2.621 | 2.644 | 4.928 | 5.023 | 0.579 | 2.405 |
| 40 + j50 | 23 | 5.444 | 4.05 | 3.738 | 6.082 | 3.504 | 2.602 |
| 75 | 25 | 2.438 | 2.727 | 3.485 | 3.044 | 2.392 | 2.988 |
| 50 − j35 | 26 | 1.749 | 2.254 | 1.936 | 1.189 | 1.712 | 5.33 |
| 60 − j20 | 28 | 4.019 | 5.093 | 3.859 | 3.6 | 5.764 | 2.461 |
| 50 + j35 | 30 | 3.594 | 3.688 | 2.976 | 4.421 | 1.271 | 2.457 |
| 30 + j10 | 32 | 2.673 | 5.383 | 2.323 | 2.982 | 1.597 | 4.451 |
| 30 − j10 | 32 | 3.924 | 5.655 | 1.271 | 1.338 | 3.587 | 1.403 |
| 60 + j20 | 34 | 4.016 | 3.794 | 3.287 | 3.005 | 2.653 | 2.897 |
| 50 − j10 | 40 | 3 | 3 | 3 | 3 | 3 | 3 |
| 50 + j10 | 40 | 3 | 3 | 3 | 3 | 3 | 3 |
| 50 | 40 | 3 | 3 | 3 | 3 | 3 | 3 |

| Load | Bandwidth | CSD | CSE | CSF | CSG | CSH | CSI | CSJ |
|---|---|---|---|---|---|---|---|---|
| 25 − j50 | 0 | 0.322 | 3.503 | 6.009 | 3.932 | 1.502 | 3.449 | 3.504 |
| 50 − j50 | 1 | 1.669 | 4.461 | 4.181 | 3.083 | 0.303 | 3.425 | 2.867 |
| 25 + j50 | 12 | 5.009 | 4.64 | 5.351 | 3.906 | 2.268 | 3.853 | 3.405 |
| 70 + j50 | 12 | 2.656 | 4.998 | 3.549 | 2.624 | 5.308 | 3.217 | 2.171 |
| 40 − j50 | 21 | 5.282 | 3.287 | 2.856 | 1.421 | 2.5 | 2.525 | 3.571 |
| 70 − j50 | 21 | 4.836 | 2.753 | 2.732 | 3.512 | 4.54 | 5.227 | 3.493 |
| 40 + j50 | 23 | 0.252 | 4.046 | 3.853 | 6.006 | 5.982 | 5.821 | 4.541 |
| 75 | 25 | 3.533 | 3.637 | 3.833 | 4.673 | 3.211 | 2.14 | 2.633 |
| 50 − j35 | 26 | 2.709 | 4.267 | 2.729 | 1.942 | 3.247 | 2.685 | 5.531 |
| 60 − j20 | 28 | 2.581 | 3.806 | 2.772 | 1.782 | 1.527 | 4.538 | 4.022 |
| 50 + j35 | 30 | 0.832 | 4.846 | 2.468 | 3.956 | 5.01 | 3.698 | 3.89 |
| 30 + j10 | 32 | 4.402 | 3.726 | 2.501 | 1.895 | 4.133 | 1.923 | 3.049 |
| 30 − j10 | 32 | 5.676 | 3.676 | 2.59 | 3.889 | 2.064 | 2.333 | 4.782 |
| 60 + j20 | 34 | 2.701 | 4.111 | 2.542 | 2.558 | 2.941 | 2.233 | 2.24 |
| 50 − j10 | 40 | 3 | 3 | 3 | 3 | 3 | 3 | 3 |
| 50 + j10 | 40 | 3 | 3 | 3 | 3 | 3 | 3 | 3 |
| 50 | 40 | 3 | 3 | 3 | 3 | 3 | 3 | 3 |

Device Reconsiderations

Since a 10 stub element may be too large to build and test effectively in a timely manner, a 3 stub 20% bandwidth reconfigurable network was designed for test purposes. A 3 stub network should be far less costly in terms of time and material to fabricate than a 10 stub element but be equally valuable in its ability to verify the principles of the present invention. The 3 stub tuner is simulated while taking into account as physical properties as described below, then the results to the fabricated device described below are compared to the following simulated results.

Since the 3 stub reconfigurable network is to be fabricated, extra information pertaining to the physical realization of the circuit should be included in the design equations. A modification to the method for determining stub lengths and widths from the transmission line impedance was used to take into account discontinuities and parasitic values in a microstrip circuit. Further, the adaptation of adding the varactor diodes to the interconnecting lines and stubs, adds gap discontinuities to the system. Additionally, DC blocking capacitors were introduced to make the varactor diodes capable of being biased. All of these devices and discontinuities were modeled into the device simulation and taken into account.

In-line and stub microstrip gaps were assumed to be placed in parallel with the tuning varactor diodes, providing a simple means of blocking the DC bias of the diodes. Since the addition of the tuning varactor impedance was taken into account earlier, the capacitive effects of a microstrip gap were added to the varactor impedance before calculating the size of a microstrip stub or interconnect. Although ADS has a fully functional gap discontinuity model, to obtain best device performance, the presence of the gap was built into the design equations.

FIG. 22 includes a physical and schematic representation of a microstrip gap, and the associated capacitance properties.

$$C_p = 0.5C_e \tag{67}$$

$$C_g = 0.5C_o - 0.25C_e \tag{68}$$

$$\frac{C_o}{W}(\text{pF}/m) = \left(\frac{\varepsilon_r}{9.6}\right)^{0.8}\left(\frac{s}{W}\right)^{m_o} e^{k_o} \tag{69}$$

$$\frac{C_e}{W}(\text{pF}/m) = 12\left(\frac{\varepsilon_r}{9.6}\right)^{0.9}\left(\frac{s}{W}\right)^{m_e} e^{k_e} \tag{70}$$

$$m_o = \frac{W}{h}\left[0.619\log\left(\frac{W}{h}\right) - 0.3853\right] \text{ for } 0.1 \le \frac{s}{W} \le 1.0 \tag{71}$$

$$m_e = \frac{1.565}{\left(\frac{W}{h}\right)^{0.16}} - 1 \tag{72}$$

$$k_e = 1.97 - \frac{0.03}{W/h} \text{ for } 0.3 \le \frac{s}{W} \le 1.0 \tag{73}$$

By neglecting $C_p$ (material height is enough to make this negligible) and assuming a value for $C_g$, which is then lumped with the varactor diode nominal capacitance, the width S of a gap can be calculated based on the properties of the material that the structure will be fabricated on. If a particular gap width is needed, the nominal varactor capacitance state can be changed such that when the gap capacitance and the varactor capacitance are lumped, they do not affect the width of the connecting lines or gap. The gap and connecting line widths can be added into an ADS model and placed in the circuit schematic. In the schematic representation, the DC blocking capacitors are also represented parallel to microstrip gaps.

The shunt connection to ground at the end of every stub may be accomplished by a via, which may introduce inductance that can be modeled using the ADS via model. By taking the gap capacitances and the inductive effects of the vias into account before optimization, a more accurate design can be achieved. Using the ADS optimizer to bring the circuit performance as close to theoretical as possible, while considering the more physical circuit layout, gives a more clear idea of what one can expect performance-wise from a real physical device.

FIG. 23 shows another embodiment of an optimized impedance matching network according to the present invention. The embodiment of FIG. 23 includes a three-stub reconfigurable tuner.

Table 3.9 shows simulated values for the circuit embodiment in FIG. 23.

TABLE 3.9

Optimized Microstrip Dimensions for 3 Stub 20% Bandwidth Network

| Stub/Interconnect | A | B | A, B |
|---|---|---|---|
| Width [mils] | 116 | 157 | 42 |
| Length [mils] | 281 | 294 | 233 |

Before each via at the end of each stub may be located small 30 mil transmission lines that are the same width of the corresponding stub are placed. The reason for doing this is so that there can be a pad for connecting the varactor diode before the via. All gaps in this design are 15 mils wide, although other gap widths may also be accommodated. The size of this structure was calculated using the microstrip design equations and the synthesis equations described above.

Figure 24:
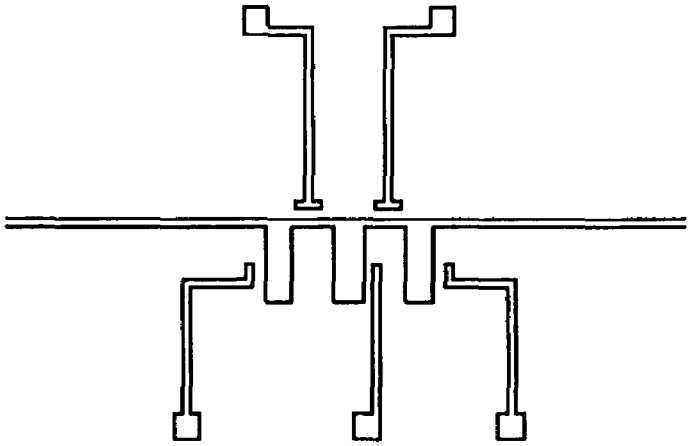
FIG. 24 is a physical layout example of a device having optimized dimensions.
Figure 25A:
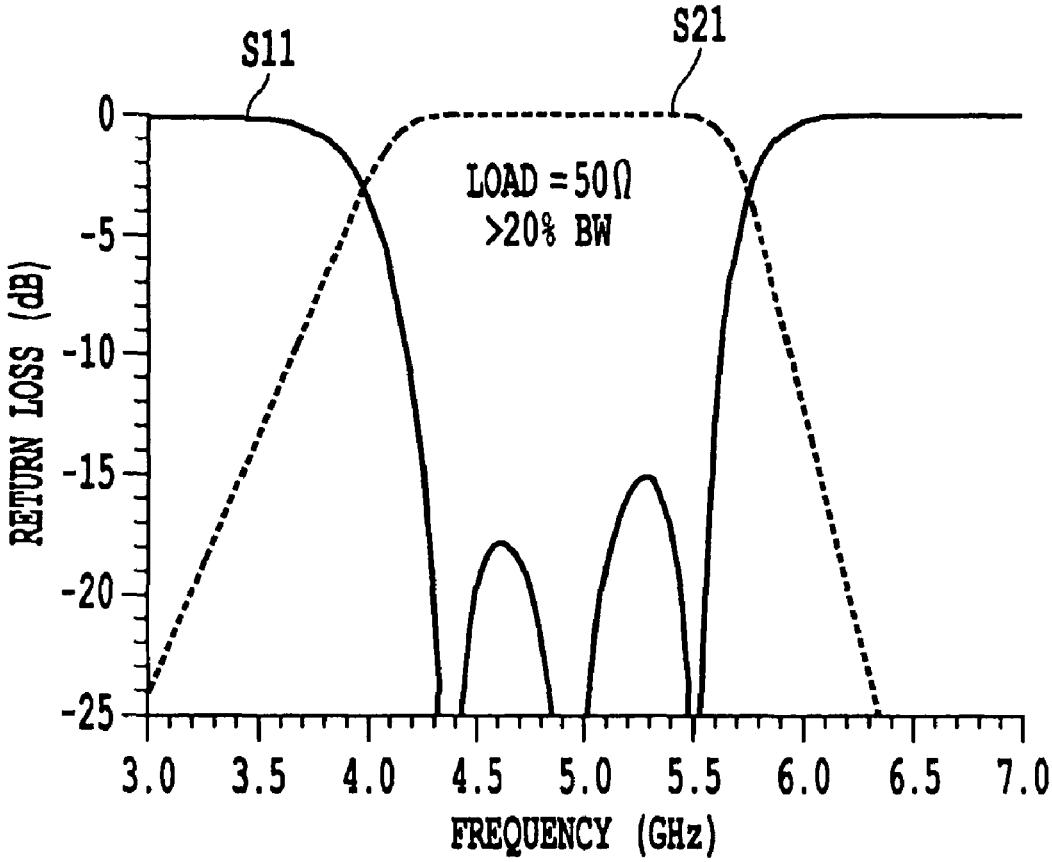
FIGS. 25A-E are frequency response plots of simulation results for the embodiment of the 3 stub tuner shown in FIG. 23 with load impedances that are equal to or close to 50Ω.
Figure 25B:
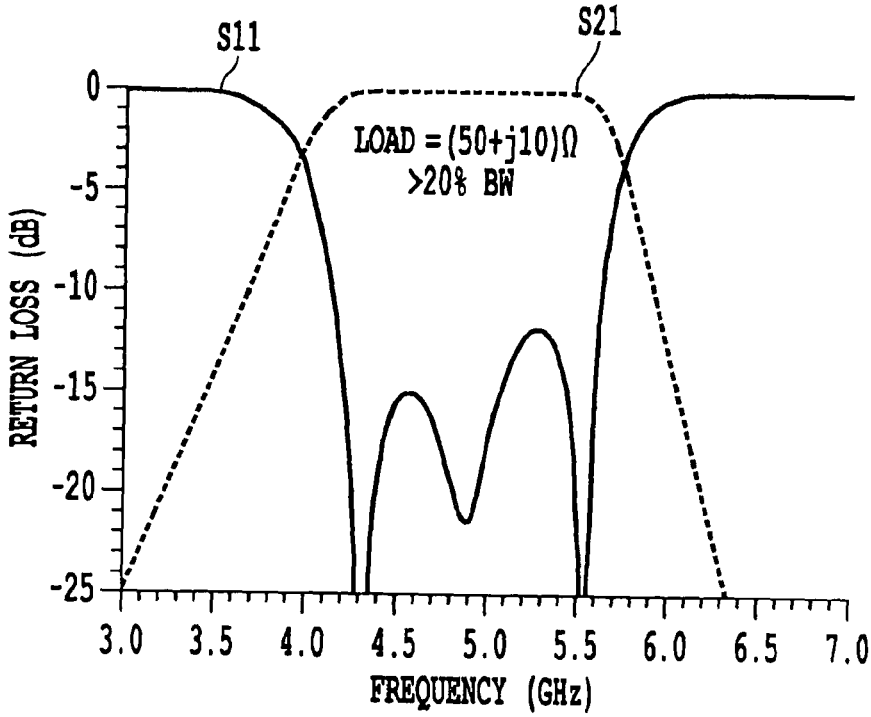
Figure 25C:
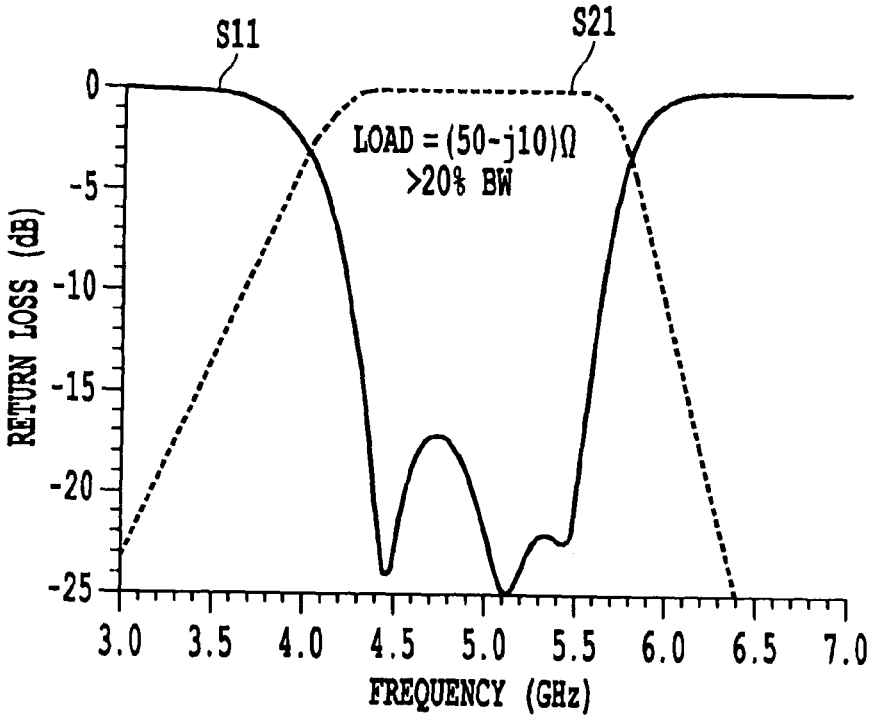
Figure 25D:
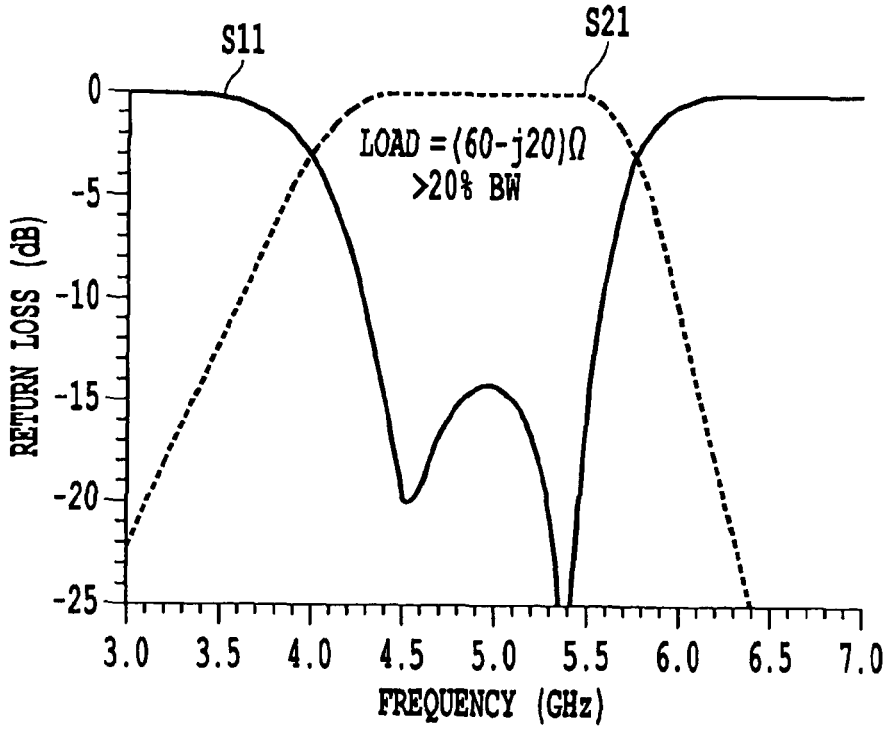
Figure 25E:
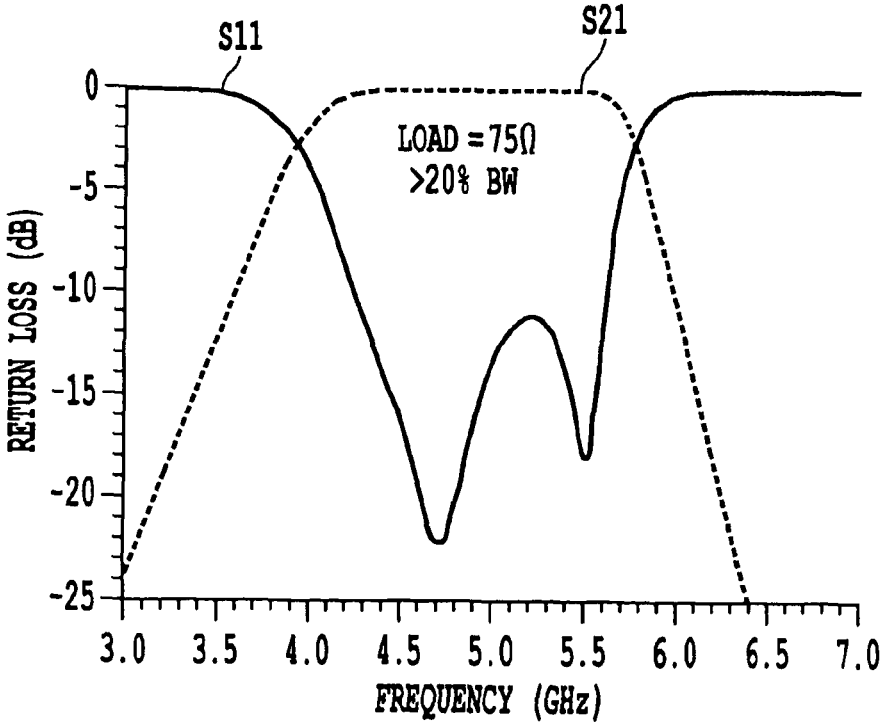
Figure 26A:
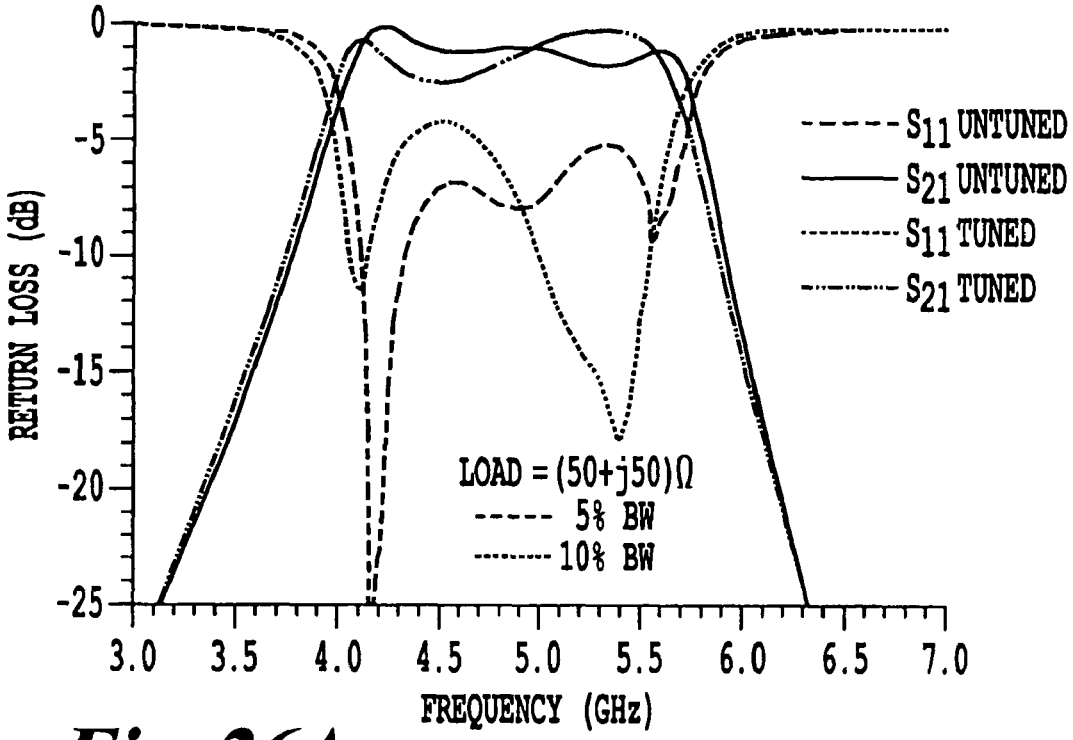
FIGS. 26A-D are frequency response plots showing the effects of loads for which the 3 element tuner was unable to achieve the bandwidth goal without tuning.
Figure 26B:
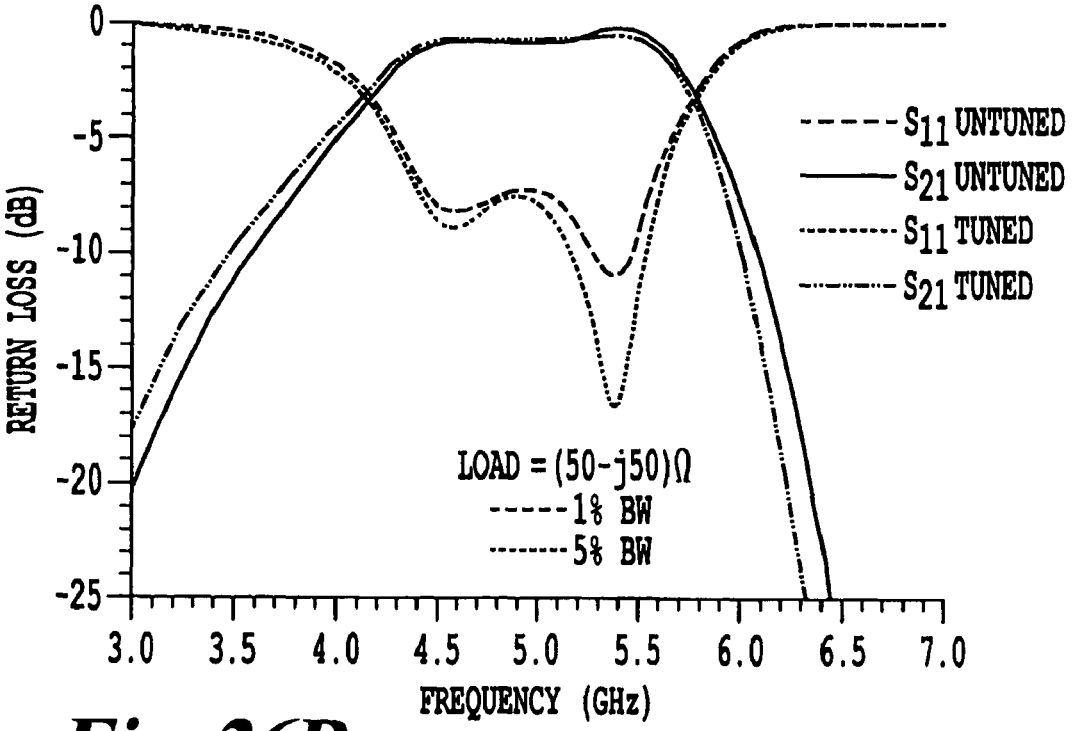
Figure 26C:
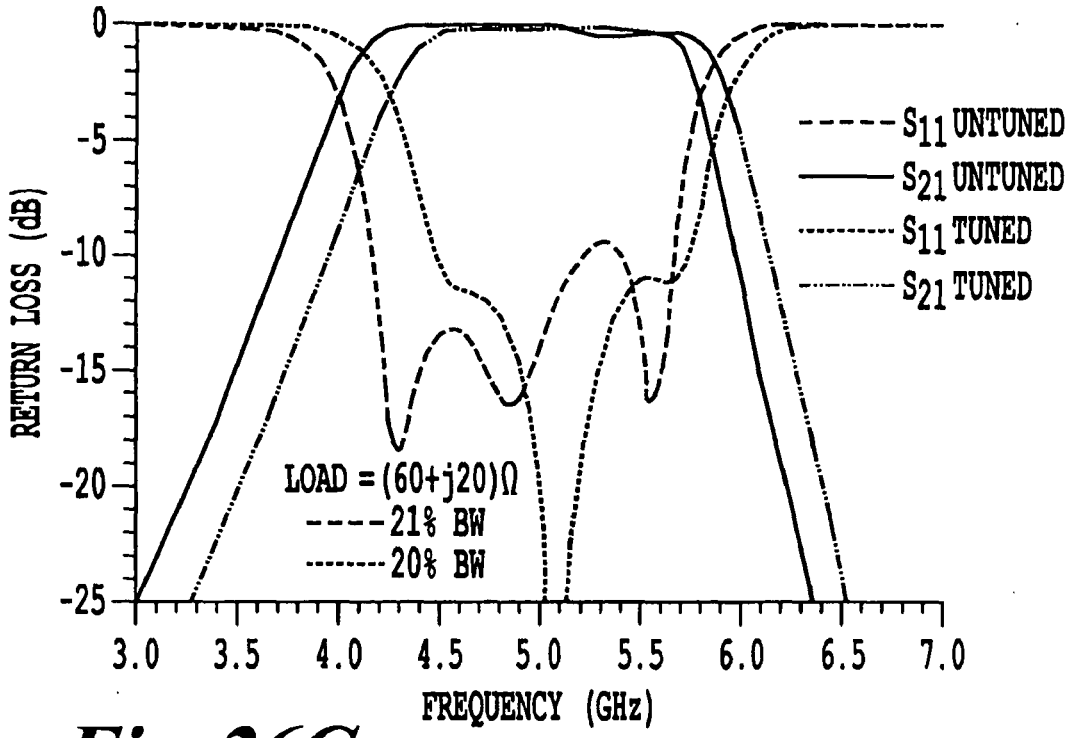
Figure 26D:
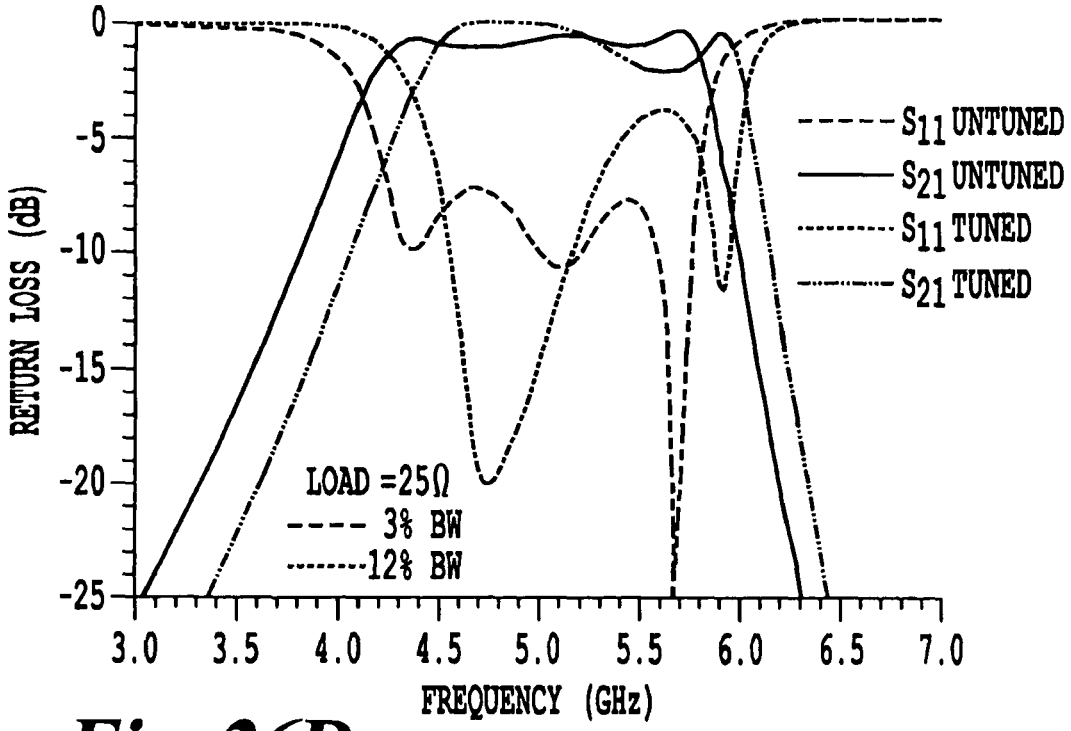

FIG. 24 shows an example of a physical layout of a device having the optimized dimensions shown in Table 3.9, including a fabrication error that lead to a longer center resonating stub that will be discussed in more detail below.

Simulation of the 20% Reconfigurable Tuner

As before, the synthesized device was optimized before extensive testing. Although the reconfigurable tuner was designed to have 20% instantaneous bandwidth matching, simulations show it is capable of more than that, sometimes achieving 30% bandwidth. Unfortunately, designing for a lower number of resonators compromised some of the tuning properties of the matching structure. Simulations on the 3 stub device represent a best case scenario and may not accurately reflect the effects of parasitic resistances, capacitances, and inductances introduced in actual physical assembly of the device. These parasitic elements may be difficult to determine and are examined in more detail when the circuit is fabricated and tested.

FIGS. 25A-E are frequency response plots of simulation results for the embodiment of the 3 stub tuner shown in FIG. 23 with load impedances that are equal to or close to 50Ω.

As is evidenced by the plots in FIGS. 25A-E, the 3 stub tuner is capable of achieving 20% instantaneous bandwidth over a wide variety of loads without the need for varactor tuning. In addition to the excellent bandwidth properties, the insertion loss profile appears very flat. However, the 3 stub tuner does not perform as well with highly reactive loads. Different than in the 10 element tuner, the 3 element network seems to favor inductive loads over capacitive loads.

FIGS. 26A-D are frequency response plots showing the effects of loads for which the 3 element tuner was unable to achieve the bandwidth goal without tuning.

The 3 stub tuner has a difficult time matching to loads that are highly reactive or have relatively small impedance without tuning. Once tuning is attempted the 3 stub element meets and exceeds the bandwidth requirement over a wide range of loads. Surprisingly enough, high impedance loads seem to be easier to match than lower impedance loads. High impedance loads can have highly varying reactive profiles and the reconfigurable circuit is capable of matching impedance. Loads which have highly reactive profiles but real impedance values around the center of the Smith Chart are difficult to match. FIGS. 26A-D also show attenuation and insertion loss matching results for the 3 stub reconfigurable network when tuning using the optimization method was attempted.

Figure 27:
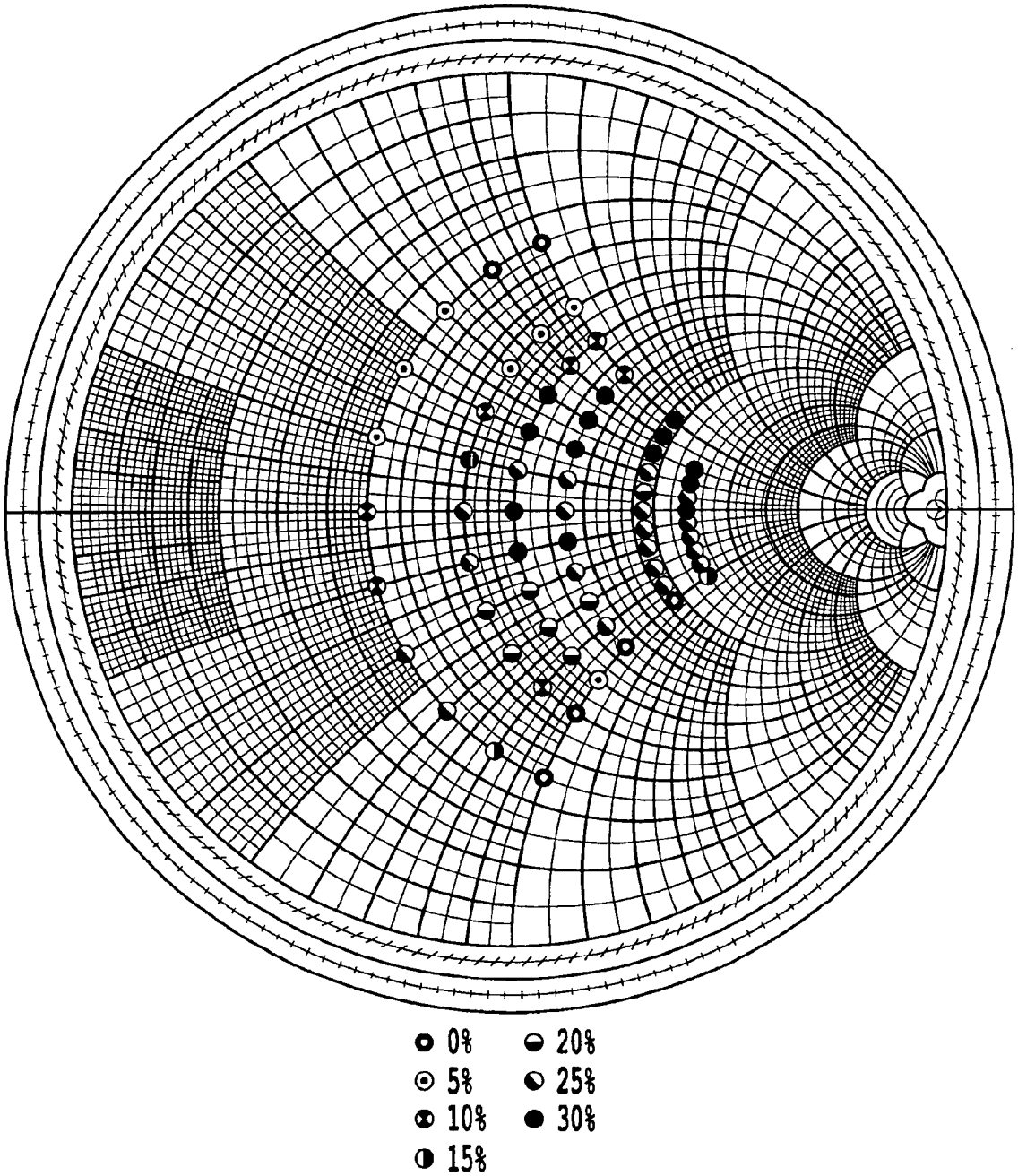
FIG. 27 plots the matching ability for the 3 stub tuner over a variety of load cases and indicates that high impedance loads can be matched with a high degree of success.

FIG. 27 plots the matching ability for the 3 stub tuner over a variety of load cases and indicates that high impedance loads can be matched with a high degree of success. Loads with lower impedance and high reactance may not be matched to 50Ω with large bandwidth successfully.

Stub Tuner Fabrication

A discussion of the process of fabrication of the 3 stub tuner follows. There are a variety of methods for fabricating a microwave circuit according to the present invention. In the following example, the invention was implemented as a microstrip circuit using well established manufacturing methods. However, one of skill in the art will readily see that alternate fabrication methods are also included in the invention.

Fabrication Process

Fabrication of the impedance matching network took place at the University of Arizona Microelectronics Laboratory, a 1000 ppm clean room environment. The impedance matching network structure was fabricated on a Rogers Corp DUROID 6006. This material has a dielectric constant of 6.15 and a loss tangent of 0.0027. Materials such as DUROID 6006 have excellent mechanical and electrical properties, however, the invention also applies to other microstrip fabrication materials, as would be understood by one of skill in the art. Since DUROID 6006 is malleable, it can withstand great physical shock without damage. Additionally because the substrate will not shatter, drilling vias is especially easy and does not require the use of a laser.

The material parameters used in to fabricate an embodiment of the invention are shown in Table 4.1.

TABLE 4.1

| DUROID Material Properties | |
|---|---|
| Dielectric Constant | 6.15 |
| Loss Tangent | 0.0027 |
| Thickness | 25 mil |
| Cladding | 1 oz |
| Cladding Method | Rolled and Electrodeposited |
| Conductor Thickness | 1.4 mil |

A mask may be generated for the three stub design using Postscript programming and then later simplified using AutoCAD 2004. The mask is a physical layout of the circuit tested in ADS with line widths, stubs, blocking capacitors, and gaps all modeled accordingly. In addition to the normal filter structure, DC bias lines and pads were added to facilitate the tuning action of the circuit. The overall length of this structure on a material of $\in_r$=6.15 is approximately 1100 mils. The width of the device is dependent on how the designer decides to handle biasing of the tuning diodes, but is preferably not less than about 350 mils (the length of the stubs added to the width of the input and output line).

Once a mask is generated and printed on film at resolution of at least 1200 dpi and material is procured, fabrication can begin. The first step in fabrication is cutting the DUROID material to the correct size. It is preferred to cut the material in a square shape so that when photo-resist is applied and spun, it is balanced and the structure does not detach from the spinner. Applying photoresist uniformly is made easier by spinning only one side and brushing the other side with photoresist. The spun side, which was more uniformly covered in photoresist, was where the circuit element would be etched. The ground plane was fabricated on the brushed side. The structure was baked with photoresist at 100° C. for 2 minutes. If the photoresist is not applied uniformly it can be removed with acetone and a uniform distribution can be reattempted. In order to obtain good accuracy in etching, it is important to apply the photoresist as uniformly as possible.

Once photoresist was applied and the circuit was baked, the mask was placed over the spun side of DUROID and exposed to UV light for one minute thirty seconds. Depending on how thick the photoresist was applied longer exposure times may be necessary. After exposure the structure is then placed in developer solution. Once the circuit pattern is visible the circuit is washed with water and then examined under a microscope. Upon examination under the microscope, all circuits exposed appeared to be developed accurately. Close inspection of edges and the jaggedness of straight lines can reveal how well a structure has been developed.

After development, the structure was then etched in copper etching solution and hot water. It is important to maintain a good concentration of water and copper etching solution to get a uniform etch. In addition to a good concentration, the temperature must be set correctly. Obtaining the right solution concentration and temperature may be done by trial and error. Often a hotplate is used to warm the entire etch bath. Once etching is complete and the unwanted copper is removed, the entire piece is bathed in acetone to remove the excess photoresist.

Early iterations of the 3 stub tuner were etched on DUROID with rolled copper cladding. Rolled copper cladding is often much smoother than electrodeposited cladding and offers slightly better electrical properties. Electrodeposited cladding takes much less time to etch however, and much more accurate structures can be obtained. Through use, it became apparent that electrodeposited copper cladding was less sensitive to the etching solution concentration. Electrodeposited copper also allows for much thinner claddings than typical rolled copper, if the potential application so requires it.

Circuit Vias on Microstrip

After the structure was successfully etched, vias were created to account for the shunt in the circuit. According to Hong, the width of the via should be as wide as the resonating stub and more or less square in shape. In the simulation of the circuit it was decided that a simple hole placed at the end and middle of the stub would be sufficient as a via, and would be easier to manufacture. In order to create vias, holes had to be drilled in the circuit structure.

To facilitate drilling of vias a drill bit of 15 mil diameter was purchased. A pin vise was used so that the small drill bit could be adapted to fit a standard drill press chuck. It was found that by applying the epoxy in a small glob on the ground plain of the structure and pushing it through much like with a spackle and putty knife, the holes would fill more effectively. If the structure is baked immediately after filling a via, excellent electrical properties may be obtained.

Varactor Tuning Diodes

Varactor diodes are available in many different capacitance ranges and packaging sizes. For this embodiment, it is determined that good tuning action is accomplished when the capacitance ranges from 0.2 pF to 5 pF at 5 GHz.

In order to accomplish good tuning, the diode's nominal capacitance state should preferably be in the middle of its capacitance range. Using the MPV1965 diode, the nominal capacitance is 3 pF and structure parameters are selected based on this metric. If the nominal capacitance were lower, the stub width would become very narrow. There is often a tradeoff between the desired width, choosing a nominal diode state, and balancing nominal state power usage. Ideally, when a diode is in its nominal state it would require no bias voltage and therefore not require any external energy to work. For good tuning action, however, this is not practical.

Figure 28:
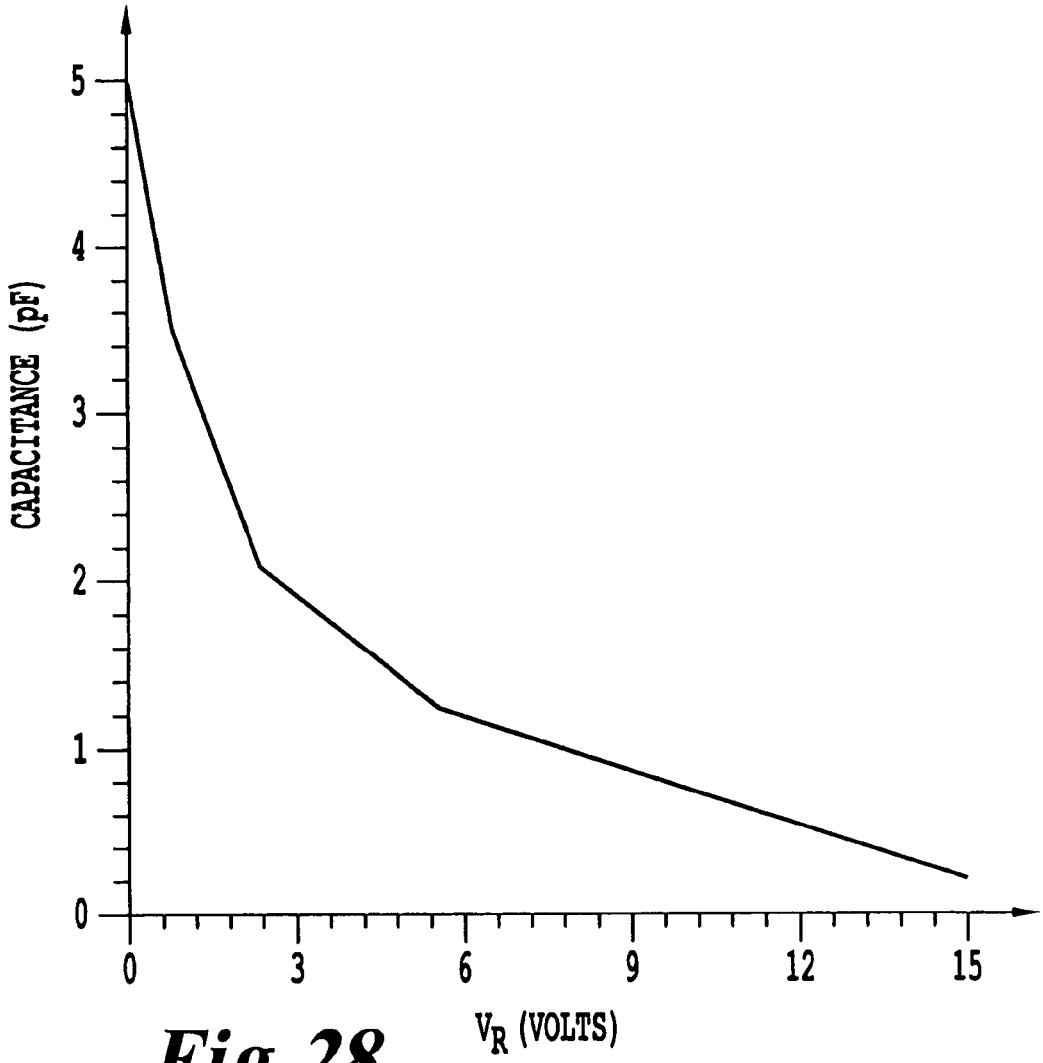
FIG. 28 shows an approximate C-V curve for the MPV diode.

FIG. 28 shows an approximate C-V curve for the MPV diode. This curve was constructed from data collected obtained from Microsemi about this diode.

Attaching the diodes to the circuit structure proved to be a very difficult task due to the small package size. Initially, soldering was attempted and a good electrical connection was achieved. Unfortunately, soldering was messy and it was uncertain what parasitics were associated with this effect, so silver epoxy, which has excellent electrical properties and is much easier to use precisely, was selected instead of solder. The silver epoxy used in this embodiment was a mixture of two different solutions.

Once the epoxy was mixed a toothpick was used to spread it to the contact area. Using tweezers, the diode was set on top of the glue such that the cathode was oriented to allow reverse bias. The entire structure was then baked at 150° C. for 2 minutes and allowed to cool. Using a digital multi-meter a proper diode connection was checked by measuring forward bias resistance, and the diode built in voltage. Often the built in voltage would measure as 0V or the forward bias resistance was 0 Ohm, hinting the epoxy has formed a short. Since the epoxy was not baked for the entire cure time, it can be easily removed using acetone and the diode placement can be started over. Once all the diodes have been placed and tested individually, the entire structure is baked at 150° C. for 4 minutes. The structure does not have to be baked, but may be cured for 4 hours at room temperature; if this is done however the electrical properties of the epoxy are often inferior.

Inductors and Biasing Circuits

In order to use the entire range of capacitances available for the varactor diodes, DC biasing of the diodes is preferred. If the bias lines are connected directly to the diodes some high frequency energy may couple to the DC the bias lines. Since the bias lines are very thin they may act as high impedance shunts or inductors resonant at high frequency.

To combat RF energy backing up into the bias lines, a small inductor may be placed in series very close to where the diode is biased. This inductor acts as a low pass filter, which prevents any high frequency energy from dissipating down the bias lines. At very low frequencies, essentially near DC, the inductor is basically a very low resistance short circuit. The inductors may be 38 gauge wire wound about a pin head and connected in series. Such a small inductor can be soldered onto the structure and glued down using nail polish or model airplane cement. The inductance of a part created in this manner may be unknown but could be easily characterized.

In a first embodiment of the design, the wound inductor technique was attempted and found to be problematic. It proved to be very difficult to solder these small parts and there was no pad designed for connection on one side. In a second embodiment, some very small packaged inductors were used. However, virtually any surface mount inductor would work in this application.

Figure 29:
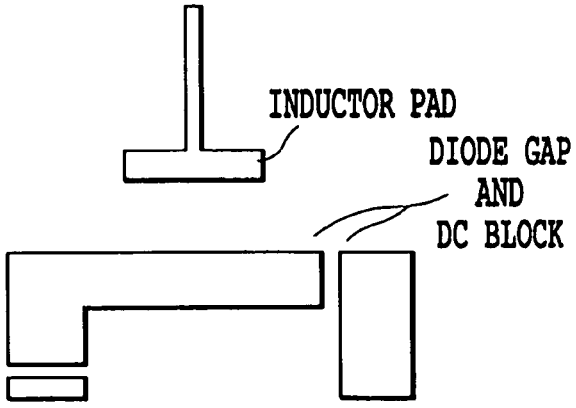
FIG. 29 shows an example pad arrangement included in a third inductor embodiment, in which packaged inductors may be connected in series to the bias lines.

FIG. 29 shows an example pad arrangement included in a third inductor embodiment, in which packaged inductors may be connected in series to the bias lines. The presence of pads made connecting the inductors very simple and was done in parallel to placement of the diodes, allowing epoxy curing through baking. This provided excellent electrical properties as well as a good clean look to the circuit. The packaged inductors in the third embodiment were 100×60 $mils^2$ in size, thus the pads were made 100×20 $mils^2$ long and 55 mils from the circuit. Characterization of the inductors revealed that the −3 dB point for the low pass filter would be about 1 KHz, far below the design center frequency of 5 GHz.

DC Blocking

Biasing varactor diodes to obtain the desired capacitance range has the unfortunate effect of placing DC voltage on the circuit.

Figure 30:
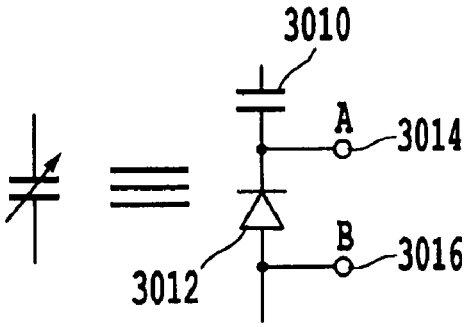
FIG. 30 is a circuit diagram of a first varactor bias embodiment.

FIG. 30 is a circuit diagram of a first varactor bias embodiment to reduce this adverse effect. In this embodiment, a fixed value capacitor 3010 may be placed before the varactor 3012 in series as shown in FIG. 30. In FIG. 30, points A 3014 and B 3016 represent points where varactor 3012 is biased. The fixed capacitor may prevent DC voltages and currents from reacting with the rest of the circuit. Since variable capacitance is needed on the interconnecting lines and stubs a more complicated approach may be needed. In biasing interconnecting varactors a capacitance can be placed before and after the varactor at points A 3014 and B 3016. Biasing in this manner may require an extra bias line, increase the number of lumped elements used, and therefore may increase parasitic effects.

Figure 31:
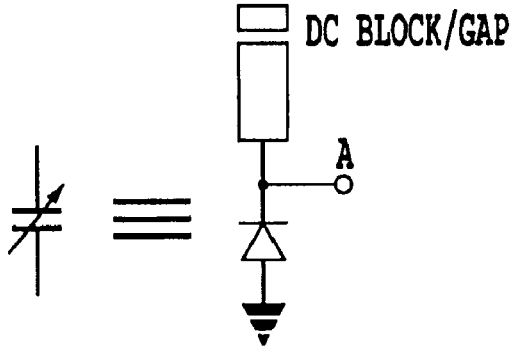
FIG. 31 is a circuit diagram of a second varactor bias embodiment.

FIG. 31 is a circuit diagram of a second varactor bias embodiment to correct problems described above with respect to the embodiment of FIG. 30.

The second embodiment proved more effective as it allowed a DC bias to flow through different parts of the circuit, not blocked by a capacitor. As was apparent in the second embodiment this had the consequence of allowing DC bias on the input and output lines of the circuit. Network analyzers do not allow DC on the RF lines and introducing this bias can damage the device. Thus, in a first alternate embodiment, small gaps were cut in the input and output lines to facilitate DC biasing of the diodes. However, the first alternate embodiment resulted in introduction of unknown capacitances, even at RF, adding undesired poles to the circuit response.

The biasing problems may be corrected by allowing gaps on the input and output lines with the use of DC blocking capacitors. DC blocking capacitors may act as virtual shorts at RF and an open at DC. Several DC blocking capacitors offer good electrical properties at the design frequency, notably the C06 capacitor from Dielelectic Laboratories. At DC this device appears as an 835 pF capacitor but at RF it has very low return loss. The package of this device made it very easy to connect to the structure, and was placed across a gap just like the diodes were.

Load Characterization

The double stub tuner is a waveguide structure that is connected using the standard BNC connectors. The load characteristics of the double stub tuner can be carefully controlled by lengthening or shortening the two stubs. It is preferred to pick a resonant point on the network analyzer, for example 5 GHz, and adjust the network analyzer calibration to only 2-3 points in this area. Once this is accomplished, one can switch to Smith Chart mode and observe the change in impedance as the stubs are made longer or shorter. Due to the good impedance properties of a double stub tuner, one was used in place of the fabricated loads. T load impedance of the double stub tuner was frequency dependent.

Nominal State

Once the loads have been set up and characterized, the matching network was tested in the 50Ω load state. To bias each diode a small test circuit was set up on the breadboard. This circuit consisted of a few potentiometers connected to a voltage source. Each potentiometer was set up at a specific reverse bias voltage, which corresponded to a capacitance value on the diode it was connected to. Initially the potentiometers had too low of impedance; if the value of one was changed it affected voltage measured across the others. It was found that using potentiometers that were about 500 KΩ or more in a voltage divider setup limited the effect on other potentiometers in the system, and biasing was easily realized.

Mismatch Detection Circuit

In a transmission line where a wave is traveling away from the source in the direction of the load, when the wave reaches the load, depending on the characteristics of the load, the wave will react. If the load impedance matches the source impedance, the wave will be totally absorbed in the load and the efficiency of the system is maximized. If however, the impedance of the load does not match that of the source, part of the wave is absorbed while part is reflected back down the transmission line towards the source.

In a transmission line the forward and backward traveling wave, denoted by their directions as to or from the load, add together. At certain points on the transmission line this additive effect of the traveling waves is in phase while at other points it is out of phase and subtractive. At points in the line where the waves are in phase a maximum voltage is obtained, while at points where they are out of phase a minimum voltage occurs. The ratio between the maximum voltage and minimum voltage is called the standing wave ratio. Ideally the standing wave ratio is unity, meaning the maximum voltage equals the minimum voltage and no standing waves are present.

Measurement of the standing wave ratio may be difficult because a standing wave ratio measurement circuit can have an effect on the standing wave ratio itself by coupling some of the energy out of the system with its loading effects. Typically this loading effect is small enough to be considered negligible and in most cases SWR meters are often left in line between a source and load in a system. Often an SWR measurement is misleading and care must be taken when interpreting the results. In a highly lossy system the measurement of reflected energy is much lower because it has traveled through the loss elements twice. This lower measured reflected energy gives an artificial voltage reading at both the high and low points and the system appears to be well matched when in fact it may not be.

The standing wave ratio (SWR) system in the automatic match control circuit of the present invention has minimal loading effect on the circuit while giving a single logical output. The losses of the impedance matching network are low enough to not cause a large effect on the measurement. It makes little difference if the SWR measurement circuitry is placed before or after the impedance matching network. If the SWR circuit is placed before the impedance matching network the forward traveling power will appear greater while the reflected power appears lower. If the SWR circuit is placed after the impedance matching network the forward traveling power will appear lower while the reflected power appears greater. If it assumed that the losses within the impedance matching network are negligible the SWR should be the same no matter where on the line it is placed, for now we will proceed with this premise but revise it later.

Measurement of the forward and backward traveling waves directly from the transmission line can have bad loading effects on the circuit. The measurement circuitry becomes parallel to the system load and the standing wave ratio can be affected by the act of measurement.

In a first embodiment of a measurement circuit a SWR bridge is connected directly to the transmission line.

Figure 32:
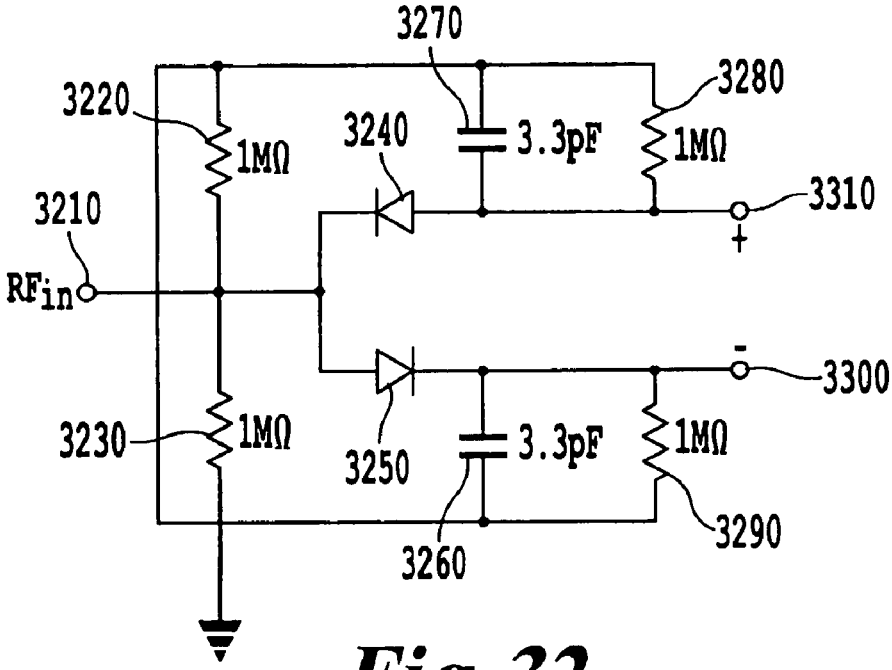
FIG. 32 is a an example circuit diagram for the first embodiment of the measurement circuit.

FIG. 32 is a an example circuit diagram for the first embodiment of the measurement circuit including input $RF_{in}$ 3210, resistors 3220, 3230, 3280, and 3290, diodes 3240, 3250, capacitors 3260 and 3270, and outputs 3300 and 3310. Since the impedance of the bridge is high it does not have a significant parallel loading effect on the entire system and doesn't affect the standing wave ratio itself. Each branch partially rectifies the forward and backward traveling wave and then uses the difference between the two to form the standing wave ratio. Due to the high impedance of this circuit the capacitors on each branch charges and discharges very slowly. However, this slow rate gives rise to a hysteresis effect and the circuit is not able to rapidly show changes in the standing wave ratio. A way to combat the hysteresis would be to decrease the impedance of the circuit, but that would cause a parallel load effect with the overall system load. Alternatively, it may be preferable to measure the standing wave ratio from an isolated circuit.

Measurement Circuit with No Loading Effects

In a second embodiment of a standing wave ratio measurement circuit a small amount of forward and backward traveling energy is coupled off of the system and measured.

Figure 33:
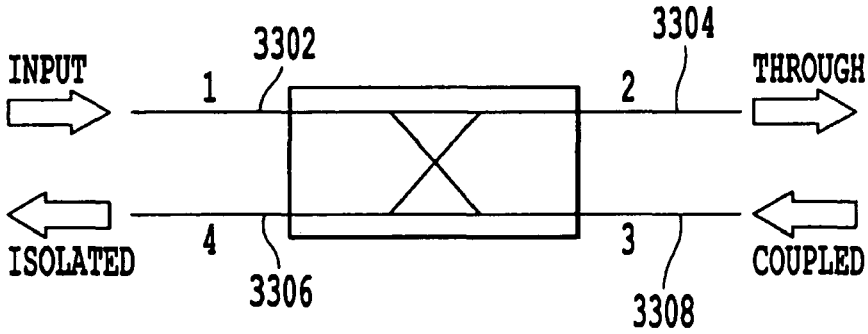
FIG. 33 is a block diagram of a four port coupler used to couple some of the forward and backward traveling energy.

FIG. 33 is a block diagram of a four port coupler used to couple some of the forward and backward traveling energy. In the forward sense a small fraction of energy from port 1 3302 travels out of port 3 3308 while the majority travels unabated through port 2 3304. Port 4 3306 is called the isolated port because no energy from port 1 3302 shows up there. In the backward sense port 2 3304 becomes port 1 3302 and port 3 3304 becomes port 4 3306. At the standard port numbering scheme, backward coupled energy can be measured at port 4 3306 while forward coupled energy can be measured at port 3 3308. Ideally the amount of energy coupled to other ports would be very small, having a negligible impact on the traveling power, but still large enough to measure. The coupling factor relates the power given to the coupled port from the input port while the isolation relates the power at the isolated port coupled from the input port, as described in Pozar.

$$C = 10\log\frac{P_1}{P_3} = -20\log|S_{13}| \tag{74}$$

$$I = 10\log\frac{P_1}{P_4} = -20\log|S_{14}| \tag{75}$$

Design of a microstrip four port coupler can be accomplished by:

$$Z_{oe} = Z_0\sqrt{\frac{1+C}{1-C}} \tag{76}$$

$$Z_{0o} = Z_0\sqrt{\frac{1-C}{1+C}} \tag{77}$$

Figure 34:
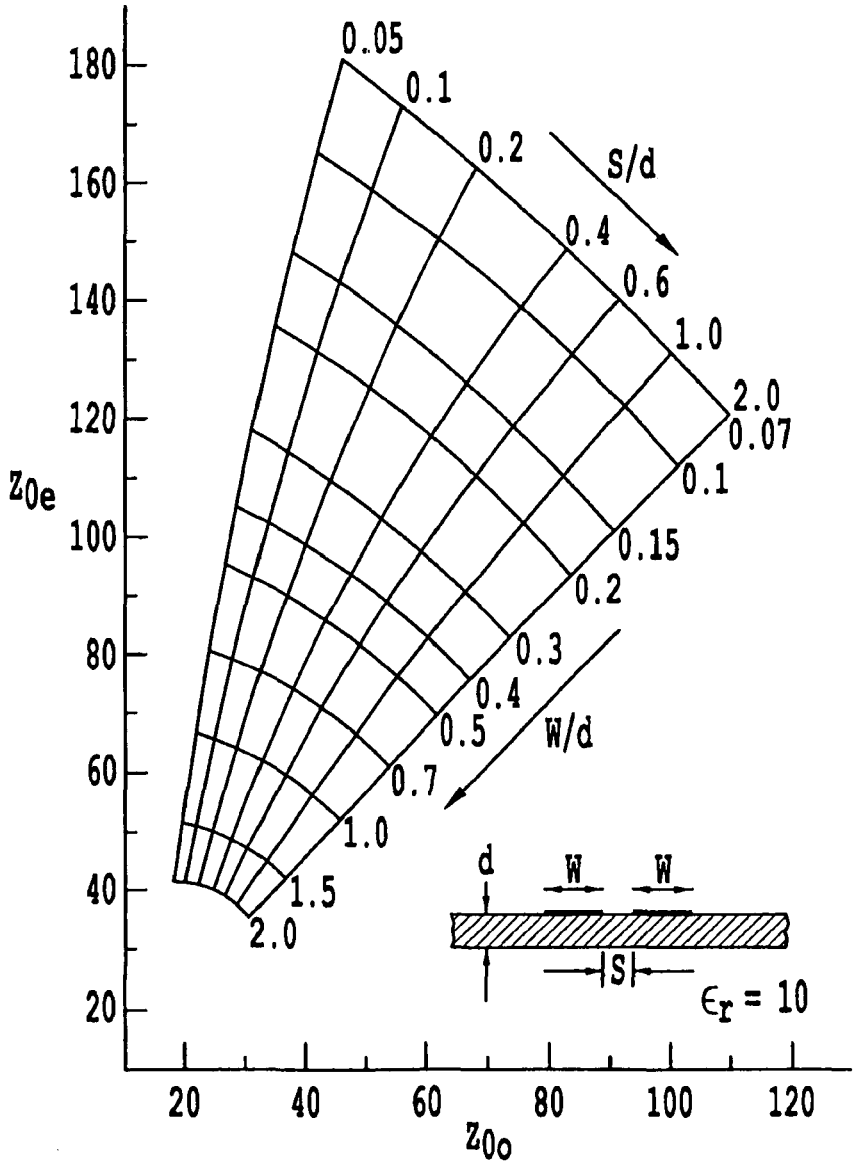
FIG. 34 is a plot of even and odd mode impedances for coupled microstrip lines.

FIG. 34 is a plot of even and odd mode impedances for coupled microstrip lines, as described by Pozar. Using FIG. 34 with $Z_{0o}$=45.23Ω and $Z_{0e}$=55.28Ω yields $$\frac{W}{d} = 1.0$$

and $$\frac{S}{d} = 1.0$$

After the forward and backward waves have been coupled from the transmission line it is time to create a ratio of the voltages between them. Using a diode the waves are semi-rectified and clamped at their maximum voltage by the capacitor. One can pick a capacitance value of sufficient size such that the effect of a ripple can be reduced to a percentage of the peak waveform.

$$C_{val} = \frac{1}{V_{rat} f_0 R} \tag{78}$$

Where $V_{rat}$ represents the peak ratio between the magnitude of the ripple and the peak voltage and R is the resistance of shunt resistance. Once the forward and backward waves are rectified and clamped the maximum voltage is available is available for measurement. Since $$P = \frac{V^2}{R}$$

with R=50Ω the forward and backward power can be computed. However, in this circuit the detector may only detect non-reactive load impedances. If the load is reactive the forward and backward voltages are measured the same as in the real case, but the power may be calculated incorrectly since reactive loads do not dissipate any power. In reactive loads the current and voltage are out of phase by 90 degrees, thus there is no real power dissipated. Thus, it may be difficult to measure voltages using the circuits in FIG. 35 or 36.

However, to measure SWR correctly, both current and voltage should be taken into account when calculating forward and backward power. In order to detect both current and voltage in an RF system either two transformers or two couplers may preferably be used. Taking the isolated and coupled ports and connecting them together using a resistance proportional to the resistance of the coupler, one can rectify the waveform at one end and get a voltage representation of the RF current.

Combining the voltage and current measurement circuits together can give a fairly good measurement of the standing wave ratio.

Figure 35:
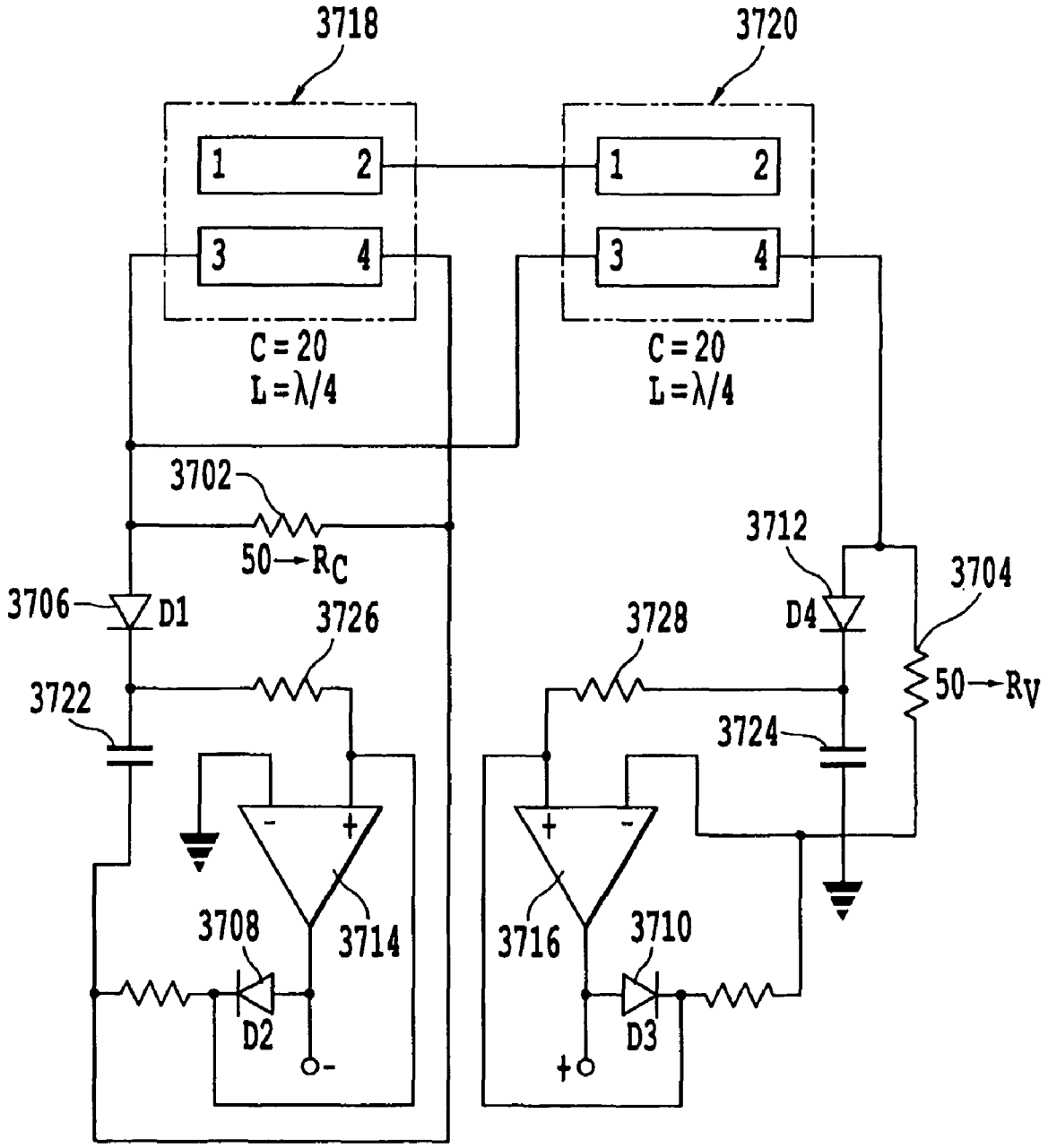
FIG. 35 is a circuit diagram of an embodiment of a SWR measurement circuit according to the present invention.

FIG. 35 is a circuit diagram of an embodiment of SWR measurement circuit combining the advantageous features of the voltage and current measurement circuits above. In this embodiment, $R_C$ 3702 represents the current sensing resistor. Since one end of $R_C$ 3702 is connected to ground, the high end represents the forward power. The voltage from the right coupler 3720 connected to $R_V$ 3704 subtracts from the output from the current sensing resistor. Since $R_C$ 3702 and $R_V$ 3704 are equal, there is no incident RF energy across $R_V$ 3704, and the voltage across it represents the reflected power.

Consider the circuit connected with no load impedance. In this case the RF current is 0 so there is nothing contributed from the left coupler 3718. The voltage contributing to the output of the circuit is from the right coupler 3720. Since the voltage is divided between $R_C$ 3702 and $R_V$ 3704 equally, the forward output is equal to the reflected input, a condition of infinite SWR.

If the load impedance is shorted to ground, the output voltage is zero but there is a large amount of current flowing through $R_C$ 3702. The left coupler 3718 will distribute this voltage created by the current equally between $R_C$ 3702 and $R_V$ 3704, again hinting the SWR is infinite. Note that in building this circuit it may be preferable to use Schottky diodes for diodes D1-D4 3706-3712 as Schottky diodes have small barrier voltages and typically have faster switching times. The Op-Amp compensation stages 3714 and 3716 allow the circuit to work at very low power and the diodes D2 3708 and D3 3710 on this stage should preferably match the diodes D1 3706 and D4 3712 used in the half wave rectifying input stage. The left coupler 3718 and right coupler 3720 may each be implemented as a microstrip transmission line directional coupler with C=20 and L=λ/4, for example. Also included in the present embodiment are capacitors 3722 and 3724, and resistors 3726 and 3728.

The output to the SWR circuit is non-linear since the contributing current and voltages terms were subtracted. To get the actual SWR an easy calculation must be made. If the load is represented as a complex impedance $Z_L=R_L+jX_L$ then let $$\rho = \sqrt{\frac{(50 - R_L)^2 + X_L^2}{(50 + R_L)^2 + X_L^2}} \tag{79}$$

$$SWR = \frac{\rho + 1}{\rho - 1} \tag{80}$$

where the SWR is a magnitude value.

A novel moderate bandwidth reconfigurable network has been presented. This network advantageously allows reconfiguration device operation. A new approach using a cost function to determine the quality of an impedance matching network is also described. The cost function may also optimize the performance of the reconfigurable matching network by using the synthesized structure as a starting point. The reconfigurable impedance matching network has been extensively simulated, manufactured, and tested and has been shown to match a continuous range of loads. This represents an improvement beyond conventional impedance matching networks, which may be constrained to low bandwidth and discrete load tuning.

Methods that have been presented in development of a reconfigurable network based on an intelligent RF front end system.

Standing wave ratio sensing is the central information-providing component in an impedance matching intelligent RF front end. A simple and highly passive circuit is presented to detect the standing wave ratio. The SWR matching circuit can be altered using a reconfigurable tuner on the outputs of the coupler to provide information about the entire pass-band of the system. This information can be used by a microprocessor-based device to provide biasing information to the reconfigurable tuner, possibly with use of the cost function.

Further, in the description above, it was assumed that loading a tuning element such as a varactor on the end of a resonator consisted of a capacitor in parallel with an inductor, and this circuit in series with another capacitor. However, as noted by A. R. Brown et al., "A Varactor Tuned RF Filter," submitted for review to *IEEE Trans. Microwave Theory and Techniques*, October 1999, which is incorporated herein by reference in its entirety, although the loading of a varactor on the end of a resonator appears to be a series combination, it is mathematically equivalent to a parallel combination.

$$z_{res+var} = \frac{Z_{res} Z_{var}}{Z_{res} + Z_{var}} \tag{81}$$

$Z_{res}$ is the impedance calculated for each stub or interconnect.

$$Z_{var} = \frac{1}{j\omega C} \tag{82}$$

Varactor series resistance is neglected in each of equations (81) and (82).

Considering this and setting $Z_{res+var}$ equal the calculated impedance for a stub or interconnect, and knowing the calculated impedance $Z_{var}$ for a varactor diode in the nominal state, one can calculate the new impedance for the resonator. This impedance in parallel with the impedance of the diode in nominal state should equal the calculated value in the design equations. Simulation results show that this provides nearly an ideal starting point for the matching circuit before ADS optimization as described above.

Numerous modifications and variations of the present invention are possible in light of the above teachings. It is therefore to be understood that within the scope of the appended claims, the invention may be practiced otherwise than as specifically described herein.

The invention claimed is:

1. An impedance matching apparatus for matching an impedance of a source to an impedance of a load, the apparatus comprising:

a mismatch detection circuit connected to the load and configured to receive information regarding the impedance of the source, determine the impedance of the load, and produce a difference between the source and load impedances, each of the source and load impedances varying based on an operating frequency;

a match network controller configured to receive the difference between the source and load impedances from the mismatch detection circuit and produce a control value based on the difference; and a matching network including a plurality of resonant elements, each of the plurality of resonant elements resonating with respect to a different frequency, at least one of the plurality of resonant elements being controlled based on the control value to resonate at the operating frequency such that the matching network produces an impedance that matches the impedance of the source to the impedance of the load.

2. The apparatus of claim 1, wherein the mismatch detection circuit further comprises:

a first four port coupler including a first input port connected to the source, a first through port, a first coupled port, and a first isolated port;

a second four port coupler including a second input port connected to the first through port of the first four port coupler, a second through port connected to the load, a second coupled port, and a second isolated port connected to the first isolated port of the first four port coupler;

a current sensing resistor having a first end connected to the isolated port of the first four port coupler, the isolated port of the second four port coupler, and an anode of a first input diode;

the first input diode having a cathode connected to a first end of a first capacitor and a first end of a first input resistor;

the first capacitor having a second end connected to ground;

the first input resistor having a second end connected to a non-inverting input of a first operational amplifier, a cathode of a first output diode, and a first end of a first output resistor;

the first output diode having an anode connected to an output of the first operational amplifier;

the first operational amplifier having a non-inverting input connected to ground;

the first output resistor having a second end connected to ground;

a second input diode having an anode connected to the second coupled port of the second four port coupler and a first end of a voltage sensing resistor, and a cathode connected to a first end of a second capacitor and a first end of a second input resistor;

the voltage sensing resistor having a second end connected to ground;

the second capacitor having a second end connected to ground;

the second input resistor having a second end connected to a non-inverting input of a second operational amplifier, a first end of a second output resistor, and a cathode of a second output diode;

the second output diode having an anode connected to an output of the second operational amplifier;

the second output resistor having a second end connected to ground; and the second operational amplifier having an inverting input connected to ground, wherein a voltage difference between the outputs of the first and second operational amplifiers represents the magnitude of the impedance difference.

3. The apparatus of claim 1, wherein the matching network further includes at least one varactor configured to be controlled by the control value from the match network controller, to vary a capacitance of the at least one varactor.

4. The apparatus of claim 3, wherein at least one of the at least one varactor is mounted on each of the plurality of resonant elements, at least one of the plurality of resonant elements being a stub.

5. The impedance matching apparatus of claim 3, wherein the at least one varactor is positioned at an end of at least one of the plurality of resonant elements.

6. The apparatus of claim 1, wherein the plurality of resonant elements are shunt resonant stubs each having a varactor, and the control value includes a varactor control voltage for controlling the varactor in each of the shunt resonant stubs.

7. The apparatus of claim 6, wherein the shunt resonant stubs are symmetrically arranged around a central resonator located in between the source and the load.

8. The impedance matching apparatus of claim 6, wherein the plurality of resonant elements are formed in a microstrip transmission line having a plurality of discontinuities, and the plurality of resonant elements are capacitatively coupled.

9. The impedance matching apparatus of claim 6, wherein the impedance produced by the matching network changes at a rate based on a number of the plurality of resonant elements.

10. An impedance matching apparatus for matching an impedance of a source to an impedance of a load, the apparatus comprising:

a mismatch detection circuit connected to the load and configured to receive information regarding the impedance of the source, determine the impedance of the load, and produce a difference between the source impedance and the load impedance, each of the source impedance and the load impedance varying based on an operating frequency;

a match network controller configured to receive the difference between the source and the load impedance from the mismatch detection circuit and produce a control value based on the difference; and means for varying an impedance, connected between the source and the load, that resonates with respect to any one of a plurality of frequencies and is controlled based on the control value to resonate at the operating frequency to produce the impedance that matches the source impedance with the load impedance.

11. An impedance matching apparatus for matching an impedance of a source to an impedance of a load, the apparatus comprising:

a mismatch detection circuit connected to the load and configured to receive information regarding the impedance of the source, determine the impedance of the load, and produce a difference between the source and load impedances;

a match network controller configured to receive the difference between the source and load impedances from the mismatch detection circuit and produce a control value based on the difference; and a matching network including at least one variable capacitative element mounted on at least one of a plurality of resonant elements, the plurality of resonant elements being stubs, the at least one variable capacitative element being configured to be controlled by the control value to vary a capacitance of the at least one variable capacitative element, which produces a continuously variable impedance, that is used to match the impedance of the source to the impedance of the load.

* * * * *